US010617905B2

(12) United States Patent
Moran et al.

(10) Patent No.: US 10,617,905 B2
(45) **Date of Patent: *Apr. 14, 2020**

(54) ADJUSTABLE DUMBBELL SYSTEM HAVING A WEIGHT SENSOR

(71) Applicant: NAUTILUS, INC., Vancouver, WA (US)

(72) Inventors: Thomas H. Moran, Portland, OR (US); Jason Pharis Petersen, Ridgefield, WA (US); Marcus L. Marjama, Vancouver, WA (US); Todd D. Anderson, Vancouver, WA (US); Peter L. Crabb, Vancouver, WA (US); Glen A. Wooldridge, Vancouver, WA (US); PJ M. Bush, Vancouver, WA (US)

(73) Assignee: Nautilus, Inc., Vancouver, WA (US)

( * ) Notice: Subject to any disclaimer, the term of this patent is extended or adjusted under 35 U.S.C. 154(b) by 138 days.

This patent is subject to a terminal disclaimer.

(21) Appl. No.: 15/722,513

(22) Filed: Oct. 2, 2017

(65) Prior Publication Data

US 2018/0036578 A1 Feb. 8, 2018

Related U.S. Application Data

(63) Continuation of application No. 14/311,228, filed on Jun. 20, 2014, now Pat. No. 9,776,032.

(51) Int. Cl.
*A63B 21/075* (2006.01)
*A63B 21/072* (2006.01)
(Continued)

(52) U.S. Cl.
CPC ..... *A63B 21/075* (2013.01); *A63B 21/063* (2015.10); *A63B 21/0724* (2013.01);
(Continued)

(58) Field of Classification Search
CPC ..... A63B 21/0004; A63B 21/00058; A63B 21/00061; A63B 21/00069;
(Continued)

(56) References Cited

U.S. PATENT DOCUMENTS 5,464,379 A 11/1995 Zarecky
5,857,939 A 1/1999 Kaufman
(Continued)

FOREIGN PATENT DOCUMENTS

EP 2586502 A1 5/2013
JP 2005528960 A 9/2005
(Continued)

OTHER PUBLICATIONS

European Patent Office, "PCT International Search Report for PCT/US2014/059189", dated Mar. 13, 2015, 3 Pages.
(Continued)

*Primary Examiner* — Gary D Urbiel Goldner
(74) *Attorney, Agent, or Firm* — Dorsey & Whitney LLP

(57) ABSTRACT

An adjustable dumbbell system may include a handle assembly, at least one weight, at least one sensor, and a computing device. The at least one weight may be selectively fixedly connectable to the handle assembly. The at least one sensor may be positioned on the handle assembly. The at least one sensor may be configured to detect a handle assembly attribute indicative of whether the at least one weight is fixedly connected to the handle assembly. The computing device may be in communication with the at least one sensor and may be configured to receive information regarding the handle assembly attribute from the at least one sensor.

18 Claims, 42 Drawing Sheets

(51) Int. Cl.

| | |
|---|---|
| ***A63B 71/00*** | (2006.01) |
| ***A63B 71/06*** | (2006.01) |
| ***A63B 24/00*** | (2006.01) |
| ***A63B 21/062*** | (2006.01) |
| ***A63B 21/00*** | (2006.01) |

(52) U.S. Cl.

CPC ..... *A63B 21/0726* (2013.01); *A63B 21/0728* (2013.01); *A63B 24/0087* (2013.01); *A63B 71/0036* (2013.01); *A63B 71/0619* (2013.01); *A63B 21/00065* (2013.01); *A63B 2071/068* (2013.01); *A63B 2209/08* (2013.01); *A63B 2220/13* (2013.01); *A63B 2220/16* (2013.01); *A63B 2220/40* (2013.01); *A63B 2220/52* (2013.01); *A63B 2220/803* (2013.01); *A63B 2220/89* (2013.01); *A63B 2225/20* (2013.01); *A63B 2225/30* (2013.01); *A63B 2225/50* (2013.01)

(58) Field of Classification Search

CPC ..... A63B 21/00072; A63B 21/00076; A63B 21/062; A63B 21/0622; A63B 21/0624; A63B 21/0626; A63B 21/0628; A63B 21/063; A63B 21/0632; A63B 21/072; A63B 21/0724; A63B 21/0726; A63B 21/0728; A63B 21/075; A63B 21/4033; A63B 21/4035; A63B 21/4041; A63B 21/4043; A63B 21/4045; A63B 24/0087; A63B 71/0036; A63B 71/0619; A63B 71/0622; A63B 2071/065; A63B 2071/0675; A63B 2071/0694; A63B 2209/00; A63B 2209/08; A63B 2210/00; A63B 2210/50; A63B 2220/10; A63B 2220/13; A63B 2220/16; A63B 2220/40; A63B 2220/50; A63B 2220/51; A63B 2220/52; A63B 2220/58; A63B 2220/80; A63B 2220/801; A63B 2220/803; A63B 2220/805; A63B 2220/83; A63B 2220/833; A63B 2225/09; A63B 2225/093; A63B 2225/15; A63B 2225/20; A63B 2225/30; A63B 2225/305; A63B 2225/50; A63B 2225/52; A63B 2225/54; A63B 2244/09

See application file for complete search history.

(56) References Cited

U.S. PATENT DOCUMENTS

| | | | | |
|---|---|---|---|---|
| 6,033,350 | A | 3/2000 | Krull | |
| D422,654 | S | 4/2000 | Chen | |
| 6,059,576 | A | 5/2000 | Brann | |
| 6,099,442 | A | 8/2000 | Krull | |
| 6,261,022 | B1 | 7/2001 | Dalebout et al. | |
| 6,322,481 | B1 | 11/2001 | Krull | |
| 6,402,666 | B2 | 6/2002 | Krull | |
| 6,416,446 | B1 | 7/2002 | Krull | |
| 6,500,101 | B1 | 12/2002 | Chen | |
| 6,540,650 | B1 | 4/2003 | Krull | |
| 6,629,910 | B1 | 10/2003 | Krull | |
| 6,669,606 | B2 | 12/2003 | Krull | |
| 6,679,816 | B1 | 1/2004 | Krull | |
| 6,719,674 | B2 | 4/2004 | Krull | |
| 6,733,424 | B2 | 5/2004 | Krull | |
| 6,746,381 | B2 | 6/2004 | Krull | |
| 6,749,547 | B2 | 6/2004 | Krull | |
| 6,793,607 | B2 | 9/2004 | Neil | |
| D498,272 | S | 11/2004 | Sanford-Schwentke et al. | |
| D500,820 | S | 1/2005 | Krull | |
| 6,855,097 | B2 | 2/2005 | Krull | |
| 6,872,173 | B2 | 3/2005 | Krull | |
| 6,896,645 | B1 | 5/2005 | Krull | |
| 6,899,661 | B1 | 5/2005 | Krull | |
| D508,628 | S | 8/2005 | Crawford et al. | |
| 6,949,052 | B2 | 9/2005 | Millington et al. | |
| 6,974,405 | B2 | 12/2005 | Krull | |
| 6,997,856 | B1 | 2/2006 | Krull | |
| 7,060,011 | B1 | 6/2006 | Krull | |
| 7,066,867 | B2 | 6/2006 | Krull | |
| 7,077,790 | B1 | 7/2006 | Krull | |
| D528,173 | S | 9/2006 | Flick et al. | |
| D528,611 | S | 9/2006 | Flick et al. | |
| 7,128,696 | B1 | 10/2006 | Krull | |
| 7,128,697 | B1 | 10/2006 | Krull | |
| 7,137,931 | B2 | 11/2006 | Liu | |
| 7,153,243 | B1 | 12/2006 | Krull | |
| D540,405 | S | 4/2007 | Crawford et al. | |
| D540,894 | S | 4/2007 | Crawford et al. | |
| 7,223,214 | B2 | 5/2007 | Chen | |
| 7,261,678 | B2 | 8/2007 | Crawford | |
| 7,264,578 | B1 | 9/2007 | Krull | |
| 7,291,098 | B1 | 11/2007 | Krull | |
| 7,300,390 | B1 | 11/2007 | Krull | |
| 7,387,597 | B2 | 6/2008 | Krull | |
| 7,452,312 | B2 | 11/2008 | Liu | |
| 7,470,216 | B2 | 12/2008 | Farinelli et al. | |
| D584,086 | S | 1/2009 | Gettle | |
| 7,485,077 | B2 | 2/2009 | Chen | |
| 7,497,813 | B1 | 3/2009 | Krull | |
| 7,497,814 | B1 | 3/2009 | Krull | |
| 7,520,845 | B2 | 4/2009 | Towley | |
| 7,547,268 | B1 | 6/2009 | Krull | |
| 7,549,952 | B2 | 6/2009 | Towley et al. | |
| 7,578,771 | B1 | 8/2009 | Towley, III et al. | |
| 7,588,520 | B2 | 9/2009 | Nalley | |
| 7,604,577 | B2 | 10/2009 | Lin | |
| 7,608,021 | B1 | 10/2009 | Nalley | |
| 7,614,982 | B2 | 11/2009 | Crawford et al. | |
| 7,614,983 | B1 | 11/2009 | Krull | |
| 7,621,855 | B1 | 11/2009 | Krull | |
| 7,625,322 | B1 | 12/2009 | Krull | |
| 7,648,448 | B2 | 1/2010 | Krull | |
| D610,636 | S | 2/2010 | Golesh et al. | |
| 7,678,030 | B2 | 3/2010 | Savage | |
| 7,704,197 | B2 | 4/2010 | Yu | |
| D617,854 | S | 6/2010 | Gettle | |
| 7,794,359 | B1 | 9/2010 | Lannon et al. | |
| 7,874,958 | B1 | 1/2011 | Ramsey, Sr. | |
| D639,358 | S | 6/2011 | Rauwerdink | |
| D639,359 | S | 6/2011 | Rauwerdink | |
| 7,981,012 | B1 | 7/2011 | Krull | |
| D643,481 | S | 8/2011 | Rauwerdink | |
| 8,002,680 | B2 | 8/2011 | Crawford et al. | |
| 8,007,415 | B1 | 8/2011 | Lundquist | |
| 8,038,576 | B2 | 10/2011 | Farinelli et al. | |
| 8,075,458 | B2 | 12/2011 | Nalley | |
| 8,105,207 | B1 | 1/2012 | Lannon et al. | |
| 8,105,209 | B2 | 1/2012 | Lannon et al. | |
| 8,217,797 | B2 | 7/2012 | Ikoyan | |
| 8,287,438 | B2 | 10/2012 | Krull | |
| 8,337,364 | B2 | 12/2012 | Ishii et al. | |
| 8,747,282 | B2 | 6/2014 | Lannon et al. | |
| 8,749,380 | B2 | 6/2014 | Vock et al. | |
| 8,913,134 | B2 | 12/2014 | Goree et al. | |
| 8,932,188 | B2 | 1/2015 | Svenberg | |
| D737,907 | S | 9/2015 | Flick | |
| 9,162,102 | B1 | 10/2015 | Eder et al. | |
| D743,713 | S | 11/2015 | Flick | |
| D753,247 | S | 4/2016 | Flick | |
| 9,327,159 | B1 | 5/2016 | Medina | |
| 9,375,602 | B2 * | 6/2016 | Krull | A63B 21/0724 |
| 9,604,092 | B2 * | 3/2017 | Krull | A63B 21/0724 |
| 9,776,032 | B2 * | 10/2017 | Moran | A63B 21/075 |
| 9,814,922 | B2 * | 11/2017 | Moran | A63B 21/075 |
| 10,195,477 | B2 * | 2/2019 | Marjama | A63B 71/0036 |
| 2002/0128127 | A1 | 9/2002 | Chen | |
| 2003/0148862 | A1 | 8/2003 | Chen et al. | |
| 2003/0207740 | A1 | 11/2003 | Fenelon et al. | |
| 2004/0067826 | A1 | 4/2004 | Elledge | |

(56) References Cited

U.S. PATENT DOCUMENTS

| | | | |
|---|---|---|---|
| 2004/0162198 | A1 | 8/2004 | Towley et al. |
| 2005/0065003 | A1 | 3/2005 | Klotzki |
| 2005/0227831 | A1 | 10/2005 | Mills et al. |
| 2005/0233873 | A1 | 10/2005 | Chen |
| 2006/0084422 | A1 | 4/2006 | Huang et al. |
| 2007/0184945 | A1 | 8/2007 | Lin |
| 2008/0026921 | A1 | 1/2008 | Liu |
| 2008/0064575 | A1 | 3/2008 | Towley |
| 2009/0186748 | A1 | 7/2009 | Golesh et al. |
| 2009/0197745 | A1 | 8/2009 | Olson |
| 2010/0184570 | A1 | 7/2010 | Cheng |
| 2010/0304938 | A1 | 12/2010 | Olson |
| 2010/0323856 | A1 | 12/2010 | Svenberg et al. |
| 2011/0028285 | A1 | 2/2011 | Towley |
| 2011/0092345 | A1 | 4/2011 | Svenberg et al. |
| 2012/0021877 | A1 | 1/2012 | Lundquist et al. |
| 2012/0115689 | A1 | 5/2012 | Dalebout et al. |
| 2012/0264575 | A1 | 10/2012 | Towley et al. |
| 2012/0309597 | A1 | 12/2012 | Liu |
| 2013/0065730 | A1 | 3/2013 | Camerota |
| 2013/0090212 | A1 | 4/2013 | Wang |
| 2013/0171599 | A1 | 7/2013 | Bleich et al. |
| 2013/0288859 | A1 | 10/2013 | Watterson |
| 2014/0210218 | A1 | 7/2014 | Eder et al. |
| 2014/0235409 | A1 | 8/2014 | Salmon et al. |
| 2014/0243168 | A1 | 8/2014 | Razzaq |
| 2014/0248996 | A1 | 9/2014 | Adel |
| 2014/0274596 | A1 | 9/2014 | Krull |
| 2014/0349820 | A1 | 11/2014 | Wang |
| 2015/0360073 | A1 | 12/2015 | Moran et al. |
| 2015/0367163 | A1 | 12/2015 | Moran et al. |
| 2016/0184623 | A1* | 6/2016 | Moran ..... A63B 21/075 482/8 |
| 2016/0250510 | A1* | 9/2016 | Krull ..... A63B 21/0724 482/8 |
| 2017/0001061 | A1 | 1/2017 | Marjama |

FOREIGN PATENT DOCUMENTS

| | | | |
|---|---|---|---|
| WO | 2009013679 | A2 | 1/2009 |
| WO | 2009070083 | A1 | 6/2009 |
| WO | 2013151770 | A1 | 10/2013 |

OTHER PUBLICATIONS

European Patent Office, "PCT Written Opinion for PCT/US2014/059189", dated Mar. 6, 2015, 5 Pages.

United States Patent and, Trademark Office, "International Search Report and Written Opinion dated Jan. 14, 2015, for PCT/US2014/059075", 8 Pages.

United States Patent and, Trademark Office, "International Search Report and Written Opinion", International Search Report and Written Opinion dated Jan. 15, 2015, for PCT/US14/59192, 10 Pages.

* cited by examiner

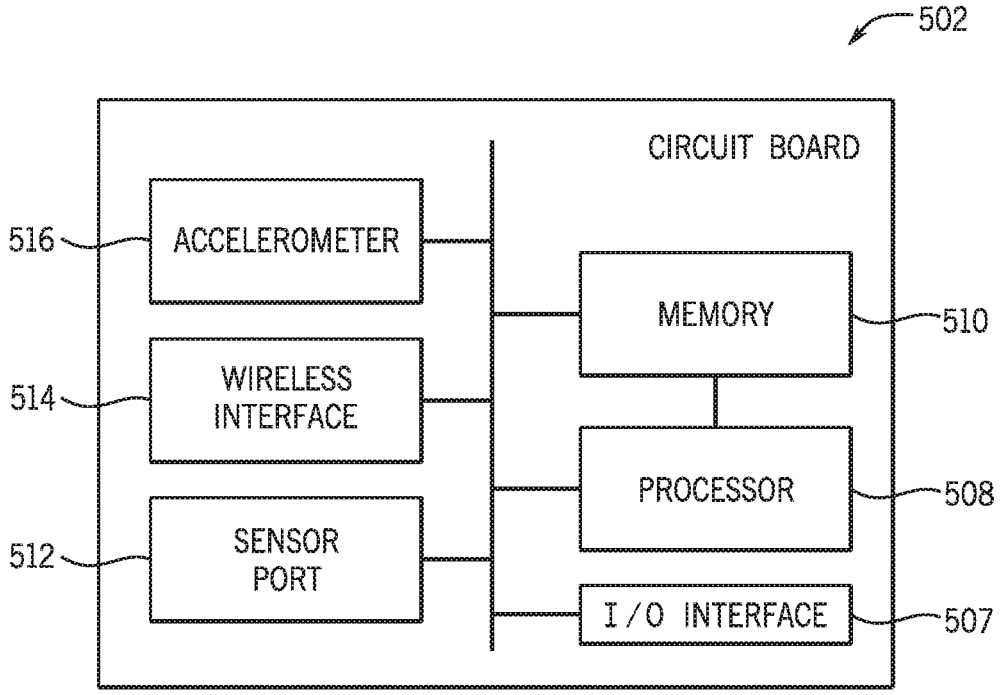
FIG. 46
FIG. 47
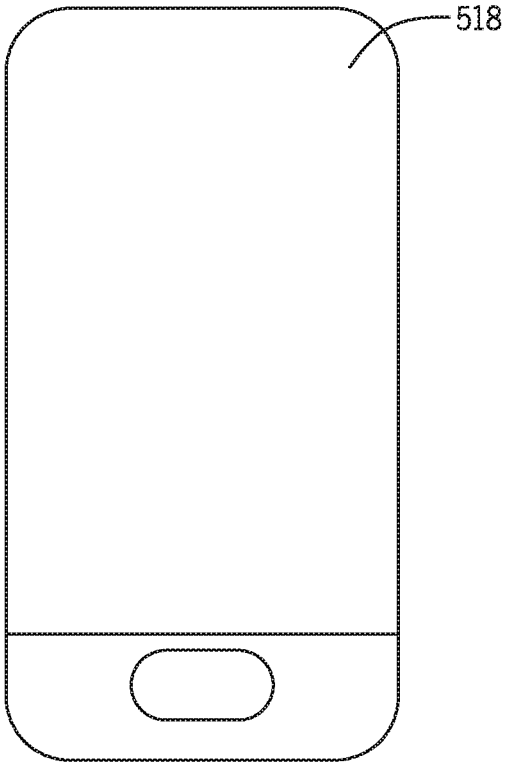

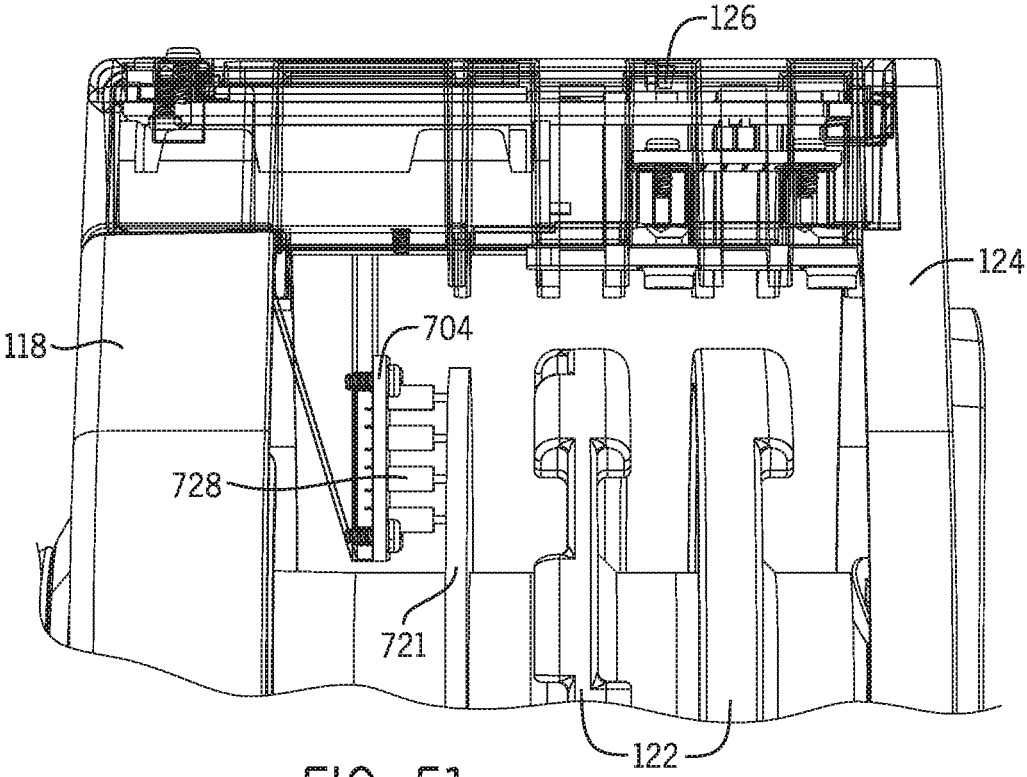
FIG. 51
FIG. 52
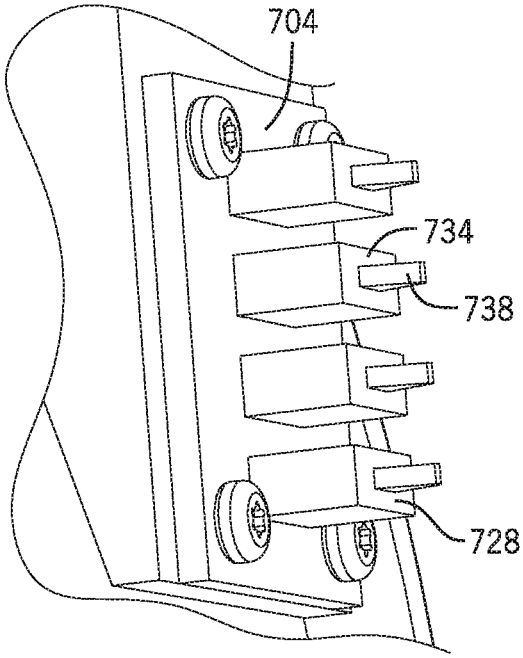

ADJUSTABLE DUMBBELL SYSTEM HAVING A WEIGHT SENSOR

CROSS REFERENCE TO RELATED APPLICATIONS

This application is a continuation of U.S. patent application Ser. No. 14/311,228, entitled "Adjustable Dumbbell System Having a Weight Sensor", and filed on Jun. 20, 2014, which is hereby incorporated by reference herein in its entirety for all purposes.

FIELD

The present disclosure relates generally to an adjustable dumbbell system, and more specifically to an adjustable dumbbell system with a weight sensor.

BACKGROUND

Dumbbells are widely used exercise devices for providing resistance training in a wide variety of exercises such as bicep curls, bench presses, shoulder presses, triceps extensions, and the like. Due to the number of exercises that may be performed with dumbbells, users often need many different dumbbells, each with different weights, to perform an exercise routine. Traditional dumbbells are somewhat inconvenient to use because each time one desires to change the weight of the dumbbell, the user either has to select a heavier dumbbell, or disassemble the dumbbell he is using and change the weight. A single adjustable dumbbell allows a user to perform a varied exercise routine without requiring a large number of different weight dumbbells.

In response to these issues, dumbbells have been designed that allow the weight to be changed on a single dumbbell. These adjustable dumbbells typically are delineated into lighter weight adjustable dumbbells and heavier weight adjustable dumbbells due to length and weight-increment constraints. The lighter weight adjustable dumbbells typically have reasonable weight increments between weight settings and a reasonable overall length, but have a limited overall weight range. The heavier weight adjustable dumbbells have a larger overall weight range, but typically have relatively large weight increments between weight settings to maintain a reasonable overall length of the dumbbell.

SUMMARY

In a first aspect, an adjustable dumbbell system is disclosed. The adjustable dumbbell system may include a handle assembly, at least one weight, at least one sensor, and a computing device. The at least one weight may be selectively fixedly connectable to the handle assembly. The at least one sensor may be positioned on the handle assembly, and the at least one sensor may be configured to detect a handle assembly attribute indicative of whether the at least one weight is fixedly connected to the handle assembly. The computing device may be in communication with the at least one sensor, and the computing device may be configured to receive information regarding the handle assembly attribute from the at least one sensor.

In some examples, the at least one weight may include two or more weights. The handle assembly may include a disc that is rotatable into a set of discrete rotational positions. Each rotational position may correspond to a different combination of the two or more weights fixedly connected to the handle assembly. The at least one sensor may be configured to detect the rotational position of the disc, and the computing device may be configured to determine which of the two or more weights are fixedly connected to the handle assembly based on the rotational position detected by the at least one sensor. The at least one sensor may include at least one of the following: an optical sensor, a reflective sensor, a mechanical sensor, an inductive sensor, a capacitive sensor, a potentiometer, an accelerometer, or a magnetometer.

In some examples, the at least one sensor may be positioned on the handle assembly so as to remain in a fixed position relative to the rotation of the disc.

Some examples additionally include a rotational position encoding feature arranged on the disc so as to encode each of two or more disc sectors with a unique binary number. Each disc sector may correspond to one of the discrete rotational positions of the disc. The at least one sensor may include two or more sensors configured to cooperate with the rotational position encoding feature to detect a different one of the unique binary numbers when the disc is in each of the discrete rotational positions. The computing device may be configured to determine which of the two or more weights are fixedly connected to the handle assembly based on the unique binary number detected by the two or more sensors.

In some examples, the rotational position encoding feature encodes each disc sector with a unique binary number by encoding each of two or more sector subdivisions with either a first binary digit or a second binary digit. The two or more sensors may be configured to sense the unique binary number by sensing each of the sector subdivision encodings. Each sensor of the two or more sensors may be arranged to sense one of the sector subdivisions encodings when the disc is in a particular one of the discrete rotational positions.

In some examples, the rotational position encoding feature may include two or more tabs arranged around a perimeter of the disc and extending axially outward from the perimeter. A presence of one of the two or more tabs in a particular sector subdivision may correspond to that particular sector subdivision being encoded with the first binary digit, and an absence of one of the two or more tabs in a sector subdivision may correspond to that particular sector subdivision being encoded with the second binary digit. The two or more sensors may include optical interrupt sensors. Each optical interrupt sensor may include a transmitter and a receiver disposed on opposing sides of the tabs. The transmitter may be configured to emit a light beam toward the opposing receiver. Each optical interrupt sensor may be configured to detect that a particular sector subdivision is encoded with the first binary digit by sensing that the light beam emitted by the transmitter is blocked by one of the two or more tabs so as to prevent reception of the light beam by the opposing receiver and may be configured to detect that a particular sector subdivision is encoded with the second binary digit by sensing that the light beam emitted by the transmitter is not blocked by one of the two or more tabs so as to be received by the opposing receiver.

In some examples, the rotational position encoding feature may include two or more surface features disposed on a surface of the disc. A presence of a surface feature in a particular sector subdivision may correspond to that particular sector subdivision being encoded with the first binary digit, and an absence of a surface feature in a sector subdivision may correspond to that particular sector subdivision being encoded with the second binary digit. The two or more sensors may include mechanical sensors. Each mechanical sensor may be movable into a unactuated position by the action of a sensor biasing mechanism when a sensor contact is engaged with one of the surface features and movable into an actuated position by an application of a mechanical force by the surface of the disc that acts against the sensor biasing mechanism when the sensor contact is not engaged with one of the surface features Each mechanical sensor may be configured to detect that a particular sector subdivision is encoded with the first binary digit by sensing that the mechanical sensor is in the unactuated position and may be configured to detect that a particular sector subdivision is encoded with the second binary digit by sensing that the mechanical sensor is in the unactuated position.

In some examples, the at least one weight comprises two or more weights. The handle assembly may include a disc that is rotatable into a set of discrete rotational positions. Each rotational position may correspond to a different combination of the two or more weights fixedly connected to the handle assembly. The at least one sensor may be configured to detect the rotational position of the disc by detecting a sensible parameter including a substantially continuous range of possible values. The substantially continuous range of values may be divided into at least one sub-range. Each of the at least one sub-range may be associated with a particular number of the plurality of weights. The computing device may be configured to determine which of the two or more weights are fixedly connected to the handle assembly by determining in which one sub-range is detected.

In some examples, the disc may include a contoured perimeter such that points along at least a portion of the perimeter are disposed at a different distance from a center of the disc. The at least one sensor may include a potentiometer operatively associated with the contoured perimeter to detect the rotational position of the disc.

In some examples, the disc may include a concentric ring of material positioned on a surface of the disc. The material may include an electrical property that has a different magnitude at each angular position along the ring. The at least one sensor may include an electrical sensing portion adjacent to the ring of material. The electrical sensing portion may be configured to detect the magnitude of the electrical property of the ring of material as the disc rotates. The sensor may detect the rotational position of the disc based on the detected magnitude of the electrical property.

Some examples additionally include a magnet joined to the handle assembly. The magnet may be configured to change a direction of the magnetic field as the disc rotates. The at least one sensor may include a magnetic sensing portion adjacent to the magnet. The magnetic sensing portion may be configured to detect the direction of the magnetic field of the magnet. The sensor may detect the rotational position of the disc based on the detected direction of the magnetic field of the magnet.

Some examples additionally include at least one separator disc operatively associated with the disc so as rotate with the disc. The separator disc may include a number of cut-out sections arranged within an outer ring portion of the separator disc. Two or more selector discs may be operatively associated with the disc so as to rotate with the disc. Each selector disc may include engagement features that retain a particular weight on the handle assembly in certain rotational positions of the selector disc. Two or more reflective optical sensors may be positioned on the handle assembly. The two or more reflective optical sensors may be configured to sense a unique pattern of cut-out sections and engagement features formed at a position proximate to the sensors. The computing device may be configured to determine which weights are fixedly connected with the handle assembly based on the unique pattern of cut-out sections and engagement features detected by the two or more reflective optical sensors.

In some examples, the at least one sensor may include an accelerometer that rotates with the disc. The accelerometer may be configured to sense a change in a gravity vector as the disc is rotated between the discrete rotational positions. The computing device may be configured to receive change in gravity vector information from the accelerometer and to determine which weights are fixedly connected to the handle assembly based on the gravity vector information.

In some examples, at least one of the at least one weight may include a selection assembly. The selection assembly may include a selection member movable between a selected position where said at least one of the at least one weight is fixedly connected to the handle assembly and an unselected position where said at least one of the at least one weight is not fixedly connected to the handle assembly. The at least one sensor may configured to detect if said at least one of the at least one weight is fixedly connected to the handle assembly by sensing if the selection member is in the selected position.

In some examples, the handle assembly may include a handle operatively associated with the disc so as to rotate with the disc.

In a second aspect, a sensing mechanism is disclosed. The sensing mechanism may include at least one sensor connected to a handle assembly of an adjustable dumbbell so as to remain in a fixed position relative to a rotation of an indicator member of the handle assembly. The at least one sensor may be configured to detect the rotational position of the indicator member. The computing device may be configured to determine which of at least one weight is engaged by the handle assembly based on the rotational position detected by the at least one sensor.

In some examples, the at least one weight may include two or more weights. The sensing mechanism may include a rotational position encoding feature arranged on the indicator member so as to encode each of two or more indicator member sectors with a unique binary number. Each sector may correspond to one of two or more discrete rotational positions of the indicator member. Each rotational position may correspond to selection of a different combination of weights. The at least one sensor may include two or more sensors configured to cooperate with the rotational position encoding feature to detect a different one of the unique binary numbers when the indicator member is in each of the discrete rotational positions. The two or more sensors may include at least one of the following: an optical sensor, a reflective sensor, a mechanical sensor, an inductive sensor, a capacitive sensor, a potentiometer, an accelerometer, or a magnetometer. The computing device may be configured to determine which of the two or more weights are fixedly connected to the handle assembly based on the unique binary number detected by the two or more sensors.

In some examples, the rotational position encoding feature may encode each sector with a unique binary number by encoding each of two or more sector subdivisions with either a first binary digit or a second binary digit. The two or more sensors may be configured to sense the unique binary number by sensing each of the sector subdivision encodings. Each sensor of the two or more sensors may be arranged to sense one of the sector subdivisions encodings when the indicator member is in a particular one of the discrete rotational positions.

In some examples, the indicator member may be a disc. The rotational position encoding feature may include two or more tabs arranged around a perimeter of the disc and extending axially outward from the perimeter. A presence of one of the two or more tabs in a particular sector subdivision may correspond to that particular sector subdivision being encoded with the first binary digit, and an absence of one of the two or more tabs in a sector subdivision may correspond to that particular sector subdivision being encoded with the second binary digit. The two or more sensors may include optical interrupt sensors. Each optical interrupt sensor may include a transmitter and a receiver disposed on opposing sides of the tabs. The transmitter may be configured to emit a light beam toward the opposing receiver. Each optical interrupt sensor may be configured to detect that a particular sector subdivision is encoded with the first binary digit by sensing that the light beam emitted by the transmitter is blocked by one of the two or more tabs so as to prevent reception of the light beam by the opposing receiver and may be configured to detect that a particular sector subdivision is encoded with the second binary digit by sensing that the light beam emitted by the transmitter is not blocked by one of the two or more tabs so as to be received by the opposing receiver.

In some examples, the indicator member may be a disc, and the rotational position encoding feature may include two or more surface features disposed on a surface of the disc. A presence of a surface feature in a particular sector subdivision may correspond to that particular sector subdivision being encoded with the first binary digit, and an absence of a surface feature in a sector subdivision may correspond to that particular sector subdivision being encoded with the second binary digit. The two or more sensors may include mechanical sensors. Each mechanical sensor may be movable into a unactuated position by the action of a sensor biasing mechanism when a sensor contact is engaged with one of the surface features and movable into an actuated position by an application of a mechanical force by the surface of the disc that acts against the sensor biasing mechanism when the sensor contact is not engaged with one of the surface features. Each mechanical sensor may be configured to detect that a particular sector subdivision is encoded with the first binary digit by sensing that the mechanical sensor is in the unactuated position and may be configured to detect that a particular sector subdivision is encoded with the second binary digit by sensing that the mechanical sensor is in the unactuated position.

In some examples, the at least one weight may include two or more weights. The handle assembly may include an indicator member that is rotatable into a set of discrete rotational positions. Each rotational position may correspond to a different combination of the two or more weights fixedly connected to the handle assembly. The at least one sensor may be configured to detect the rotational position of the indicator member by detecting a sensible parameter including a substantially continuous range of possible values. The substantially continuous range of values may be divided into at least one sub-range. Each of the at least one sub-range may be associated with a particular number of the two or more weights. The computing device may be configured to determine which of the two or more weights are fixedly connected to the handle assembly by determining which sub-range is detected.

In some examples, the indicator member may be a disc, and the disc may include a contoured perimeter such that points along at least a portion of the perimeter are disposed at a different distance from a center of the disc. The at least one sensor may include a potentiometer operatively associated with the contoured perimeter to detect the rotational position of the disc.

In some examples, the indicator member may be a disc that includes a concentric ring of material positioned on a surface of the disc. The material may include an electrical property that has a different magnitude at each angular position along the ring. The at least one sensor may include an electrical sensing portion adjacent to the ring of material. The electrical sensing portion may be configured to detect the magnitude of the electrical property of the ring of material as the disc rotates. The sensor may detect the rotational position of the disc based on the detected magnitude of the electrical property.

In some examples, the indicator member may be a disc, and the sensing mechanism may further include a magnet. The magnet may be joined to the handle assembly. The magnet may be configured to change the direction of the magnetic field as the disc rotates. The at least one sensor may include a magnetic sensing portion adjacent to the magnet. The magnetic sensing portion may be configured to detect the direction of the magnetic field of the magnet. The sensor may detect the rotational position of the disc based on the detected direction of the magnetic field of the magnet.

In some examples, the at least one weight include two or more weights. The at least one sensor may include an accelerometer that rotates with the indicator member. The accelerometer may be configured to sense a change in a gravity vector as the indicator member is rotated between discrete rotational positions. The computing device may be configured to receive change in gravity vector information from the accelerometer and to determine which of two or more weights are fixedly connected to the handle assembly based on the gravity vector information.

This summary of the disclosure is given to aid understanding. Each of the various aspects and features of the disclosure may advantageously be used separately in some instances, or in combination with other aspects and features of the disclosure in other instances. Accordingly, while the disclosure is presented in terms of examples, individual aspects of any example can be claimed separately or in combination with aspects and features of that example or any other example.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

FIG. 46 is a block diagram of the on-board computing device of FIG. 42-44.

FIG. 47 is a top plan view of mobile device that may be used in connection with the on-board computing device of FIG. 42-45.

FIG. 51 is a side elevation view of another example of the adjustable dumbbell shown in FIG. 43.

FIG. 52 is an enlarged view of the sensor board shown in FIG. 51.

The drawings are not necessarily to scale. In certain instances, details unnecessary for understanding the disclosure or rendering other details difficult to perceive may have been omitted. In the appended drawings, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. The claimed subject matter is not necessarily limited to the particular examples or arrangements illustrated herein.

DETAILED DESCRIPTION

Figure 1:
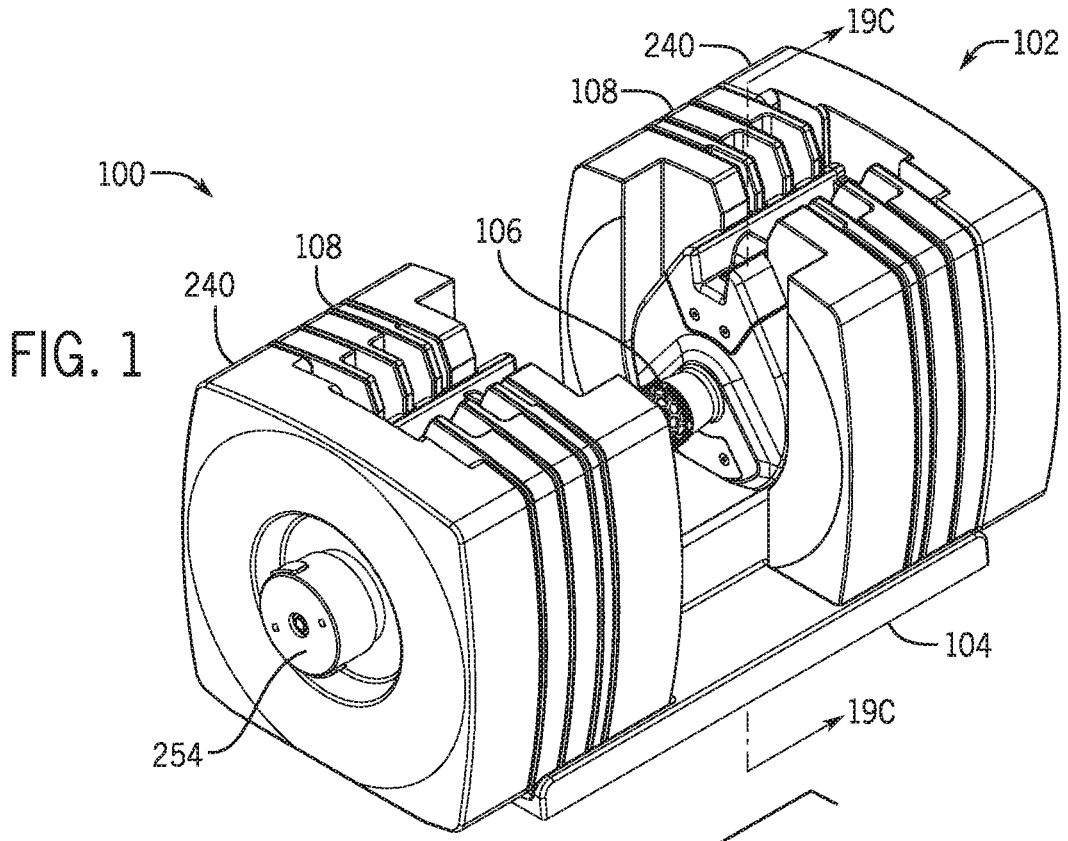
FIG. 1 is an isometric view of an adjustable dumbbell system in accordance with an example of the present disclosure.
Figure 2:
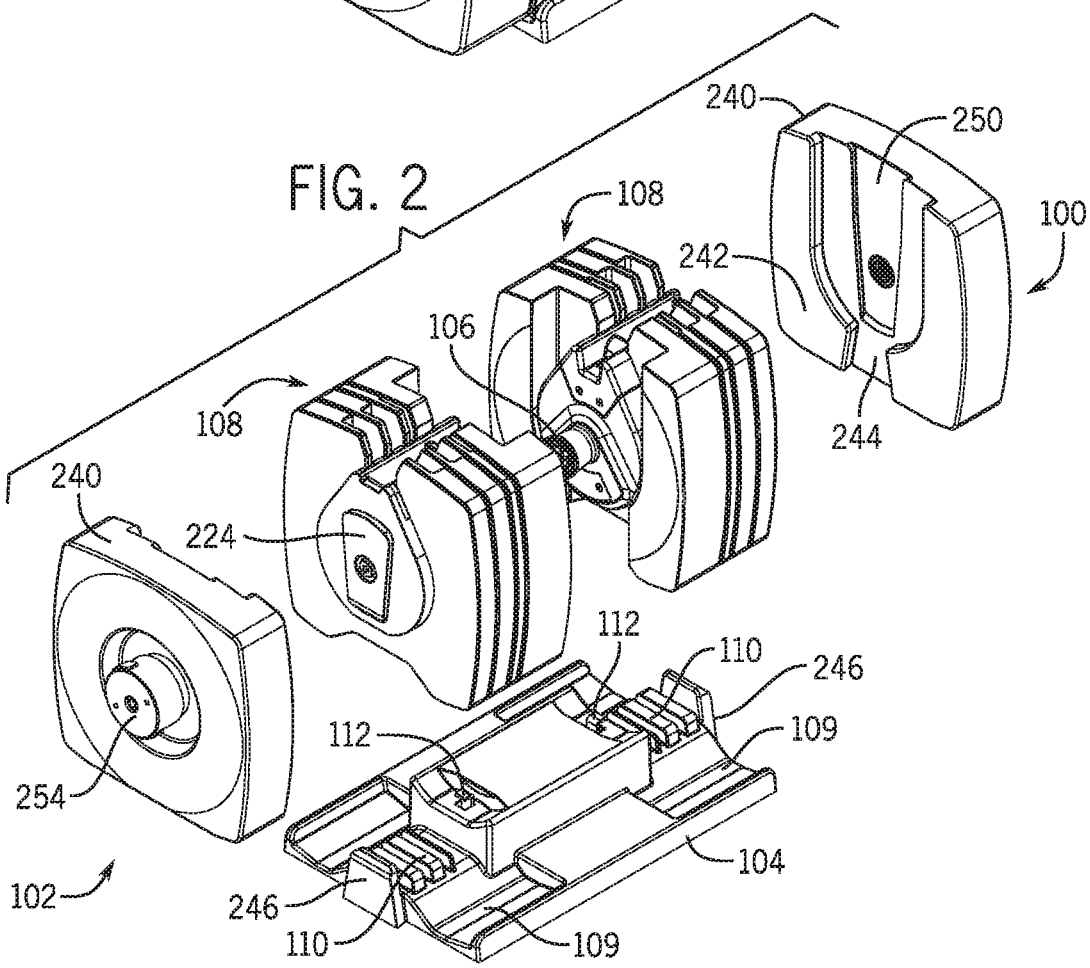
FIG. 2 is a partially exploded, isometric view of the adjustable dumbbell system of FIG. 1.

The present disclosure provides an adjustable dumbbell system which allows a user to select a dumbbell weight. Referring to FIGS. 1 and 2, an adjustable dumbbell system 100 may include an adjustable dumbbell 102 and a base 104. To change the weight of the dumbbell 102, the user may place the dumbbell 102 in the base 104, turn a handle 106 of the dumbbell 102 to engage a desired combination of weights 108, and remove the dumbbell 102 from the base 104 to perform a desired exercise. The desired combination of weights may be coupled to the handle 106, and unused weights may remain in the base 104. Should the user desire a different dumbbell weight, the user may place the dumbbell 102 back in the base 104, turn the handle 106 to engage the desired weights 108, and remove the dumbbell 102 from the base 104 with the desired weight. When the adjustable dumbbell 102 is not in the base 104, for example during exercise-type use, the adjustable dumbbell 102 may be configured such that it is difficult to add or remove weights 108.

The base 104 may receive the dumbbell 102 and may allow a user to adjust the weight of the dumbbell 102. During use of the dumbbell 102, the base 104 may hold the weights 108 that are not attached to the dumbbell 102. Before using the dumbbell 102, the user may first determine the weight to be lifted and turn the handle 106 while the dumbbell 102 is in the base 104, causing no weights or one or more weights 108 to be fixedly connected to a handle assembly 114. The user may then lift the dumbbell 102 out of the base 104. Any weight 108 not fixedly connected with the adjustable dumbbell 102 remains in the base 104.

The base 104 may include a bottom wall 109, one or more positioning walls 110, and a pair of lock features 112. The bottom wall 109 may support the adjustable dumbbell 102 and the weights 108. The positioning walls 110 may ensure that the adjustable dumbbell 102 is properly aligned when it is inserted into the base 104. The positioning walls 110 may hold the weights 108 upright and in the proper location relative to the handle assembly 114 so that the adjustable dumbbell 102 may be inserted into and removed from the base 104. The positioning walls 110 may be spaced so as to fit between adjacent weights 108 when the dumbbell 102 rests in the base 104 and to keep any weight 108 not attached to the dumbbell 102 upright when the dumbbell 102 is removed from the base 104.

The lock features 112 may be formed from a relatively rigid metal, plastic, or other suitable material. Each lock feature 112 may extend upwardly from the base 104. In some embodiments, each lock feature 112 may include a plate-like vertical portion that extends upwardly from the base 104 with a plate-like horizontal portion that extends substantially perpendicular from an end portion of the vertical portion that is distal from the base 104. The arrangement of the vertical and horizontal portions of each lock feature 112 may resemble an L-shaped profile for the portion of the lock feature 112 extending above the base 104. The lock features 112 may be positioned on the base 104 to extend into a cavity formed in the adjustable dumbbell 102 when the dumbbell 102 is placed in the base 104. The lock features 112 may deactivate a locking mechanism, as described further below, to allow selection of different weights when the adjustable dumbbell 102 is in the base 104.

Figure 3:
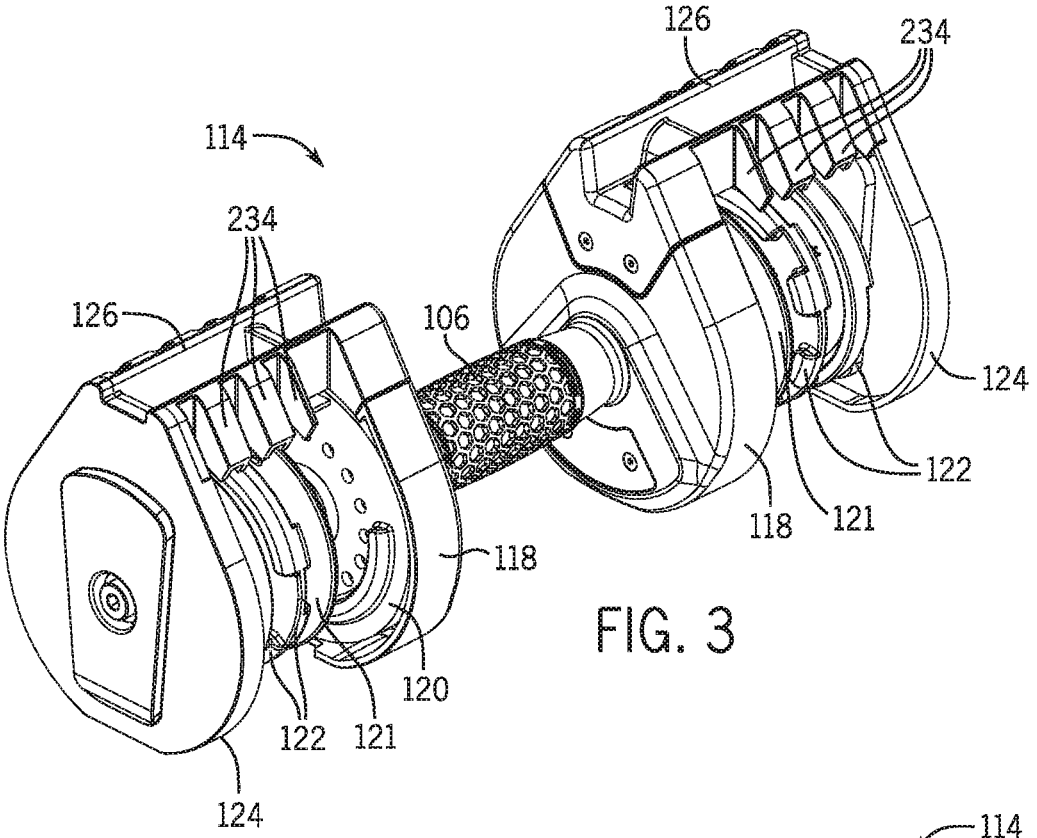
FIG. 3 is an isometric view of a handle assembly of the adjustable dumbbell system of FIG. 1.
Figure 4:
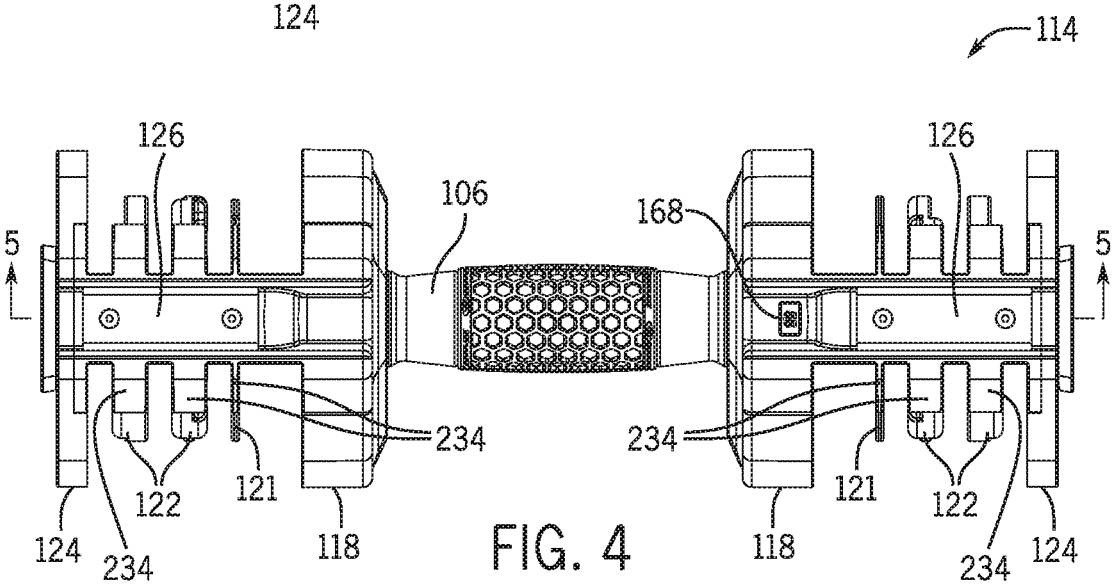
FIG. 4 is top plan view of the handle assembly of FIG. 3.
Figure 5:
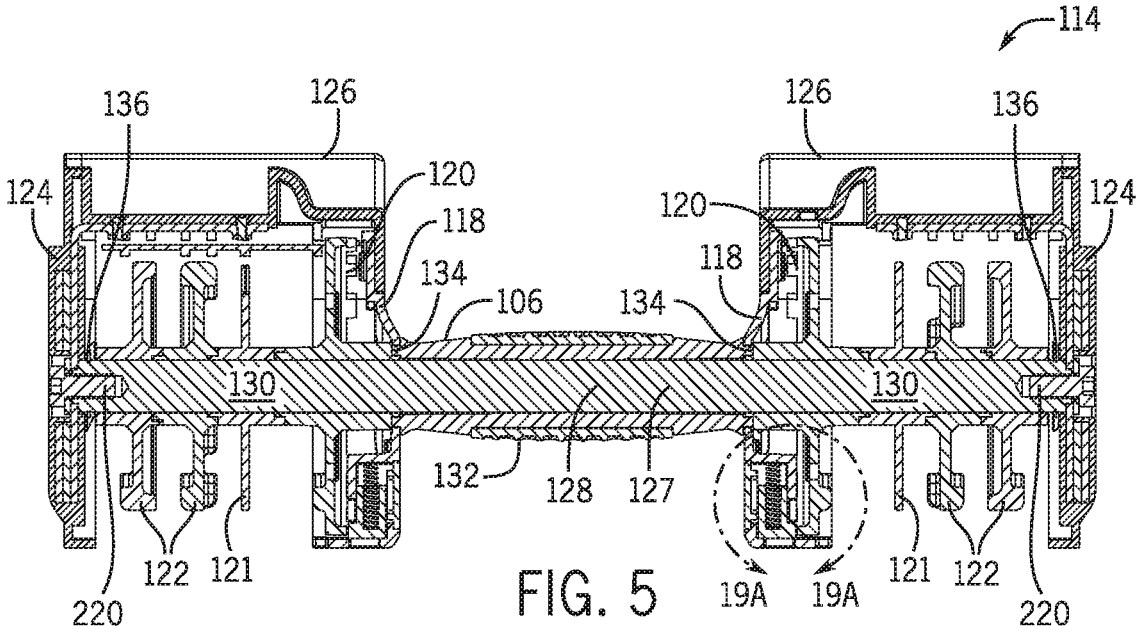
FIG. 5 is a lengthwise cross-sectional view of the handle assembly of FIG. 3 taken along line 5-5 of FIG. 4.

Referring to FIGS. 3-5, the adjustable dumbbell 102 may include the handle assembly 114. The handle assembly 114 may include the handle 106, a shaft 127, a pair of inner covers 118, a pair of indexing discs 120, one or more separator discs 121, one or more selector discs 122, a pair of end caps 124, and a pair of bridges 126. Opposing end regions of the adjustable dumbbell system 100 may be, except as where otherwise described, generally identical to one another. Thus, when reference is made to one or more parts on one side of the adjustable dumbbell 102 or base 104, it is to be understood that corresponding or similar part(s) may be disposed on the other side or end region of the adjustable dumbbell 102 or the base 104.

Figure 6:
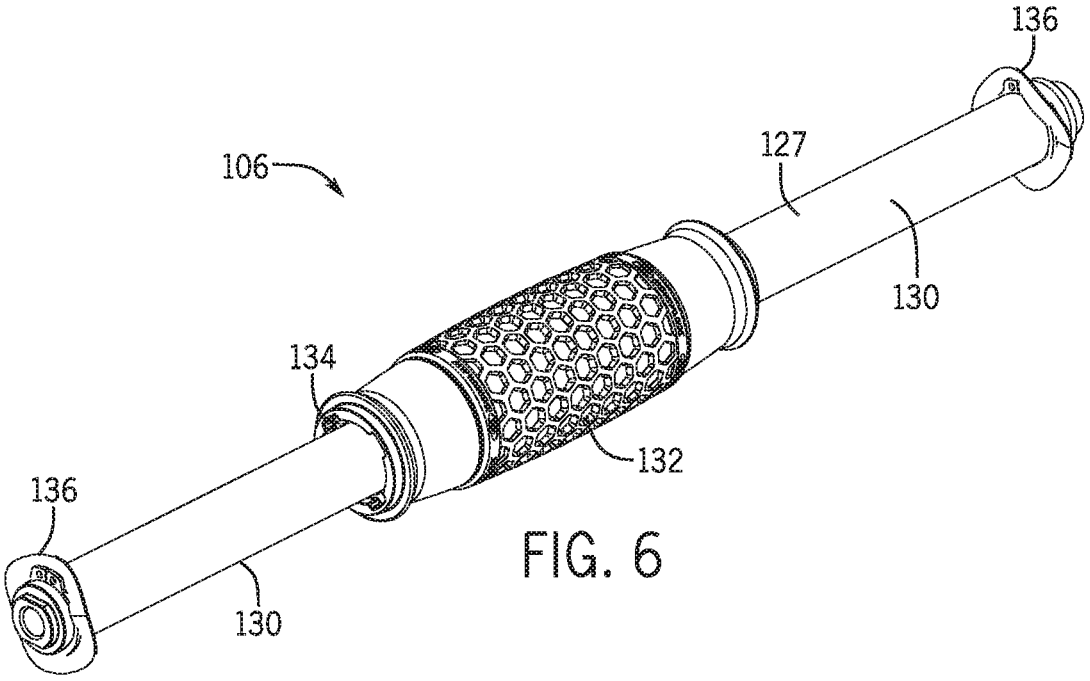
FIG. 6 is an isometric view of a portion of the handle assembly of FIG. 3.

Referring to FIG. 6, the handle 106 of the adjustable dumbbell 102 may include a grip portion 128 and a rotatable member 132, such as a sleeve or the like. The grip portion 128 may be mounted onto the rotatable member 132 and may be slightly bulged to provide a comfortable and ergonomic surface to grasp to facilitate a user securely gripping the adjustable dumbbell 102. The grip portion may be generally symmetrical about the midpoint of the rotatable member 132.

The shaft 127 may be received through a generally circular passage defined by the rotatable member 132. Each end portion 130 of the shaft 127, one on either end of the rotatable member 132, may extend beyond a respective end of the rotatable member 132. The rotatable member 132 may be rotatable about a longitudinal axis of the shaft 127 to allow a user to select a desired dumbbell weight by rotating the handle 106. In some embodiments, the rotatable member 132 may rotate relative to the shaft 127. In other embodiments, the rotatable member 132 and the shaft 127 may rotate in unison about the longitudinal axis of the shaft 127.

The rotatable member 132 may include engagement features 134 formed in opposing ends of the rotatable member 132. Each engagement feature 134 may engage a respective indexing disc 120 so that the indexing discs 120 rotate in unison with the rotatable member 132. The end portions 130 of the shaft 127 may include a pair of retaining features 136, such as wave spring washers and retaining rings, disposed adjacent outer or terminal ends of the end portions 130. The retaining features 136 may extend beyond the outer periphery of the end portions 130 and may apply an axial force transferred through any interposed separator and selector discs 121, 122 to the indexing discs 120 to ensure the indexing discs 120 remain engaged with the engagement features 134 of the rotatable member 132. As used herein, the terms inner and proximal refer to a direction toward the grip portion 128 of the handle 106, and the terms outer and distal refer to a direction toward the terminal ends of the end portions 130 of the shaft 127.

FIG. 5 shows a cross-sectional view of the adjustable dumbbell 102 taken along the longitudinal centerline of the handle 106, without any weights 108 attached to the handle assembly 114. The indexing discs 120, the separator discs 121, and the selector discs 122 may be mounted on the end portions 130 of the shaft 127 and arranged distally from the inner covers 118. The handle 106, the indexing discs 120, the separator discs 121, and the selector discs 122 may be rotationally interlocked to one another. By grasping and turning the handle 106, the indexing discs 120, the separator discs 121, and the selector discs 122 may be rotated in unison relative to the inner covers 118 and the weights 108. In some implementations, the rotatable member 132, the indexing discs 120, the separator discs 121, the selector discs 122, or a combination thereof are interference fit onto the shaft 127, resulting in the shaft 127 rotating in unison with the handle 106 during weight selection. The dumbbell may also allow the selection of the desired combination of weights without requiring the handle to be turned. For instance, in one example, the selector discs at either or both ends of the dumbbell may be sleeved over the handle to allow them to be rotated independently of the handle to allow the desired weights to be selected.

With reference to FIGS. 3-5, 7, and 8, each inner cover 118 may be mounted on the shaft 127 adjacent to ends of the rotatable member 132. The inner covers 118 each may define a generally centrally-formed aperture 138 for receiving a respective end portion 130 of the shaft 127 there through. Each inner cover 118 may be mounted onto opposing respective end portions 130 of the shaft 127 and may be abutted against a radially-extending shoulder of the rotatable member 132 to axially locate the inner covers 118 along the shaft 127. When the dumbbell 102 is positioned in the base 104, the inner covers 118 may be non-rotatably seated in the base 104. An underside of the inner covers 118 may abut against the bottom wall 109 of the base 104.

Figure 7:
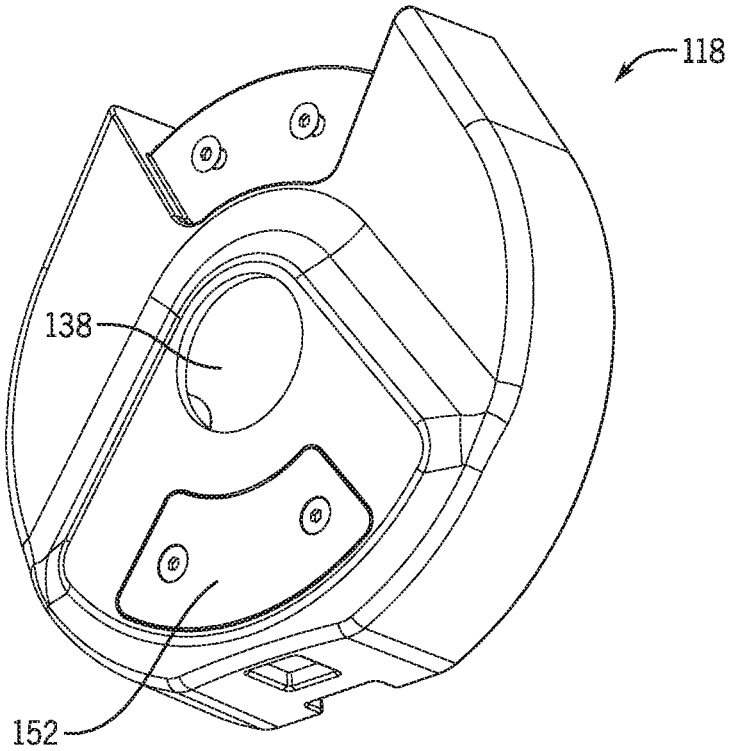
FIG. 7 is a proximal isometric view of an inner cover of the handle assembly of FIG. 3.
Figure 8:
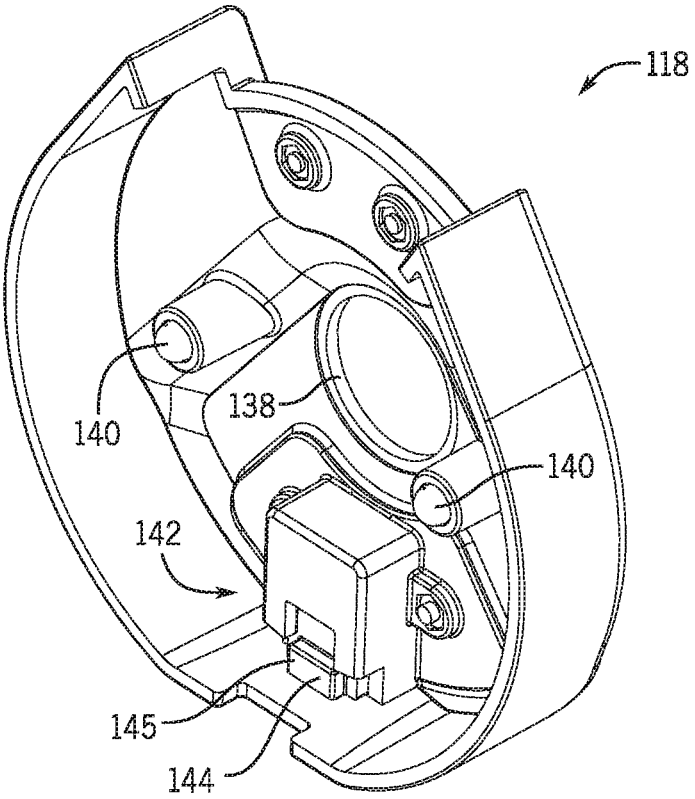
FIG. 8 is a distal isometric view of the inner cover of FIG. 7.

With reference to FIGS. 7 and 8, the inner covers 118 may include a detent 140, such as a spring loaded ball or pin, that engages an indicator feature 156 of the indexing discs 120 to provide an indication to a user that the rotatable member 132 is in a proper rotational position to permit the adjustable dumbbell 102 to be removed from the base 104. The detent 140 may be biased to extend from the inner covers 118 toward the indexing discs 120. The inner covers 118 may include a pair of detents 140 oriented to extend generally parallel to a longitudinal axis of the handle 106. The detents 140 may be biased generally to a distal or outer position and extend partially through openings formed in a distal or outer surface of the inner cover 118 in confronting relationship to the indexing discs 120 (see FIG. 19C). The detents 140 may be engaged with a distal end of a biasing member, such as a spring (leaf, coil, and so on), which may be seated within a recess of the inner covers 118. The detents 140 may be disposed radially outward of the central aperture 138.

Referring to FIGS. 7, 8, and 19A-19D, the inner covers 118 may include a locking mechanism 142 that permits or prevents rotation of the handle 106. The locking mechanism 142 may include a locking member 144, such as a spring-loaded button. The locking member 144 may include a interference feature 145, such as a protrusion or a projection, that extends in a distal direction parallel or generally parallel to a longitudinal axis of the handle 106 or the shaft 127 and toward the indexing discs 120. The locking member 144 may be vertically movable relative to the inner covers 118 and may be laterally restrained in directions oriented transversely (e.g., orthogonally) to the direction of movement.

Figure 19A:
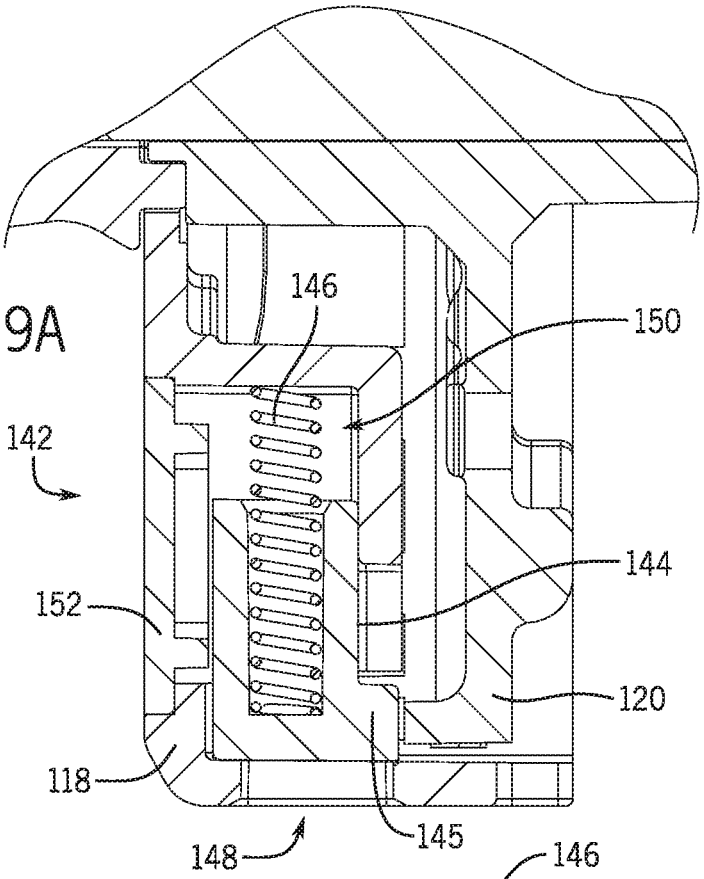
FIG. 19A is an enlarged cross-sectional view of a locking mechanism of the handle assembly of FIG. 3 taken along line 19A-19A of FIG. 5 with the locking mechanism in a first or locked position that prevents rotation of the discs.

Turning to FIG. 19A, the locking member 144 may be downwardly biased toward an opening 148 by a lock bias member 146, such as a spring, which may be arranged along a vertically-oriented axis. The opening 148 may be defined by the inner cover 118. The opening 148 may be downwardly extending to expose a lower surface of the locking member 144 to permit a portion of the base 104 to engage and vertically displace the locking member 144 against the bias of the lock bias member 146. The locking member 144 may be vertically displaced within a cavity 150 defined by the inner cover 118. The inner covers 118 may include cover plates 152, which may be removably attached to the inner or proximal surface of the inner covers 118 to provide access to the locking members 144 and the lock bias members 146. The cover plates 152 may also provide a bearing surface for the locking members 144 to slide along during vertical displacement of the locking members 144 relative to the inner covers 118.

Figure 9:
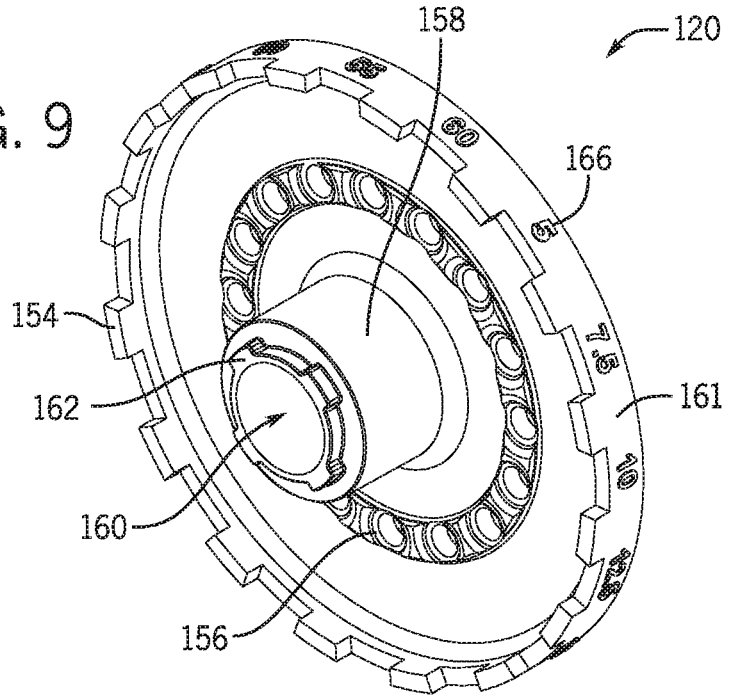
FIG. 9 is a proximal isometric view of an indexing disc of the handle assembly of FIG. 3.
Figure 10:
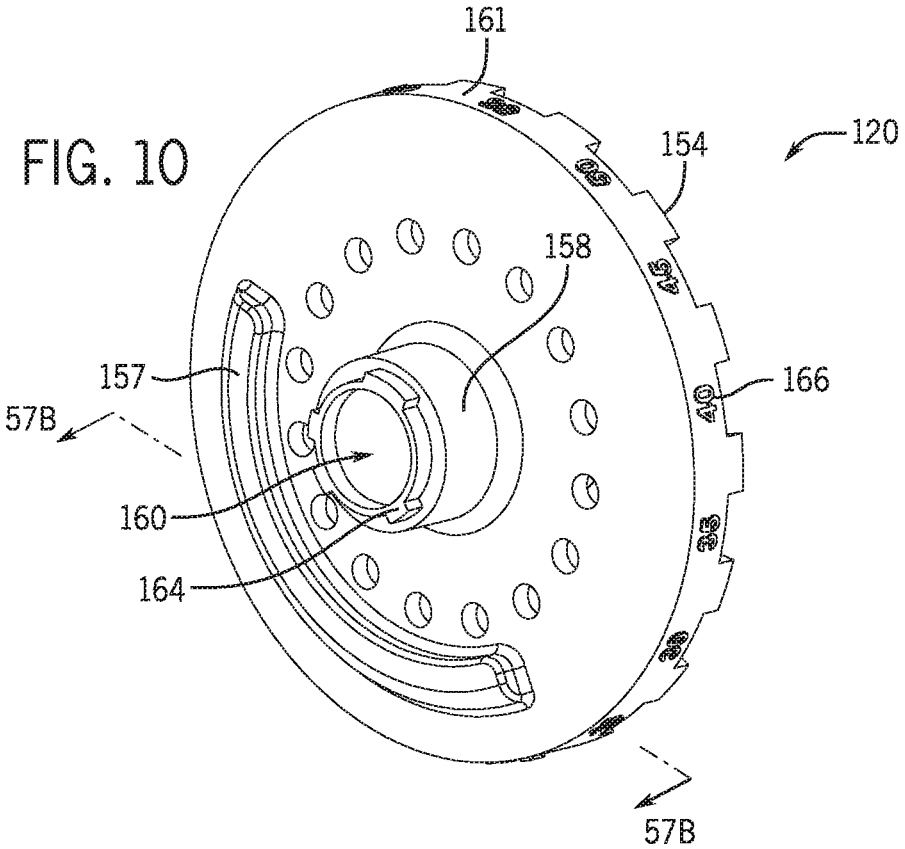
FIG. 10 is a distal isometric view of the indexing disc of FIG. 9.

Referring to FIGS. 3 and 5, the indexing discs 120 may be mounted onto the handle 106 immediately distal or outside of the inner covers 118. FIG. 9 illustrates an isometric view of the inner or proximal surface of an indexing disc 120, and FIG. 10 illustrates an isometric view of the outer or distal surface of the indexing disc 120. The indexing disc 120 may include one or more of the following: a lock feature 154, an indicator feature 156, a weight selection feature 157, an axially-extending sleeve 158, and a generally centrally located aperture 160 defined by the sleeve 158 and configured to receive a portion of the shaft 127. The lock feature 154, the indicator feature 156, the sleeve 158, and the aperture 158 may be arranged concentrically on the indexing disc 120. A proximal end of the sleeve 158 may include an engagement feature 162 configured to engage the engagement feature 134 of the rotatable sleeve 132 so that the indexing disc 120 rotates in unison with the rotatable sleeve 132 relative to the inner cover 118 and the weights 108. A distal end of the sleeve 158 may include an engagement feature 164 configured to engage an adjacent separator disc 121 so that the separator disc 121 rotates in unison with the indexing disc 120.

The lock feature 154 may be positioned proximate to the periphery of the indexing disc 120. In some embodiments, the lock feature 154 may be castellated teeth arranged around the perimeter 161 of the indexing disc 120. Each tooth may extend towards the inner covers 118 in a direction parallel, or generally parallel, to a longitudinal axis of the handle 106 and/or a longitudinal axis of the shaft 127.

Referring to FIG. 10, the weight selection feature 157 may be configured to either engage a weight 108 to fixedly join the weight 108 to the handle assembly 114 or to not engage a weight 108 to allow it to remain in the base 104 depending upon the rotational orientation of the indexing disc 120. The weight selection feature 157 may take the form of one or more flanges that protrude distally from the distal or outer surface of the indexing disc 120. The flanges may extend along an arcuate or curved path, which may be defined by a single radius originating at a center of the indexing disc 120. The number of flanges may be based on the desired rotational positions of the indexing disc 120 relative to the weight 108 for engagement of the weight selection feature 157 with the weight 108. While one flange is shown in FIG. 10, two or more flanges may also be used. The weight selection feature 157 may be positioned radially between the periphery of the indexing disc 120 and the sleeve 158. Further, in embodiments in which the lock feature 154 is positioned proximate the periphery of the indexing disc 120, the weight selection feature 157 may be positioned radially between the lock feature 154 and the sleeve 158.

With reference to FIGS. 9 and 10, the indexing disc 120 may include indicator markings 166 arranged on the perimeter 161 of the indexing disc 120. In some implementations, the indicator markings 166 may be formed as raised numbers protruding outwardly from the perimeter 161 of the indexing disc 120. In embodiments in which the locking feature 154 includes teeth, the indicator markings 166 may be positioned angularly between the teeth. The indicator markings 166 may provide a visual indication to the user of the amount of weight selected on the adjustable dumbbell 102. Referring to FIGS. 4 and 19C, the markings 166 may be individually viewable through an opening or window 168 of the bridge 126 to indicate the selected amount of weight.

Referring to FIG. 9, the indicator feature 156 of the indexing disc 120 may be detent recesses. When the lock feature 154 includes teeth, the detent recesses may be spaced radially inwardly and angularly offset from the teeth. The detent recesses may receive at least portions of the detents 140. The detent recesses may be angularly disposed on the indexing discs 120 so that the detents 140 engage the detent recesses upon a predetermined level of engagement of one or more of the weights 108 with respective indexing or selector discs 120, 122. The engagement of the detents 140 with the indicator feature 156 may provide audible, tactile, or other sensory feedback to the user indicating that the selected weights 108 are adequately engaged with the handle assembly 114 and that the dumbbell 102 is ready for removal from the base 104.

Referring to FIGS. 19A-19D, the locking mechanism 142 of the inner cover 118 may be biased to engage an associated lock feature 154 to prevent the indexing discs 120, and hence the separator discs 121 and the selector discs 122, from rotating about the longitudinal axis of the shaft 127 and/or relative to the weights 108 when the handle assembly 114 of the dumbbell 102 is removed from the base 104. Upon removal of the handle assembly 114 from the base 104, each locking member 144 interferes with a respective indexing disc 120 to prevent rotation of the indexing discs 120. This interference may occur by each locking member 144 engaging the lock feature 154 on a respective indexing disc 120. In some implementations, such as implementations in which the lock feature 154 is two or more teeth and the interference feature 145 is a protrusion, upon removal of the dumbbell 102 from the base 104, lock bias members 146 bias respective locking members 144 into a locking position in which each locking member's protrusion is disposed between adjacent teeth of respective indexing discs 120, thereby preventing rotation of the indexing discs 120, and hence rotation of the separator discs and the selector discs 122, relative to the weights 108.

Figure 19B:
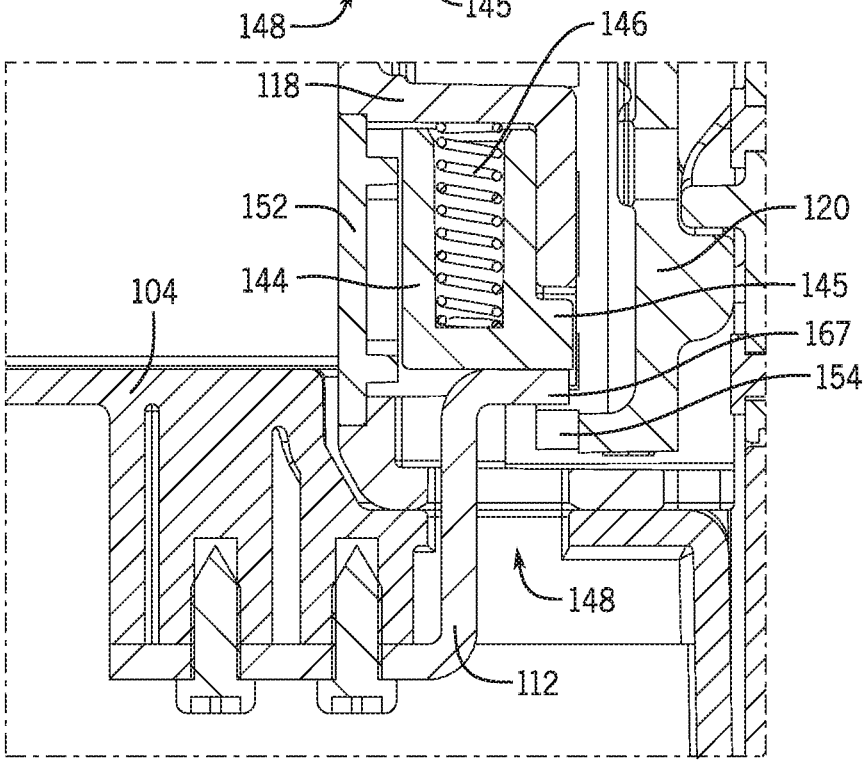
FIG. 19B is an enlarged cross-sectional view of the locking mechanism of FIG. 19A with the locking mechanism in a second or unlocked position that permits rotation of the discs.
Figure 19C:
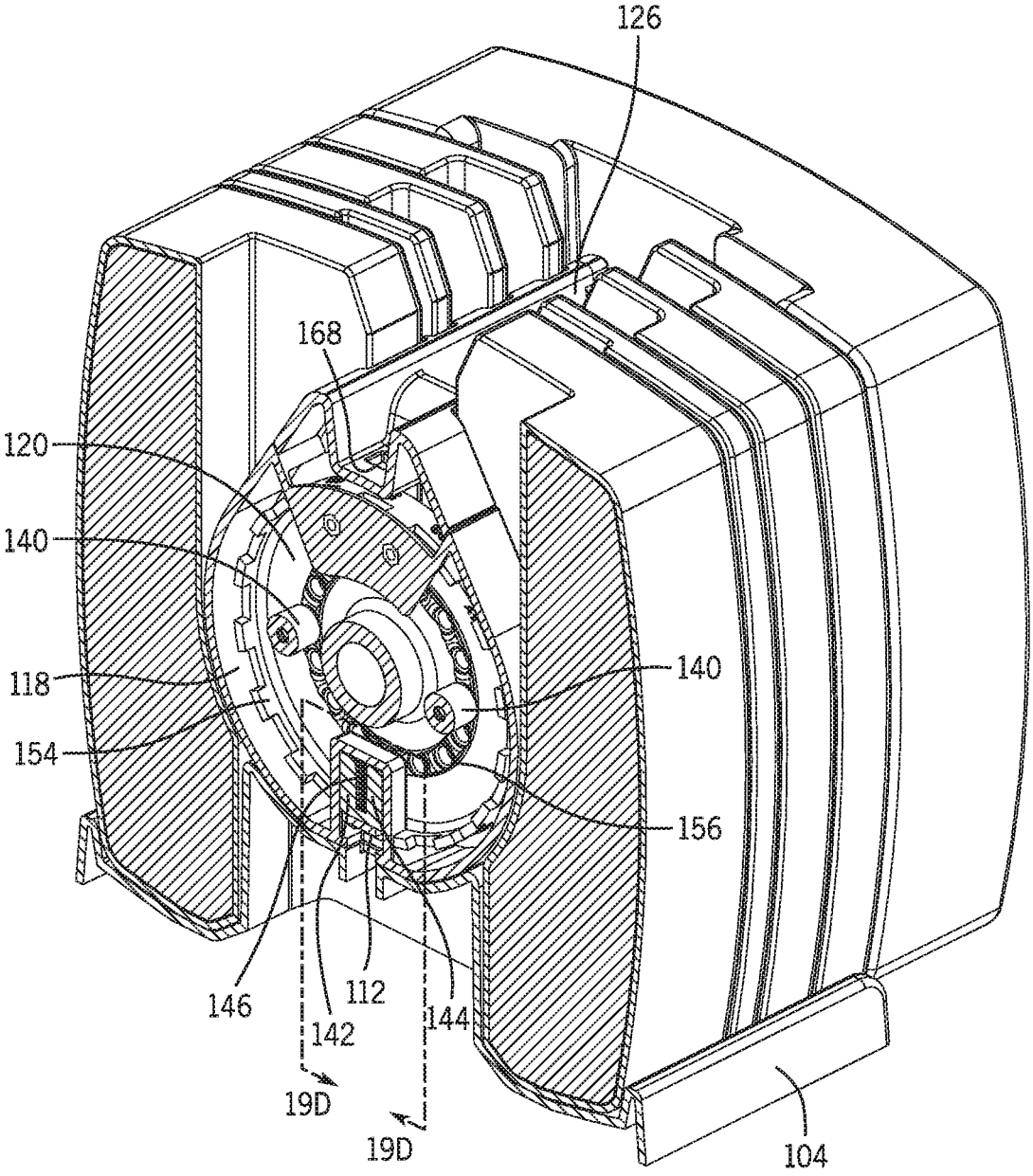
FIG. 19C is a transverse cross-sectional view of the adjustable dumbbell system of FIG. 1.
Figure 19D:
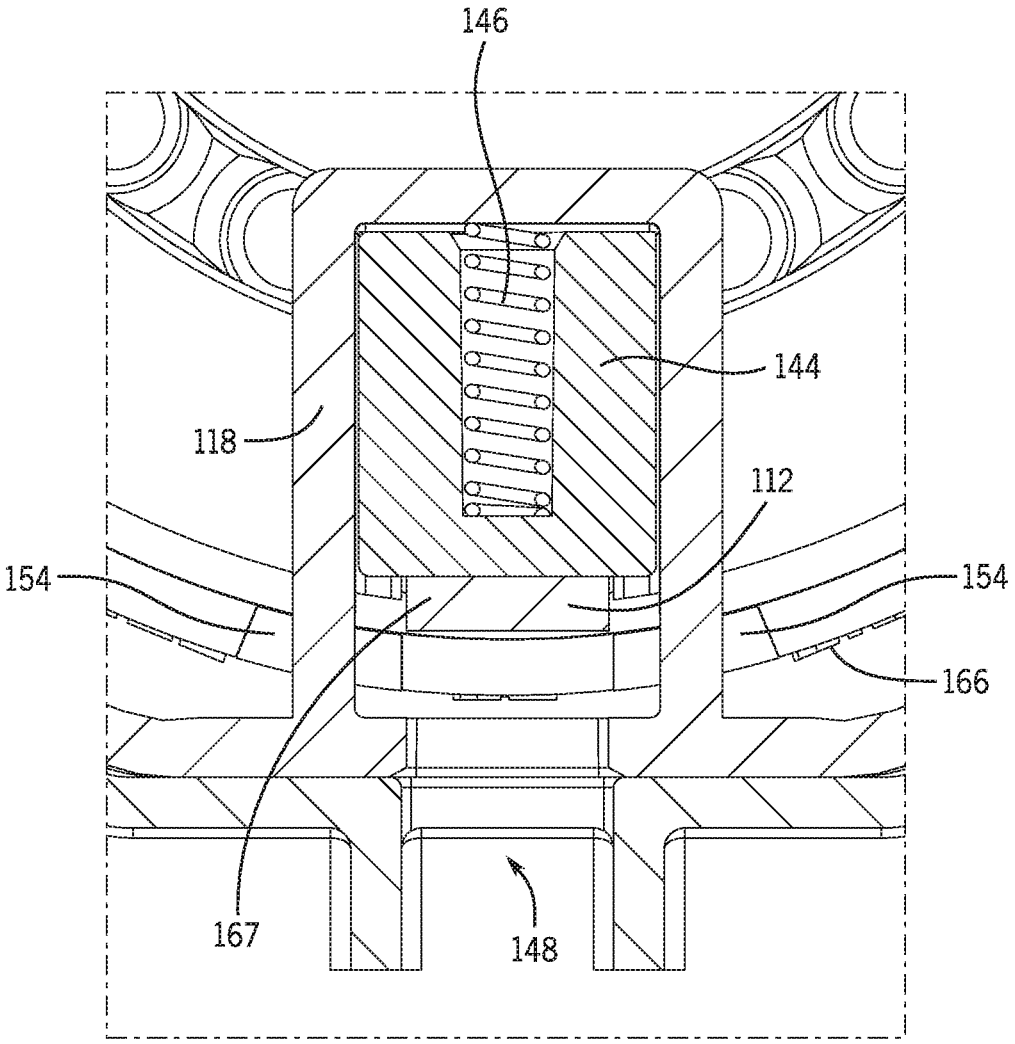
FIG. 19D is an enlarged cross-sectional view of the locking mechanism of FIG. 19A taken along line 19D-19D of FIG. 19C.

Referring to FIGS. 19B-19D, when the dumbbell 102 is placed in the base 104, the locking mechanism 142 may be moved into a disengaged or unlocked position. Upon placement of the dumbbell 102 onto the base 104, the lock feature 112 of the base 104 disengages the locking mechanism 142 from the lock feature 154 of the indexing disc 120 to allow rotation of the indexing disc 120 about the longitudinal axis of the shaft 127 and/or relative to the weights 108. In some embodiments, the lock feature 112 of the base 104 may extend upwardly through the opening 148 of the inner cover 118 and may drive the locking mechanism 142 upwardly. The lock feature 112 may move the locking member 144 upwardly a sufficient distance to displace the interference feature 145 (e.g., a protrusion, projection, or the like) from the rotational path of the lock feature 154 (e.g., teeth or the like) of the indexing disc 120 so that the indexing disc 120 and the selector discs 122 may be turned to adjust the weight of the adjustable dumbbell 102. Thus, when the dumbbell 102 is seated in the base 104, the weight of the adjustable dumbbell 102 may be adjusted by turning the rotatable member 132 of the handle 106 to selectively engage or disengage the weights 108 with the indexing discs 120 and the selector discs 122.

The adjustable dumbbell 102 may not be removed from the base 104 unless the weights 108 have a predetermined level of engagement or disengagement with the indexing discs 120 and the selector discs 122. The removal of the adjustable dumbbell 102 from the base 104 may be prevented when the base's lock feature 112 engages the indexing disc's lock feature 154 with the lock features 112, 154 engaged based on a rotational orientation of the indexing disc. In some implementations of this locking system, the lock feature 154 for each indexing disc 120 may rotate beneath an upper portion 167 of a respective lock feature 112 when the dumbbell 102 is placed in the base 104. For embodiments in which the lock feature 154 is teeth, the teeth may be circumferentially spaced apart sufficiently to allow the upper portion 167 of the lock feature 112 to pass between adjacent teeth when the indexing discs 120 and selector discs 122 are positioned at predetermined rotational positions relative to the weights 108 to permit removal of the dumbbell 102 from the base 104. Additionally, the teeth may be circumferentially spaced apart sufficiently to inhibit the upper portion 167 of the lock feature 112 from passing between adjacent teeth 154 when the indexing discs 120 and selector discs 122 are not positioned at predetermined rotational positions relative to the weights 108 to prevent removal of the dumbbell 102 from the base 104, thus effectively locking the dumbbell 102 to the base 104. The predetermined rotational positions may be selected so that any weight 108 that is intended to be fixedly joined to the handle assembly 118 based on the relative rotational positions of the indexing and selector discs 120, 122 to the weights 108 is sufficiently engaged with its respective indexing or selector disc 120, 122.

When the weights 108 are not engaged with or disengaged from the indexing discs 120 and the selector discs 122 as desired, a tooth of the indexing disc 120 may engage the upper portion 167 of the lock feature 112 and prevent the lock feature 112 from exiting through the opening 148 of the inner cover 118, thus locking the dumbbell 102 to the base 104. When the indexing discs 120 and the selector discs 122 are properly aligned rotationally, the upper portion 167 of the lock feature 112 may pass between adjacent teeth 154, and the dumbbell 102 may be removed from the base 104. During removal of the dumbbell 102 from the base 104, the lock bias member 146 may bias the locking member 144 downwardly such that the interference feature 145 interacts with the indexing disc's lock feature 154 to prevent the indexing discs 120 and the selector discs 122 from rotating relative to the inner covers 118 and the weights 108. Thus, when removed from the base 104, the weight of the dumbbell 102 may be fixed until the dumbbell 102 is repositioned onto the base 104 to select a different combination of weights.

When the dumbbell 102 is set into the base 104, the lock feature 112 may engage the locking member 144 to disengage the locking member 144 from the indexing discs 120. The handle 106 may then be rotated to rotate the indexing discs 120 and the selector discs 122 to select the desired number of weights 108. The detents 140 may help the user identify when the dumbbell 102 is at a secure location rotationally and not between locations for selecting weights 108. The markings 166 on the indexing disc 120 may be visible through the window 168 of the bridge 126 to indicate that the desired weight is selected (see FIGS. 4 and 19C). In between weight selection locations, the lock feature 154 on the indexing discs 120 may engage the lock feature 112 on the base 104 to prevent the dumbbell 102 from being removed from the base 104. When the indexing discs 120 are in a proper rotational orientation, the base's lock feature 112 does not engage the indexing disc's lock feature 154, thus allowing the dumbbell 102 to be removed from the base 104.

As the dumbbell 102 is removed from the base 104, the base's lock feature 112 ceases to engage the locking member 144, thus allowing the locking member 144 to be biased into a locking position in which the interference feature 145 interacts with the indexing disc's lock feature 154 to keep the indexing discs 120 from rotating relative to the weights 108. The locked nature of the indexing discs 120 may prevent independent rotation of the selector discs 122 since the selector discs 122 may be keyed to the rotation of the indexing discs 120. Thus, when the dumbbell 102 is removed from the base 104, the indexing discs 120 and selector discs 122 are not rotatable to change the weight selection or cause the weights 108 on the dumbbell 102 to become dislodged.

Figure 11:
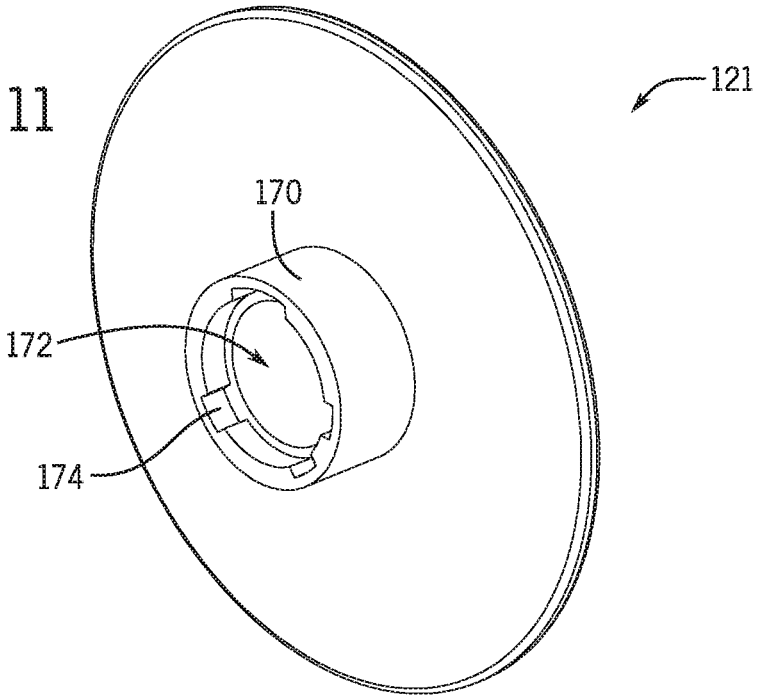
FIG. 11 is a proximal isometric view of a first separator disc of the handle assembly of FIG. 3.
Figure 12:
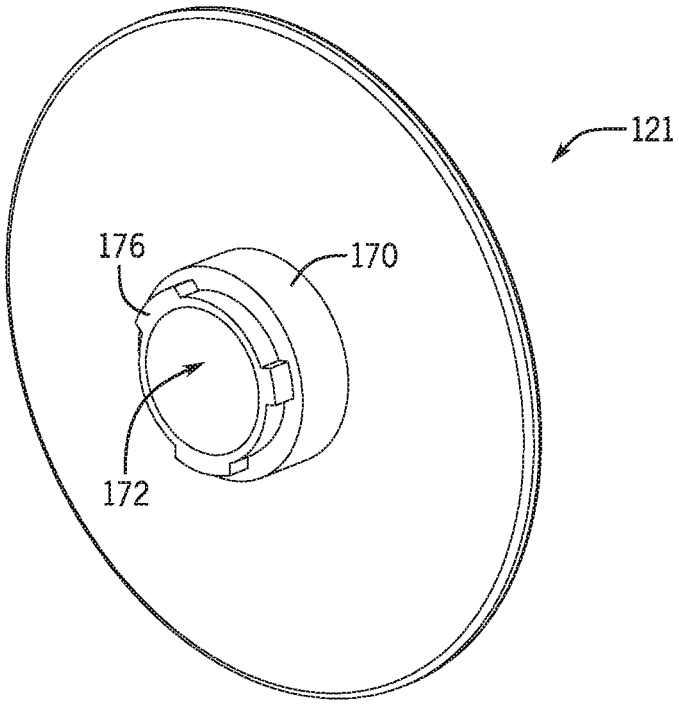
FIG. 12 is a distal isometric view of the first separator disc of FIG. 11.

Referring to FIGS. 5, 11, and 12, the separator discs 121 may be mounted onto the shaft 127 distal or outside of the indexing discs 120. The separator discs 121 may be positioned along the shaft 127 so as to fit between adjacent weights 108 when the dumbbell 102 rests in the base 104. The separator discs 121 may prevent or substantially prevent axially movement of weights 108 positioned alongside the separator discs 121 and attached to the dumbbell 102 when the dumbbell 102 is removed from the base 104. FIG. 11 illustrates an isometric view of the inner or proximal surface of the separator disc 121, and FIG. 12 illustrates an isometric view of the outer or distal surface of the separator disc 121. Although one pair of separator discs 121 is shown in FIG. 5, the dumbbell 102 may include more or less than one pair of separator discs 121 depending on the specific implementation of the dumbbell. For example, the dumbbell 102 may include additional pairs of separator discs 121 for implementations where the dumbbell 102 has a heavier weight capability, and vice versa.

A separator disc 121 may include an axially-extending sleeve 170, which may define a generally centrally located aperture 172 configured to receive the shaft 127 there through. A proximal end of the sleeve 170 may include an engagement feature 174 configured to engage the engagement feature 164 of the indexing disc 120 so that the separator disc 121 rotates in unison with the indexing disc 120 relative to the inner cover 118 and the weights 108. The sleeves 158, 170 may extend distally from the outer surface of the indexing disc 120 and proximally from the inner surface of the separator disc 121, respectively, to axially separate the separator disc 121 from the indexing disc 120 and form a space between the separator disc 121 and the indexing disc 120 configured to receive one or more of the weights 108. A distal end of the sleeve 170 may include an engagement feature 176 configured to engage the selector disc 122 so that the separator disc 121 rotates in unison with the selection disc 122.

Referring to FIGS. 5 and 13-16, the selector discs 122 may be mounted onto the shaft 127 distal or outside of the separator discs 121. The selector discs 122 may be positioned along the shaft 127 so as to fit between adjacent weights 108 when the dumbbell 102 rests in the base 104. The selector discs 122 may selective engage weights 108 positioned along both sides of the selector discs 122. By engaging multiple weights 108, the selector discs 122 may shorten the overall length of the dumbbell 102. Although two pairs of selector discs 122 are shown in FIG. 5, the dumbbell 102 may include more or less than two pairs of selector discs 122 depending on the specific implementation of the dumbbell. For example, the dumbbell 102 may include additional pairs of selector discs 122 for implementations where the dumbbell 102 has a heavier weight capability, and vice versa.

Figure 13:
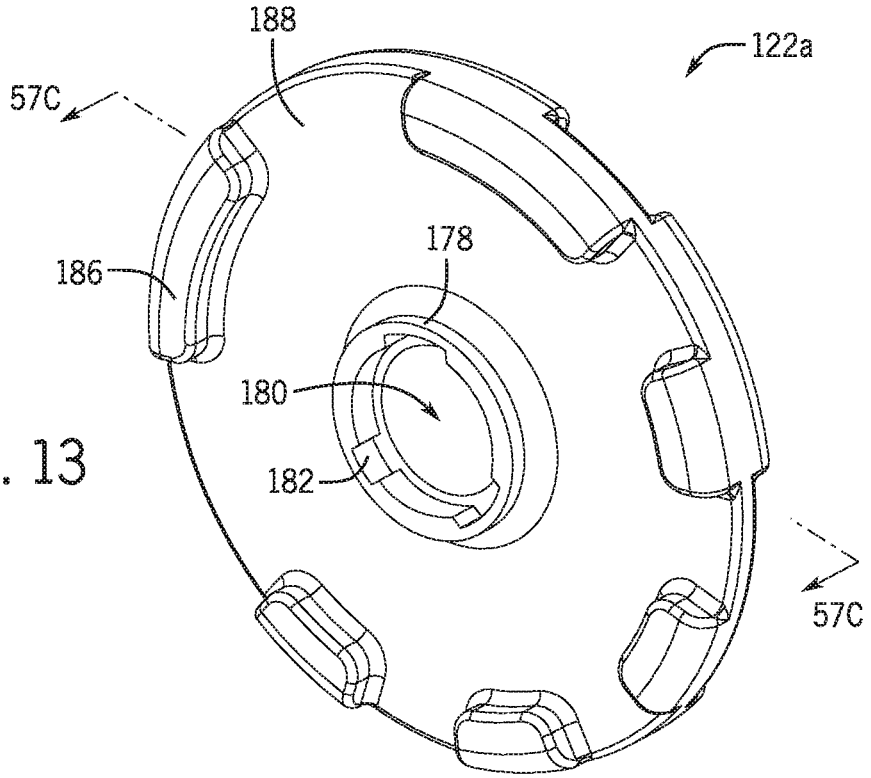
FIG. 13 is a proximal isometric view of a first selector disc of the handle assembly of FIG. 3.
Figure 14:
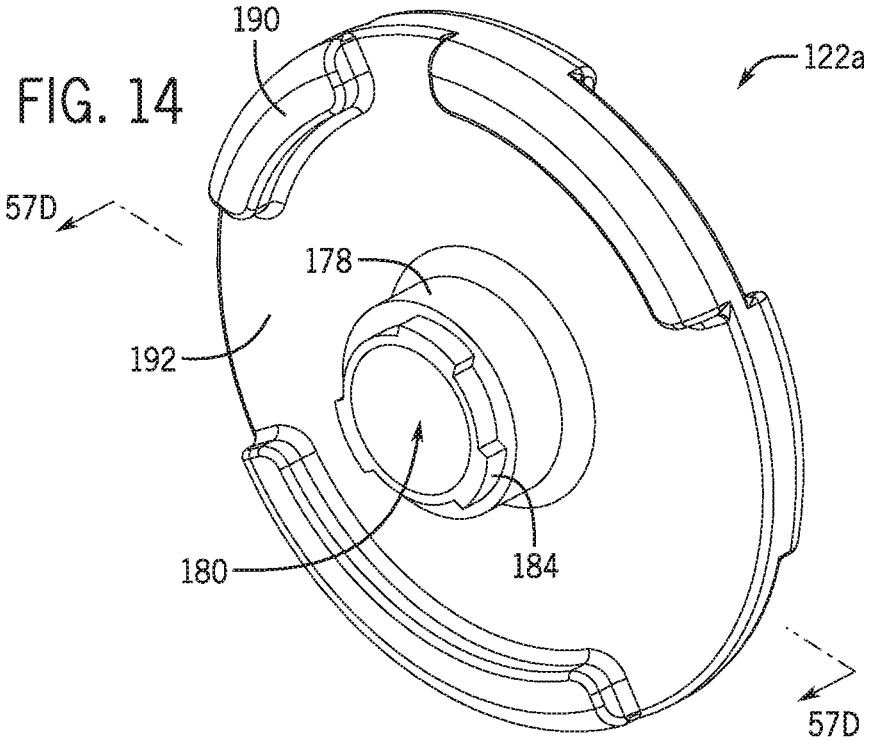
FIG. 14 is a distal isometric view of the first selector disc of FIG. 13.

FIG. 13 illustrates an isometric view of the inner or proximal surface of a first selector disc 122*a*, and FIG. 14 illustrates an isometric view of the outer or distal surface of the first selector disc 122*a*. The first selector disc 122*a* may include an axially-extending sleeve 178, which may define a generally centrally located aperture 180 configured to receive a portion of the shaft 127 there through. A proximal end of the sleeve 178 may include an engagement feature 182 configured to engage the engagement feature 176 of the separator disc 121 so that the first selector disc 122*a* rotates in unison with the separator disc 121 relative to the inner cover 118 and the weights 108. The sleeves 170, 178 may extend distally from the outer surface of the separator disc 121 and proximally from the inner surface of the first selector disc 122*a*, respectively, to axially separate the first selector disc 122*a* from the separator disc 121 and form a space between the first selector disc 122*a* and the separator disc 121 configured to receive one or more of the weights 108. A distal end of the sleeve 178 may include an engagement feature 184 configured to engage the second selector disc 122*b* so that the second selector disc 122*b* rotates in unison with the first selector disc 122*a*.

With continued reference to FIGS. 13 and 14, the first selector disc 122*a* may include first and second weight selection features 186, 190 protruding from the proximal and distal faces, respectively, of the first selector disc 122*a*. The first weight selection feature 186 may be one or more flanges that may protrude proximally from the inner or proximal surface 188 of the first selector disc 122*a*. The second weight selection feature 190 may be one or more flanges that may protrude distally from the distal or outer surface 192 of the first selector disc 122*a*. The flanges for both the first and second weight selection features 186, 190 may each extend along an arcuate or curved path, which may be defined by a single radius originating at a center of first selector disc 122*a*. The first and second weight selection features 186, 190 may each be disposed proximate to a periphery of the inner and outer surfaces 188, 192, respectively, of the first selector disc 122*a*.

The first and second weight selection features 186, 190 may be configured to either engage a weight 108 to fixedly join the weight 108 to the handle assembly 114 or to not engage a weight 108 and allow it to remain in the base 104 depending upon the rotational orientation of the first selector disc 122*a*. The first weight selection feature 186 may be configured to selectively engage a weight 108 received in a space between the first selector disc 122*a* and a proximally-adjacent separator disc 121, and the second weight selection feature 190 may be configured to selectively engage a weight 108 received in a space between the first selector disc 122*a* and a distally-adjacent second selector disc. When utilizing flanges for the first and second weight selection features 186, 190, some of the flanges on the distal side of the first selector disc 122*a* may angularly overlap the flanges on the proximal side of the first selector disc 122*a* so that in some rotational orientations the first selector disc 122*a* may simultaneously engage weights 108 disposed along the opposing faces 188, 192 of the first selector disc 122*a*. Further, at least some portions of the flanges on the distal side of the first selector disc 122*a* may not angularly overlap the flanges on the proximal side of the first selector disc 122*a*, or vice versa, so that in some rotational orientations the first selector disc 122*a* engages only one of the weights 108 disposed along the opposing faces 188, 192 of the disc 122*a*. Yet further, the flanges may be positioned on respective sides of the first selector disk 122*a* such that no weights on either side of the first selector disc 122*a* are engaged for some rotational orientations of the first selector disc 122*a*.

Figure 15:
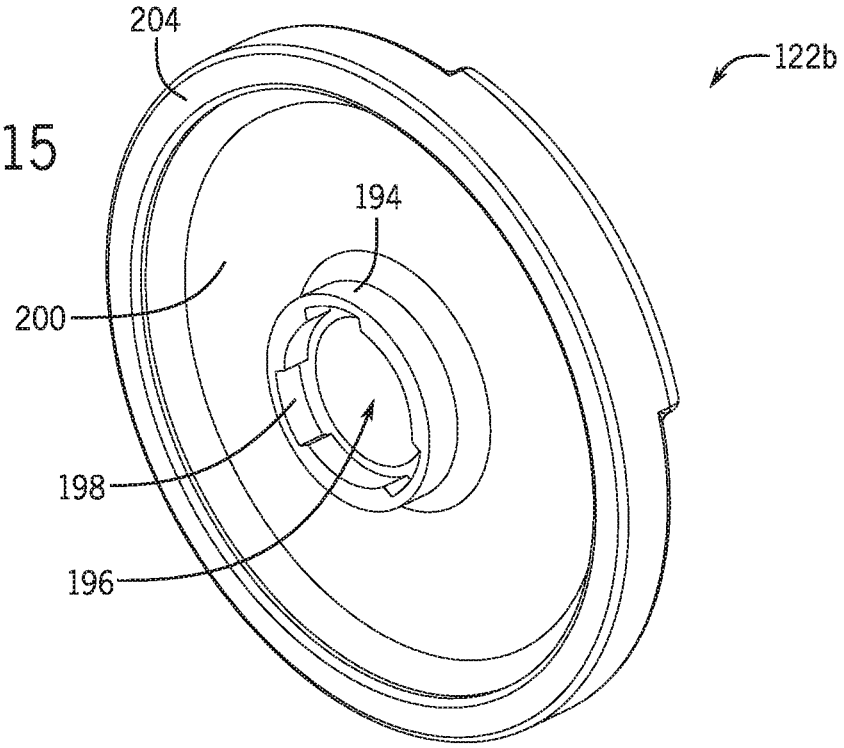
FIG. 15 is a proximal isometric view of a second selector disc of the handle assembly of FIG. 3.
Figure 16:
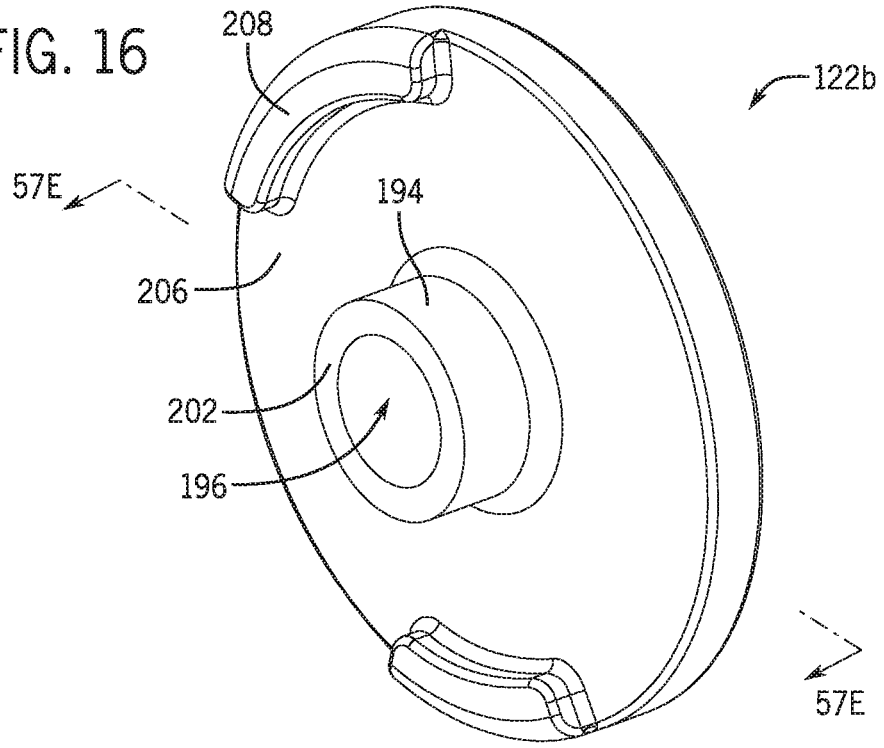
FIG. 16 is a distal isometric view of the second selector disc of FIG. 15.

FIG. 15 illustrates an isometric view of the inner or proximal surface of a second selector disc 122*b*, and FIG. 16 illustrates an isometric view of the outer or distal surface of the second selector disc 122*b*. The second selector disc 122*b* may include an axially-extending sleeve 194, which may define a generally centrally located aperture 196 configured to receive a portion of the shaft 127. A proximal end of the sleeve 194 may include an engagement feature 198 configured to engage the engagement feature 184 of the first selector disc 122*a* so that the second selector disc 122*b* rotates in unison with the first selector disc 122*a* relative to the inner cover 118 and the weights 108. The sleeves 178, 194 may extend distally from the outer surface 192 of the first selector disc 122*a* and proximally from the inner surface 200 of the second selector disc 122*b*, respectively, to axially separate the second selector disc 122*b* from the first selector disc 122*a* and form a space between the second selector disc 122*b* and the first selector disc 122*a* configured to receive one or more of the weights 108. A distal end of the sleeve 194 may include an abutment feature 202 configured to abut against the retaining feature 136 of the handle assembly 114 (see FIGS. 5 and 6).

Referring to FIG. 15, the second selector disc 122*b* may include a weight abutment feature 204 protruding axially from the proximal face 200 of the disc 122*b*. The weight abutment feature 204 may be an annular rim that protrudes proximally from the inner or proximal surface 200 of the disc 122*b*, that is spaced radially outward of the sleeve 194, and that extends continuously around a periphery of the proximal face 200 of the disc 122*b*. The weight abutment feature 204 may abut against a distal surface of a weight 108 positioned between the first and second selector discs 122*a*, 122*b* to prevent or substantially prevent lateral movement of the weight. In some implementations, a separator disc may be positioned between the first and second selector discs 122*a*, 122*b*, in which case the weight abutment feature 204 may be replaced with a weight selection feature that may similar to the weight selection features 186, 190 for the first selector disc 122*a* and that may be used to selectively engage a weight positioned between the separator disc and the second selector disc 122*b*.

Referring to FIG. 16, the second selector disc 122*b* may include a weight selection feature 208 positioned on the distal face 206 of the second selector disc 122*b* to selectively engage a weight 108 received in a space between the second selector disc 122*b* and the distally-adjacent end cap 124 depending upon the rotational orientation of the disc 122*b*. The weight selection feature 208 may be similar to the weight selection features 186, 190 of the first selector disc 122*a*.

Referring to FIGS. 5, 6, and 9-16, rotation of the rotatable member 132 may cause rotation of the indexing discs 120, the separator discs 121, and the selector discs 122 relative to the weights 108, which may be located between adjacent indexing discs 120, separator discs 121, and selector discs 122. The weights 108 may be selectively engaged by the respective weight selection features 157, 186, 190, 208 of the indexing discs 120 and the selector discs 122 depending upon the angular orientation of the discs 120, 122 relative to the weights 108. The engagement features of the sleeves 158, 170, 178, 194 of the indexing discs 120, the separator discs 121, and the selector discs 122 may be keyed such that the discs 120, 121, 122 may be assembled in only one particular order along the shaft 127 and in only one particular rotational orientation with respect to one another. In some implementations, the engagement features 162, 164, 174, 176, 182, 184, 198 of the discs 120, 121, 122 include corresponding tabs and receiving indentations that are keyed so that adjacent discs 120, 121, 122 may be interconnected in only one rotational orientation. For example, some of the tabs and indentations may be wider than the other tabs and indentations so that the discs 120, 121, 122 may be connected only in a particular orientation. This orientation feature may facilitate assembly of the dumbbell 102 while ensuring the markings 166 of the indexing disc 120 match the weight selection of the dumbbell 102.

Referring back to FIGS. 3-5, the end caps 124 may be mounted onto the shaft 127 distal or outside of the selector discs 122. The end caps 124 may be fixedly secured to the bridges 126, which may be fixedly secured to the inner covers 118. As such, the end caps 124 may remain stationary during rotation of the indexing discs 120, the separator discs 121, and the selector discs 122 during selection of the dumbbell weight. In other words, the indexing discs 120, the separator discs 121, and the selector discs 122 may rotate relative to the end caps 124.

Figure 17:
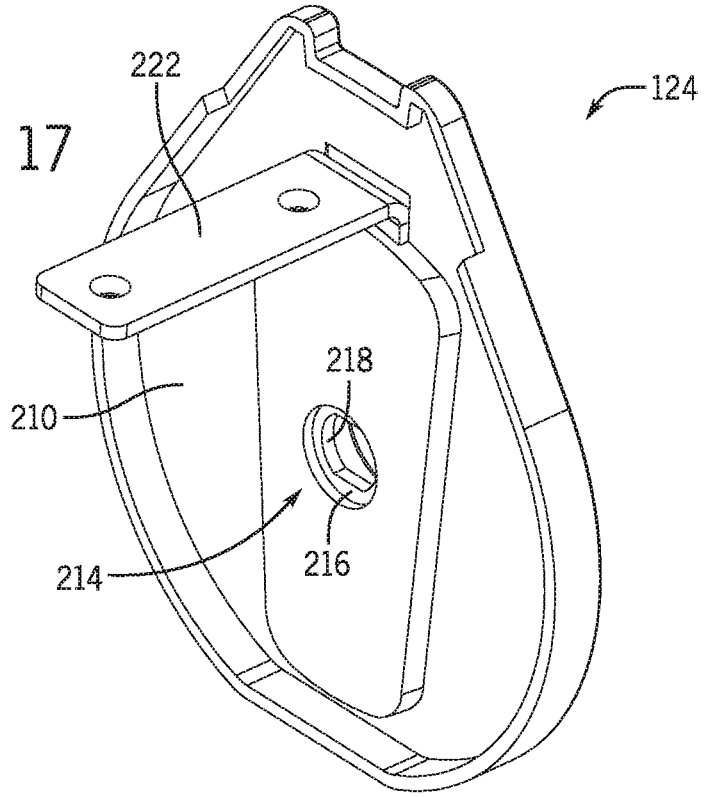
FIG. 17 is a proximal isometric view of an end cap of the handle assembly of FIG. 3.
Figure 18:
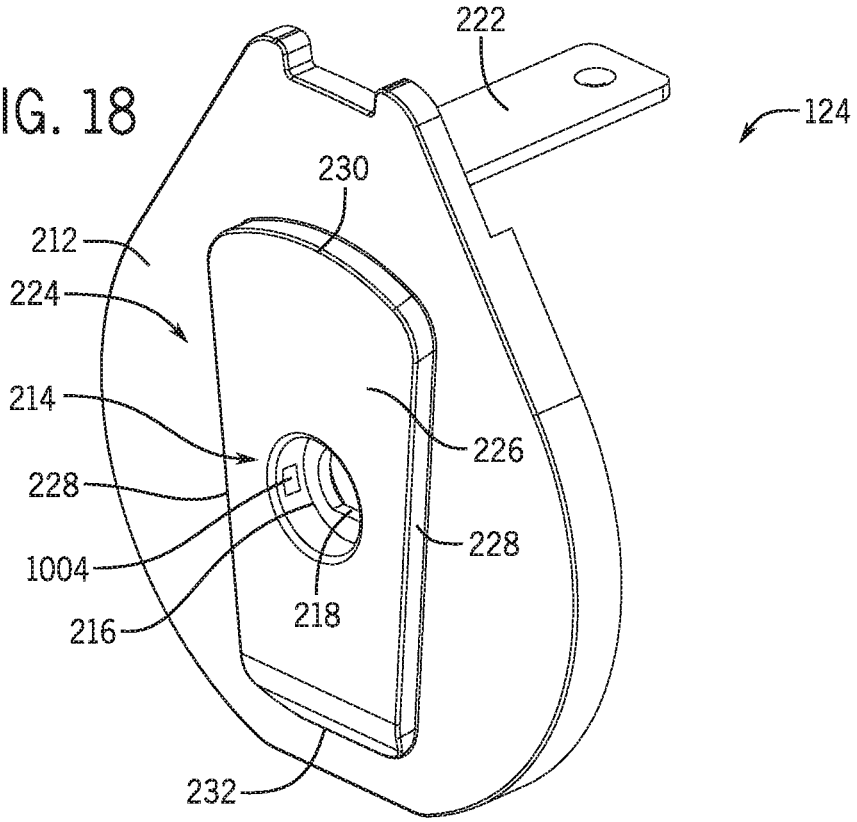
FIG. 18 is a distal isometric view of the end cap of FIG. 17.

FIG. 17 illustrates an isometric view of the inner or proximal surface 210 of the end cap 124, and FIG. 18 illustrates an isometric view of the outer or distal surface 212 of the end cap 124. The end cap 124 may define a generally centrally located aperture 214 configured to receive the end portion 130 of the shaft 127. The aperture 214 may be at least partially defined by an inwardly-extending wall 216 that defines an axially-extending, non-circular surface 218. The non-circular surface 218 may define at least a portion of the aperture 214, and thus at least a portion of the aperture 14 may be non-circular. The non-circular portion of the aperture 214 may receive therethrough a correspondingly-shaped portion of the shaft 127 that is located proximate an end of the shaft 127 and that may further be disposed distally of the retaining features 136 (see FIG. 6) to prevent or substantially prevent rotation of the end cap 124 relative to the shaft 127. A fastener (see FIG. 5) may be partially inserted through the aperture 214 and secured with the end portion 130 of the shaft 127 by threads, adhesives, press fit, sonic welds, any other known way to join fasteners to other parts, or any combination thereof to prevent or substantially prevent axial displacement of the end cap 124 relative to the shaft 127 and the discs 120, 121, 122.

Referring to FIG. 17, a bracket 222 may be attached to and extend proximally from the proximal surface 210 of the end cap 124. The bracket 222 may be configured to attach the end cap 124 to the bridge 126. The bracket 222 may define one or more through-holes for receiving fasteners that attach the bracket 222, and thus the end cap 124, to the bridge 126. The bracket 222 may be located above the generally centrally-located aperture 214.

Referring to FIG. 18, a weight attachment feature 224 may extend axially from the distal surface 212 of the end cap 124. The weight attachment feature 224 may include an end face 226, which may be offset distally from the distal surface 212 of the end cap 124 by opposing lateral side walls 228. The end face 226 may be planar and may be oriented parallel to the distal surface 212 of the end cap 124. The side walls 228 may taper toward one another as the side walls 228 extend downwardly from a top wall 230 of the weight attachment feature 224 to a bottom wall 232 of the weight attachment feature 224. Additionally, the side walls 228 may taper toward one another as the side walls 228 extend proximally from the end face 226 of the weight attachment feature 224 to the distal surface 212 of the end cap 124. The aperture 214 may extend through a central region of the weight attachment feature 224.

Referring to FIGS. 3-5, the bridge 126 attaches the end cap 124 to the inner cover 118. An outer end of the bridge 126 is attached to the end cap 124, and an inner end of the bridge 126 is attached to the inner cover 118. A middle portion of the bridge 126 spans the axial distance between the end cap 124 and the inner cover 118. The bridge 126 may include downwardly extending wings 234, which may be positioned above the separator discs 121 and the selector discs 122 so as to not interfere with the rotation of the discs 120, 121, 122. The wings 234 may be generally axially aligned with the separator discs 121 and the selector discs 122. Opposing internal side walls of weights 108 and opposing faces of the weights 108 may be positioned between adjacent wings with the opposing internal walls abutting against the bridge 126 and the opposing faces abutting against the wings 234. Abutment of the internal side walls of the weights 108 against the bridge 126 prevents the weights from rotating about the shaft 127 during use of the dumbbell 102, and abutment of the opposing faces of the weights 108 against the wings 234 prevents the weights 108 from sliding along or rocking about the shaft 127 during use of the dumbbell 102.

Figure 20:
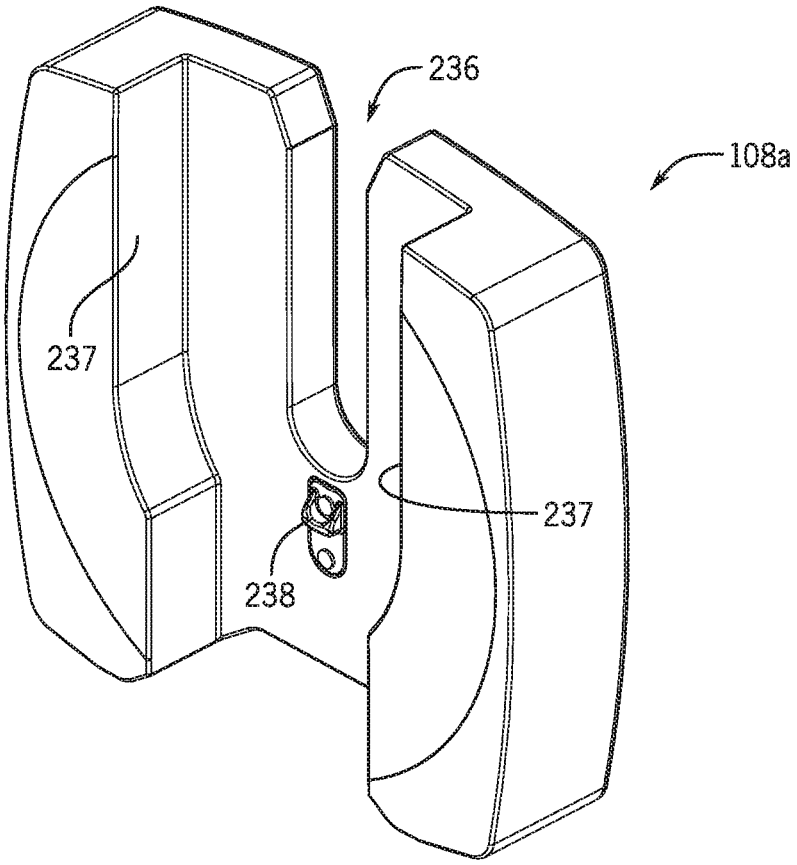
FIG. 20 is a proximal isometric view of a first weight of the adjustable dumbbell system of FIG. 1.
Figure 21:
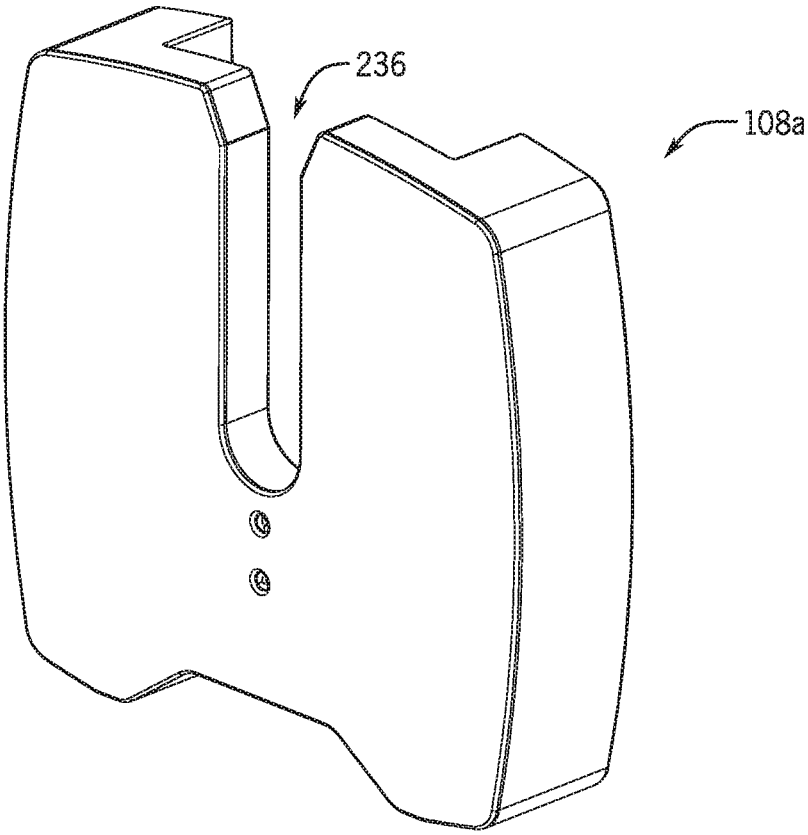
FIG. 21 is a distal isometric view of the first weight of FIG. 20.
Figure 22:
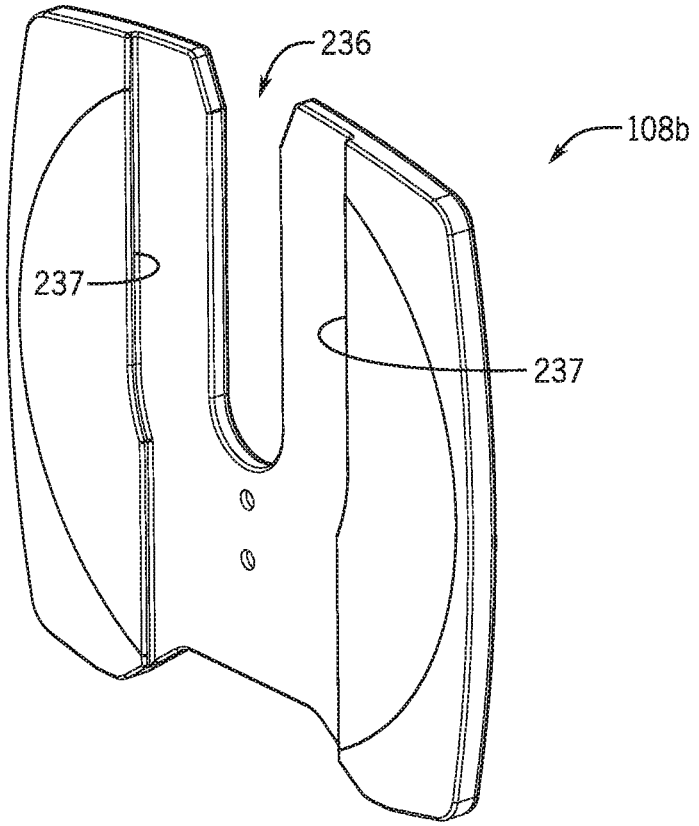
FIG. 22 is a proximal isometric view of a second weight of the adjustable dumbbell system of FIG. 1.
Figure 23:
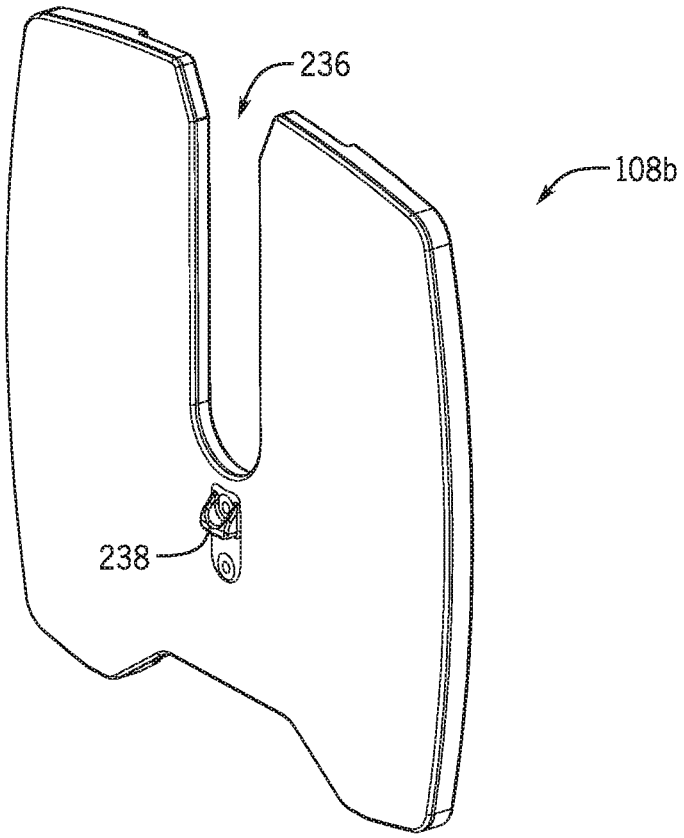
FIG. 23 is a distal isometric view of the second weight of FIG. 22.
Figure 24:
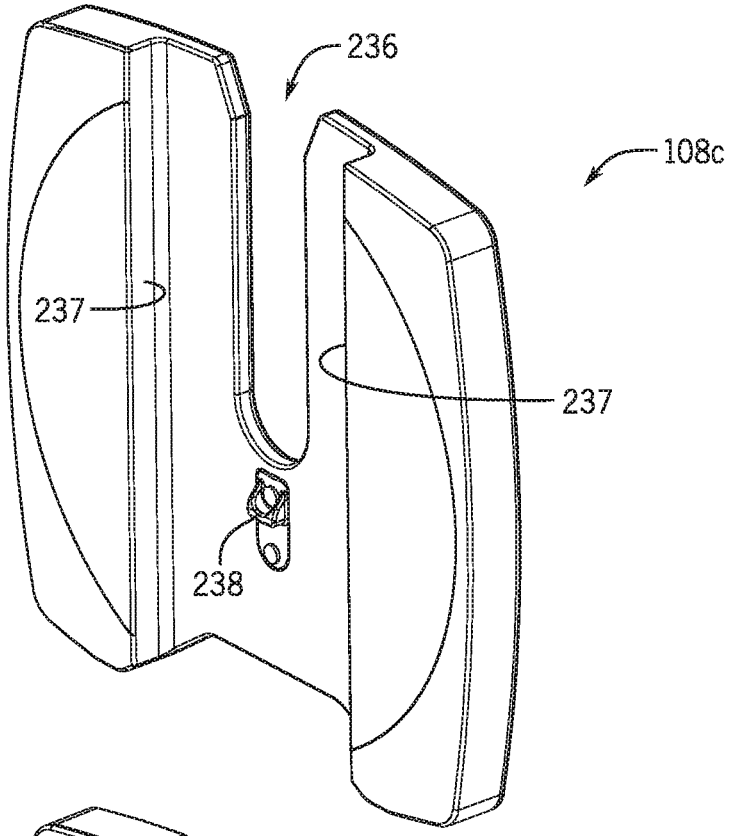
FIG. 24 is a proximal isometric view of a third weight of the adjustable dumbbell system of FIG. 1.
Figure 25:
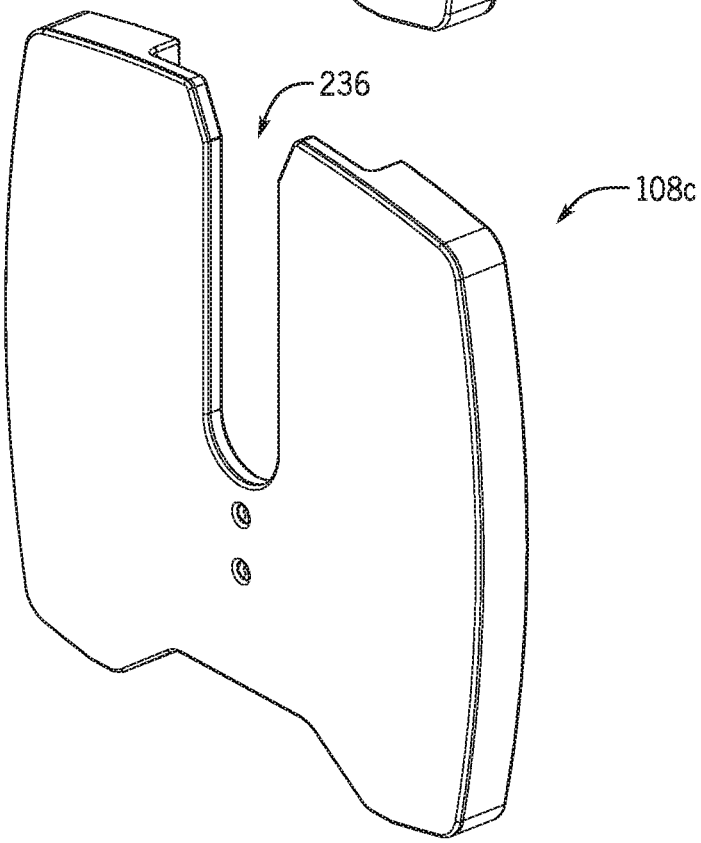
FIG. 25 is a distal isometric view of the third weight of FIG. 24.
Figure 26:
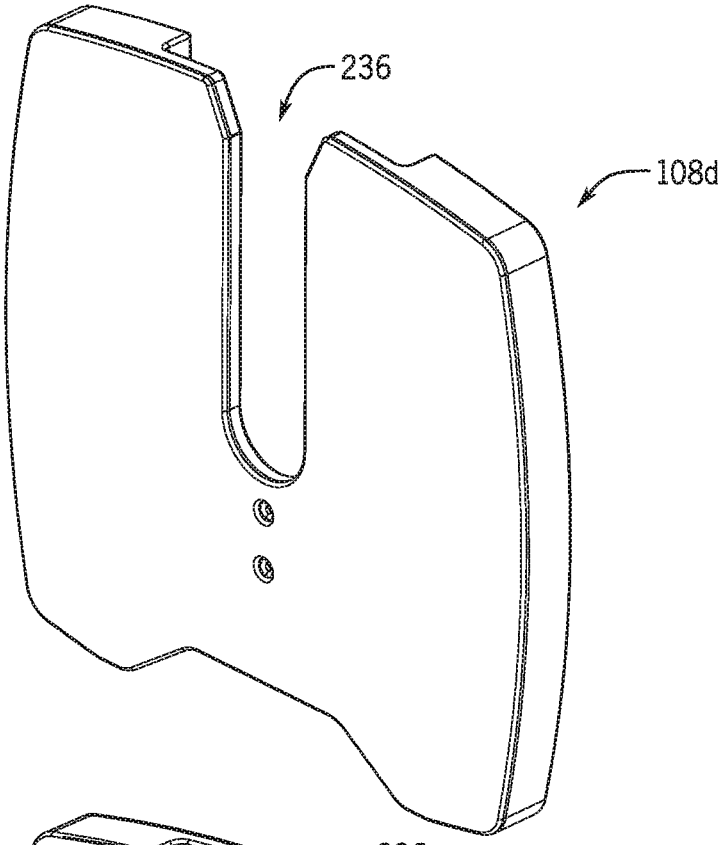
FIG. 26 is a proximal isometric view of a fourth weight of the adjustable dumbbell system of FIG. 1.
Figure 27:
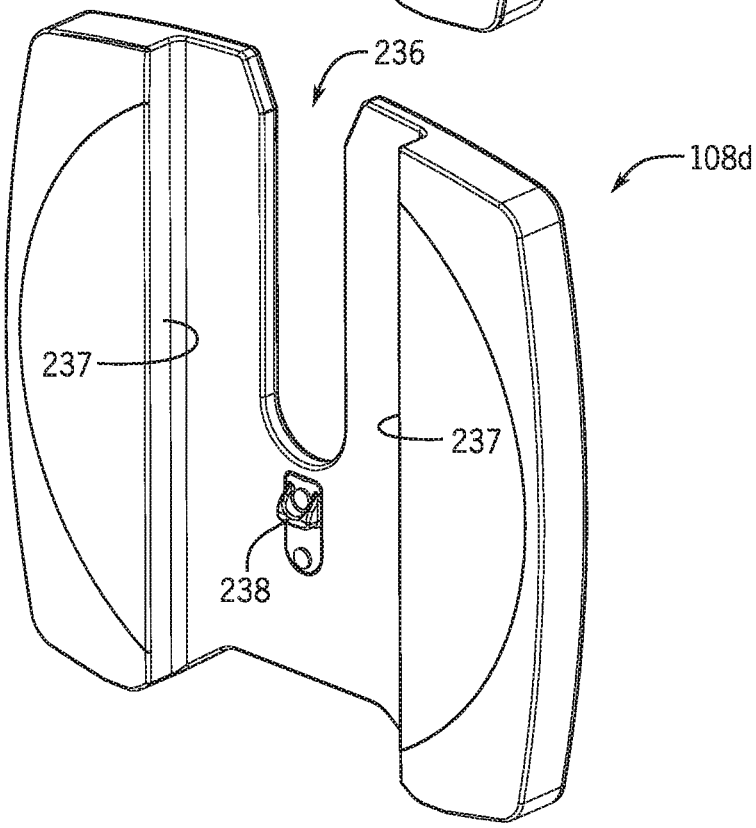
FIG. 27 is a distal isometric view of the fourth weight of FIG. 26.

Example weights 108 of the adjustable dumbbell system 100 are illustrated in FIGS. 20-27. FIGS. 20 and 21 are proximal and distal isometric views, respectively, of a first weight 108*a*. FIGS. 22 and 23 are proximal and distal isometric views, respectively, of a second weight 108*b*. FIGS. 24 and 25 are proximal and distal isometric views, respectively, of a third weight 108*c*. FIGS. 26 and 27 are proximal and distal isometric views, respectively, of a fourth weight 108*d*. The dumbbell system 100 may include more or less weights depending on the desired weight capability of the dumbbell system.

Referring to FIGS. 20-27, the weights 108*a*-108*d* may have a generally rectangular shape. Each weight 108*a*-108*d* may form a channel or slot 236 for receiving the sleeve of one of the indexing discs 120, the separator discs 121, or the selector discs 122. The channel 236 may extend through the periphery of the respective weight 108*a*-108*d* and may terminate in a semi-circular arc disposed about a longitudinal centerline of the respective weight. The channel 236 may have a constant width equal to the diameter of the semi-circular arc. The channel 236 may be sized to allow the sleeves of the discs 120, 121, 122 to rotate within the channel 236 and to only move the weight incidentally through friction. The bridge 126 may extend longitudinally through the channels 236 of the weights 108 to prevent the weights from rotating relative to the inner covers 118 and the end caps 124 during weight selection and exercise-type use. Additionally or alternatively, the wings 234 of the bridge 126 may seated within and abut against opposing internal side walls 237 of the weights 108-108*d* to prevent the weights from rotating relative to the inner covers 118 and the end caps 124 during weight selection and exercise-type use.

With continued reference to FIGS. 20-27, each weight 108*a*-108*d* may include an engagement feature 238, such as a tab, configured to engage a respective weight selection feature 157, 186, 190, 208 of one of the indexing or selector discs 120, 122. When the dumbbell 102 is placed in the base 104, the first weight 108*a* (see FIGS. 20 and 21) may be positioned between the indexing disc 120 and the separator disc 121 (see FIG. 5). The weight selection feature 157 of the indexing disc 120 (see FIG. 10) may be spaced radially outwardly of the engagement feature 238 of the weight 108*a* (see FIG. 20). In rotational orientations of the indexing disc 120 where the weight selection feature 157 is positioned beneath the engagement feature 238 of the weight 108*a*, the weight 108*a* may be fixedly joined or otherwise secured to the dumbbell handle assembly 114. In this secured position, the weight selector feature 157 of the indexing disc 120 combined with the sleeve 158 of the indexing disc 120, the sleeve 170 of the immediately distal separator disc 121, or both may restrict vertical motion of the first weight 108*a* relative to the indexing disc 120. The bridge 126 may restrict lateral and rotational motion of the weight 108*a* relative to the indexing disc 120. The opposing distal and proximal surfaces of the indexing disc 120 and the separator disc 121, respectively, and/or a wing 234 of the bridge 126 may restrict axial motion of the weight 108*a* relative to the indexing disc 120. As such, when the weight selector feature 157 of the indexing disc 120 is positioned beneath the engagement feature 238, the first weight 108*a* may be axially, laterally, vertically, and rotationally secured to the dumbbell 102. In rotational orientations of the indexing disc 120 where the weight selector feature 157 is not positioned beneath the engagement feature 238 of the first weight 108*a*, the weight 108*a* may remain in the base 104 supported by the positioning walls 110 of the base 104 as the dumbbell 102 is removed from the base 104.

When the dumbbell 102 is placed in the base 104, the second weight 108*b* (see FIGS. 22 and 23) may be positioned between the separator disc 121 and the first selector disc 122*a* (see FIG. 5). The first weight selection feature 186 of the first selector disc 122*a* (see FIG. 13) may be spaced radially outwardly of and overlap the engagement feature 238 of the second weight 108*b* (see FIG. 23). In rotational orientations of the first selector disc 122*a* where the first weight selection feature 186 is positioned beneath the engagement feature 238 of the weight 108*b*, the weight 108*b* may be retained on the dumbbell 102. In this retained position, the first weight selection feature 186 of the first selector disc 122*a* combined with the sleeve 178 of the first selector disc 122*a*, the sleeve 170 of the immediately proximal separator disc 121, or both may restrict vertical motion of the second weight 108*b* relative to the indexing disc 120. The bridge 126 may restrict lateral and rotational motion of the weight 108*b* relative to the first selector disc 122*a*. The opposing proximal and distal surfaces of the first selector disc 122*a* and the separator disc 121, respectively, and/or a wing 234 of the bridge 126 may restrict axial, lateral, and rotational motion of the weight 108*b* relative to the first selector disc 122*a*. As such, when the first weight selection feature 186 of the first selector disc 122*a* is positioned beneath the engagement feature 238, the second weight 108*b* may be axially, laterally, vertically, and rotationally secured to the dumbbell 102. In rotational orientations of the first selector disc 122*a* where the first weight selection feature 186 is not positioned beneath the engagement feature 238 of the second weight 108*b*, the weight 108*b* may remain in the base 104 supported by the positioning walls 110 of the base 104 as the dumbbell 102 is removed from the base 104.

When the dumbbell 102 is placed in the base 104, the third weight 108*c* (see FIGS. 24 and 25) may be positioned between the first and second selector discs 122*a*, 122*b* (see FIG. 5). The second weight selection feature 190 of the first selector disc 122*a* (see FIG. 14) may be spaced radially outwardly of and overlap the engagement feature 238 of the third weight 108*c* (see FIG. 24). In rotational orientations of the first selector disc 122*a* where the second weight selection feature 190 is positioned beneath the engagement feature 238 of the third weight 108*c*, the weight 108*c* may be retained on the dumbbell 102. In this retained position, the second weight selection feature 190 of the first selector disc 122*a* combined with the sleeve 178 of the first selector disc 122*a*, the sleeve 194 of the second selector disc 122*b*, or both may restrict vertical motion of the third weight 108*c* relative to the first selector disc 122*a*. The bridge 126 may restrict rotational and lateral motion of the weight 108*c* relative to the first selector disc 122*a*. The opposing distal surface 192 and annular rim 204 of the first and second selector discs 122*a*, 122*b*, respectively, and/or a wing 234 of the bridge 126 may restrict axial motion of the weight 108*c* relative to the first selector disc 122*a*. As such, when the second weight selection feature 190 of the first selector disc 122*a* is positioned beneath the engagement feature 238, the third weight 108*c* may be axially, vertically, laterally, and rotationally secured to the dumbbell 102. In rotational orientations of the first selector disc 122*a* where the second weight selection feature 190 is not positioned beneath the engagement feature 238 of the third weight 108*c*, the weight 108*c* may remain in the base 104 supported by the positioning walls 110 of the base 104 as the dumbbell 102 is removed from the base 104.

When the dumbbell 102 is placed in the base 104, the fourth weight 108*d* (see FIGS. 26 and 27) may be positioned between the second selector disc 122*b* and the end cap 124. The weight selection feature 208 of the second selector disc 122*b* (see FIG. 16) may be spaced radially outwardly of and overlap the engagement feature 238 of the fourth weight 108*d* (see FIG. 27). In rotational orientations of the second selector disc 122*b* where weight selection feature 208 is positioned beneath the engagement feature 238 of the fourth weight 108*d*, the weight 108*d* may be retained on the dumbbell 102. In this retained position, the weight selection feature 208 of the second selector disc 122*b* combined with the sleeve 194 of the second selector disc 122*b* may restrict vertical motion of the fourth weight 108*d* relative to the second selector disc 122*b*. The bridge 126 may restrict lateral and rotational motion of the weight 108*d* relative to the second selector disc 122*b*. The opposing distal and proximal surfaces of the second selector disc 122*b* and the end cap 124, respectively, and/or a wing 234 of the bridge 126 may restrict axial motion of the weight 108*d* relative to the second selector disc 122*b*. As such, when the weight selection feature 208 of the second selector disc 122*b* is positioned beneath the engagement feature 238, the fourth weight 108*d* may be axially and rotationally secured to the dumbbell 102. In rotational orientations of the second selector disc 122*b* where one of the distal flanges 208 is not positioned beneath the engagement feature 238 of the fourth weight 108*d*, the weight 108*d* may remain in the base 104 supported by the positioning walls 110 of the base as the dumbbell 102 is removed from the base 104. Various orientations of the rotatable sleeve 132, and thus of the indexing discs 120 and the selector discs 122, may cause none or one or more of the weight selection features 157, 186, 190, 208 of the discs 120, 122 to engage the engagement features 238 of the weights 108*a*-108*d* to allow the user to select a desired amount of dumbbell weight.

For dumbbells in which the weight selection features 157, 186, 190, 208 are flanges or the like, the number of incremental weight selections available on the dumbbell 102 may be altered by varying the arc length of the flanges and/or by varying the radial location of the flanges. For example, if the arc length of the flanges is decreased, the number of peripheral flanges that may be placed around a constant radius is increased, thus increasing the number of incremental weight selections that may be made. By increasing the radius of the flanges from the center of the discs 120, 122, the number of flanges that may be arranged on the discs 120, 122 is increased, thus increasing the potential number of incremental weight selections that may be made. Although the peripheral flanges are preferably located along the periphery of the selection discs 122 so that the radius available to position the flanges is maximized, the flanges may be located at any radial distance along a face of the discs 122.

The dumbbell 102 may include weights 108 having different weight amounts to provide numerous dumbbell weight options. In some implementations, the handle assembly 114 weighs about five pounds, the first weight 108*a* weighs about fifteen pounds, the second weight 108*b* weighs about two and one-half pounds, the third weight 108*c* weighs about five pounds, and the fourth weight 108*d* weighs about five pounds. In these implementations, the weights 108 may provide the dumbbell 102 with a weight range between about five and sixty pounds, with numerous weight increments. The weights 108 may be constructed of a single weight plate or multiple weight plates attached together (e.g., clipped, glued, riveted, welded, or other suitable attachment elements/methods). In implementations where the weights 108 are constructed of multiple weights plates attached together, the weight plates may be coated with an over-mold material. Example over-mold materials may be nylon, Polypropylene, Kraton, or other suitable materials.

The adjustable dumbbell 102 may include one or more weights that utilize another type of selection mechanism to accommodate heavier dumbbells. For ease of reading comprehension, these weights may be referred to as an "additional weight" or an "add-on weight." The terms "additional" or "add-on" before weight are not intended to be limiting and are merely used within the specification to help distinguish the following described weights from other weights described herein.

As described in more detail below, the add-on or additional weights may include a selection assembly, which may include selection member. In some implementations, a selector may rotate in a plane of rotation to linearly move the selection member back and forth between a selected position in which the weight is fixedly connected to the handle assembly and an unselected position in which the weight is not fixedly connected to the handle assembly, and the selection member may linearly move along a line of motion not parallel to the plane of rotation. In some implementations, the selection member may be axially movable back and forth between a selected position in which the weight is fixedly connected to the handle assembly and an unselected position in which the weight is not fixedly connected to the handle assembly.

Figure 28:
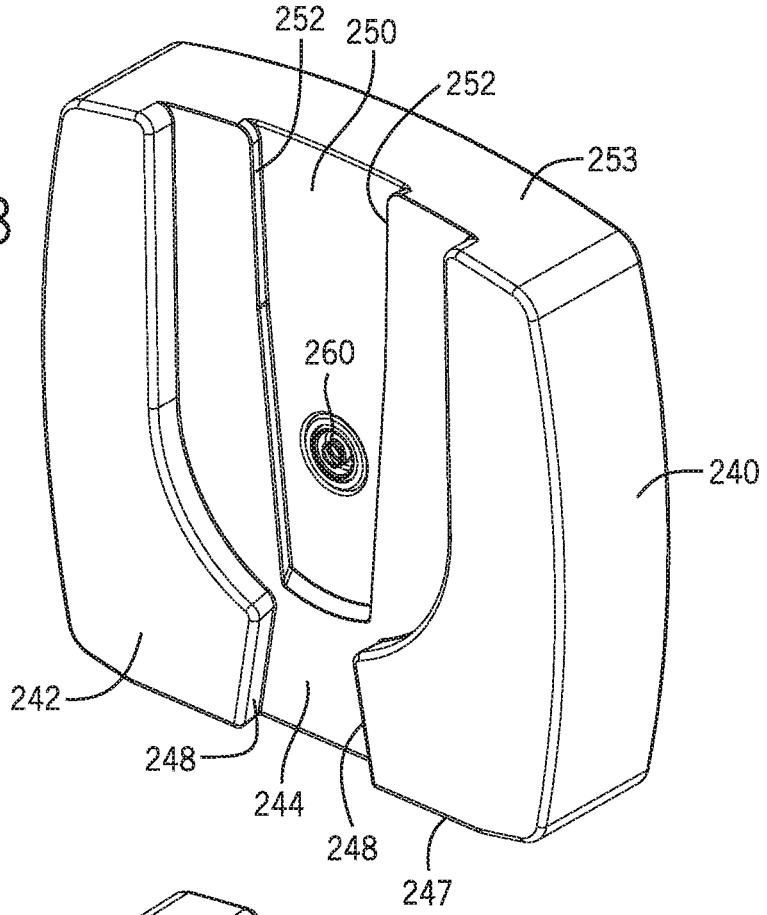
FIG. 28 is a proximal isometric view of a weight for the adjustable dumbbell system of FIG. 1.

FIGS. 1 and 2 among other figures show a first embodiment of an add-on weight 240. When not coupled to the dumbbell 102, the add-on weighs 240 may be seated onto the base 104 using a mechanical coupling technique, such as a dovetail joint. Turning to FIGS. 2 and 28, a proximal surface 242 of the add-on weight 240 may define a trapezoidal recess 244 configured to receive a complementary trapezoidal projection 246 of the base 104. Referring to FIG. 28, opposing side walls 248 defining the trapezoidal recess 244 may diverge away from one another as the side walls 248 extend downwardly toward a bottom wall 247 of the add-on weight 240. The side walls 248 may converge toward one another as the side walls 248 extend proximally toward the proximal face 242 of the add-on weight 240. The trapezoidal recess 244 may be downwardly opening so that the recess 244 receives the trapezoidal projection 246 when the dumbbell 102 is lowered vertically onto the base 104. The trapezoidal projection 246 may be located distally of the positioning walls 110 and may be oriented in an upright position. The trapezoidal projection 246 of the base 104 may include side walls configured to complement the side walls 248 of the add-on weight 240 to prevent axial, lateral, and rotational movement of the add-on weight 240 relative to the base 104 when the add-on weight 240 is seated onto the trapezoidal projection 246 of the base 104.

With continued reference to FIGS. 1 and 2, the add-on weights 240 may be situated on opposing ends of the dumbbell 102 distally of the end caps 124. Referring to FIGS. 2 and 28, the add-on weights 240 may include a weight attachment feature 250 configured to interconnect with the weight attachment feature 224 of the end cap 124. In some embodiments, the weight attachment feature 250 of the add-on weigh 240 may be an inverted trapezoidal recess configured to receive the weight attachment feature 224 of the end cap 124. The inverted trapezoidal recess may be disposed vertically above the trapezoidal recess 244. Referring to FIG. 28, opposing side walls 252 defining the inverted trapezoidal recess may diverge away from one another as the side walls 252 extend upwardly toward a top wall 253 of the add-on weight 240. Additionally, the side walls 252 may converge toward one another as the side walls 252 extend proximally toward the proximal face 242 of the add-on weight 240. The trapezoidal recess may be upwardly opening so that the recess receives the weight attachment feature 224 of the end cap 124 when the dumbbell 102 is lowered vertically onto the base 104. The side walls 252 of the inverted trapezoidal recess 250 may be complementary to the side walls 228 of the weight attachment feature 224 of the end cap 124 (see FIG. 18) to prevent axial, lateral, and rotational movement of the add-on weight 240 relative to the end cap 124 when the add-on weight 240 is seated onto the weight attachment feature 224 of the end cap 124.

While the weight attachment feature 224 of the end cap 124 is shown as a generally dovetail shaped projection or pin and the weight attachment feature 250 of the add-on weight 240 is shown as a correspondingly shaped recess or groove, these weight attachment features 224, 250 may be any suitable shape or structure that restricts one or two translation degrees of rigid body motion freedom (e.g., axial and lateral translation) between the handle assembly 114 and the add-on weight 240 when interconnected. Additionally, the weight attachment features 224, 250 of the end cap 124 and the add-on weight 240 may restrict one or more rotation degrees of rigid body motion freedom between the handle assembly 114 and the add-on weight 240. In some embodiments, five of the six degrees of rigid body motion freedom between the add-on weight 240 and the handle assembly 114 are restrained when the add-on weight 240 is joined to the handle assembly 114 via only the weight attachment features 224, 250. In such embodiments, the add-on weight 240 may move relative to the handle assembly 114 along an unrestrained translation degree of rigid body motion freedom so that the add-on weight 240 may be disconnected from the handle assembly 114. In some embodiments, the weight attachment feature 224 of the end cap 124 may take the form of a suitably shaped recess, groove, slot or the like, and the weight attachment feature 250 of the add-on weight 240 may include a correspondingly shaped projection, pin, tongue, rail or the like.

Figure 29:
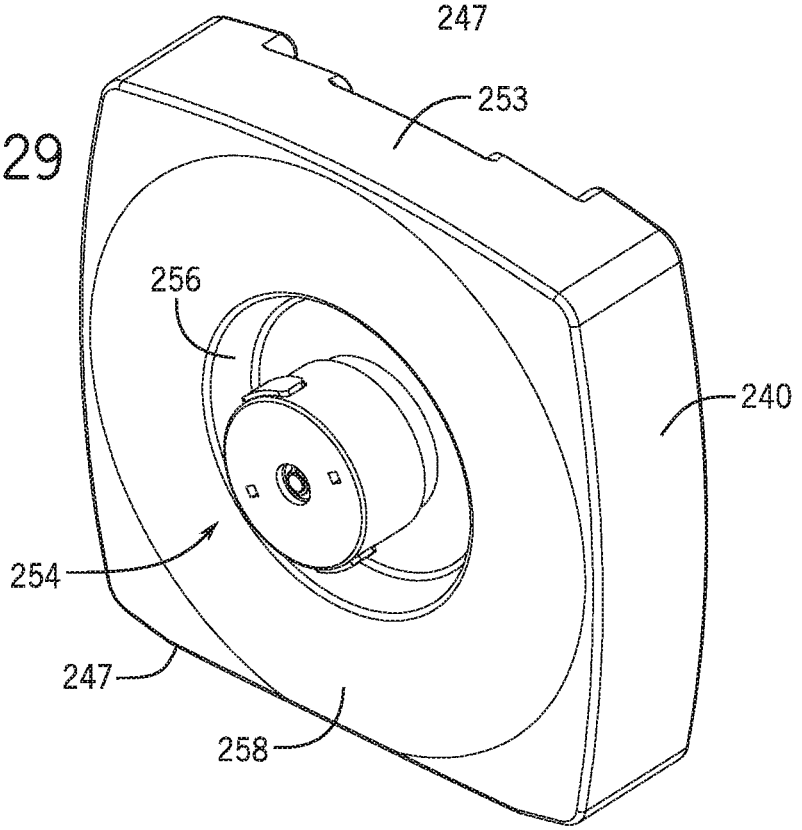
FIG. 29 is a distal isometric view of the weight of FIG. 28.

Referring to FIGS. 1, 2, and 29, the dumbbell system 100 may include a selection assembly 254 to selectively fixedly connect the add-on weight 240 to the dumbbell 102. The selection assembly 254 may be attached to the add-on weight 240 and may be substantially disposed on a distal side of the add-on weight 240. The selection assembly 254 may be axially aligned with a longitudinal axis of the dumbbell 102 and may be partially received within an aperture 260 of the add-on weight 240 (see FIG. 28). The aperture 260 may be positioned within a central region of the add-on weight 240. To shorten the overall length of the dumbbell 102 when the add-on weights 240 are selected, the selection assembly 254 may be disposed at least partially within a recess 256 defined in a distal face 258 of the add-on weight 240. The recess 256 may define an annular space around the selection assembly 254 to accommodate a user's fingers during engagement or disengagement of the add-on weight 240 to or from the dumbbell 102.

Referring to FIGS. 30-33, the selection assembly 254 may include one or more of the following: a selector 262, a base 264, a selection member 266, a pair of retaining clips 268, and a biasing member 270, such as a helical spring. With reference to FIGS. 30-33, the selector 262 may include a knob 272, a selector lock assembly, and a cover plate 310. The knob 272 may be formed into the shape of a cup or a cap.

The knob 272 may include a base plate 274 and an annular side wall 276 attached to a periphery of the base 274. The base plate 274 may define a centrally-located aperture 278, which may receive a portion of the selection member 266. The side wall 276 may extend axially away from the base plate 274 and may define an interior space 277. The knob 272 may be oriented so that the side wall 276 extends proximally from the base plate 274 toward the distal face 258 of the add-on weight 240.

Figure 31:
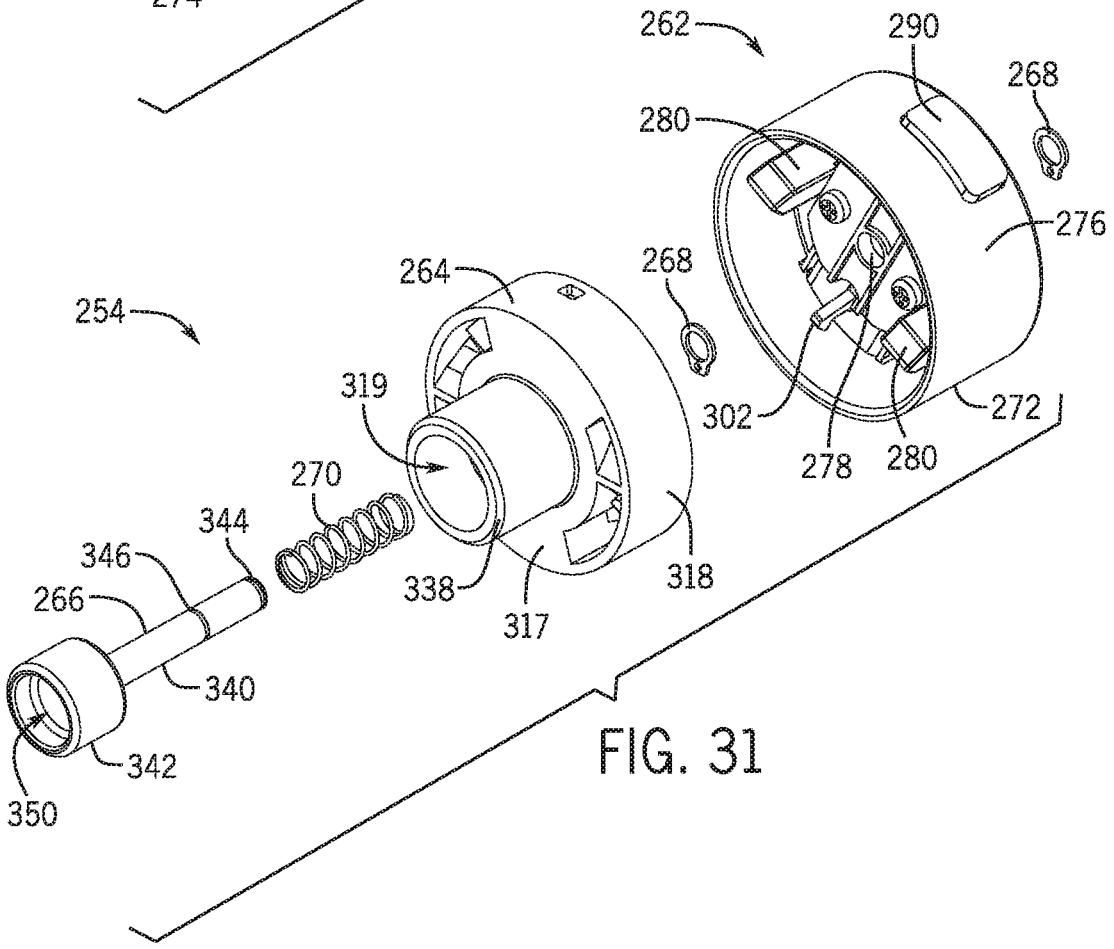
FIG. 31 is a partially exploded, proximal isometric view of the selection assembly of FIG. 30.
Figure 32:
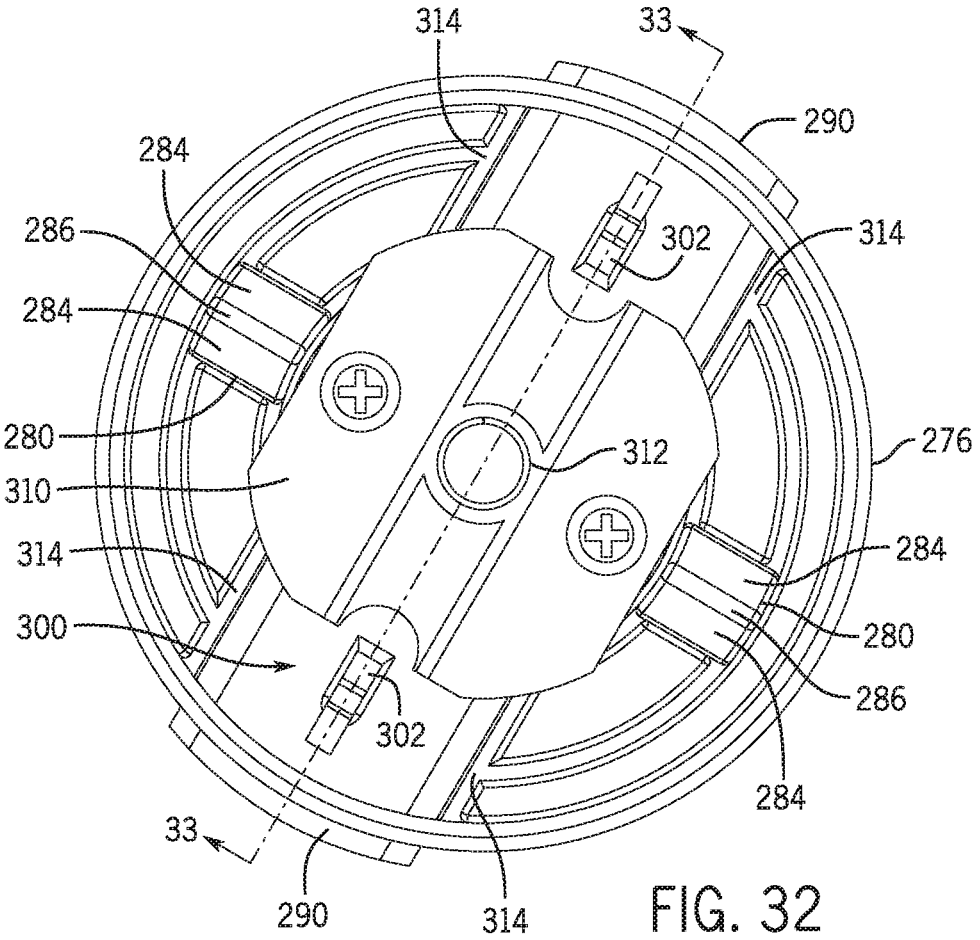
FIG. 32 is a proximal elevation view of a portion of the selection assembly of FIG. 30.
Figure 33:
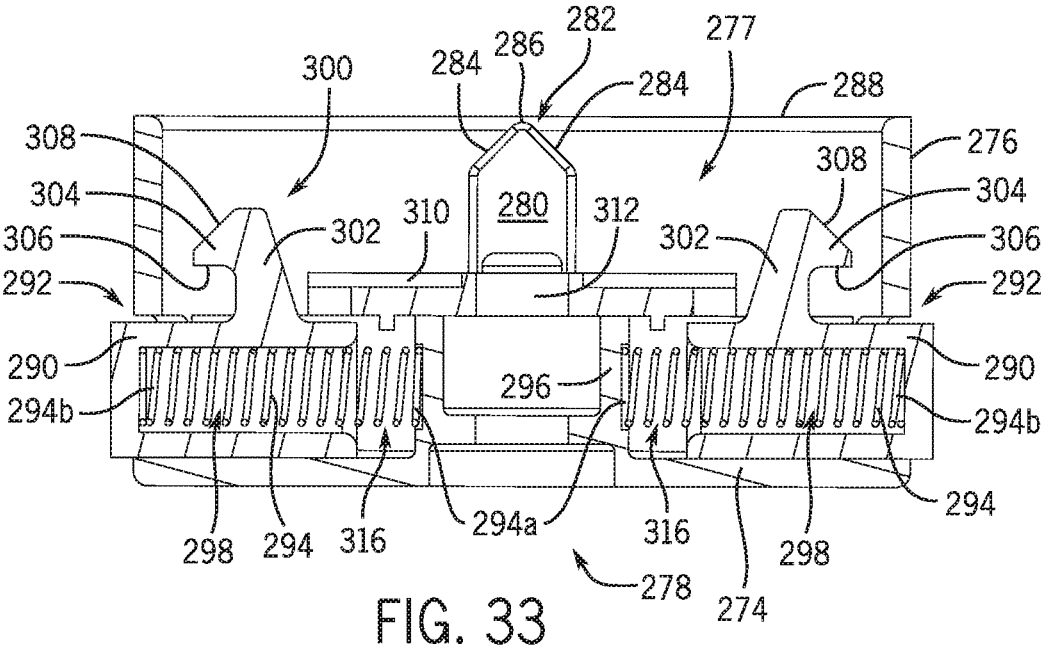
FIG. 33 is a cross-sectional view of a portion of the selection assembly of FIG. 30 taken along line 33-33 of FIG. 32.

Referring to FIGS. 31-33, a pair of diametrically-opposed cam followers or posts 280 may be attached to and extend proximally from the base plate 274. The posts 280 may be located radially between the side wall 276 and the aperture 278. Each post 280 may include a proximal free end 282, which may include two angled surfaces 284 that intersect along an apex 286 (see FIGS. 32 and 33). The apex 286 may be substantially axially aligned with a proximal end face 288 of the side wall 276 (see FIG. 33).

With continued reference to FIGS. 30-33, the selector lock assembly may include a pair of movable members 290, such as depressible buttons or push tabs, and one or more bias members 294. The movable members 290 may be received within apertures 292 formed in the side wall 276 of the knob 272 and may diametrically oppose each other. When received in the apertures 292, the movable members 290 may be disposed angularly between the posts 280.

Referring to FIG. 33, a portion of the movable members 290 may be located exterior of the side wall 276 for manipulation by a user.

Referring still to FIG. 33, the movable members 290 may be biased radially outwardly by the one or more bias members 294, such as springs. The bias members 294 may be oriented perpendicularly to a longitudinal axis of the cap assembly 262 and may be disposed between the movable members 290 and a hollow stub shaft 296 of the knob 272, which may extend axially away from the base plate 274 in a distal direction. A radially-inward end 294*a* of the bias members 294 may be seated against the stub shaft 296, and a radially-outward end 294*b* of the bias members 294 may be seated against the respective movable members 290. A portion of the bias members 294 may be received within an inner cavity 298 of the movable members 290, which may open to the stub shaft 296.

Referring to FIGS. 32 and 33, a latch feature 300 may be attached to and extend in a distal direction from the movable members 290. The latch feature 300 may be disposed radially between the stub shaft 296 and the side wall 276 and may move in unison with the movable members 290. The latch feature 300 may be configured to selectively engage the base 264 based on the axial position of the knob 272 relative to the base 264. When engaged with the base 264, the latch feature 300 may prevent axial and/or rotational movement of the cap 272 relative to the base 264 until the latch feature 300 is released by actuation of the movable members 290.

With continued reference to FIGS. 32 and 33, the latch feature 300 may include a hook 302 attached to each movable member 290. The hooks 302 may move in unison with the movable members 290. The hooks 302 may be formed generally in the shape of a T. Each hook 302 may include a free end defining a barb 304 directed radially outwardly. The barb 304 may include a distal surface 306 oriented orthogonally or substantially orthogonally to the side wall 276 and a proximal surface 308 oriented obliquely to the side wall 276.

With continued reference to FIGS. 32 and 33, the cover plate 310 may be removably attached to the knob 272. The cover plate 310 may be disposed radially inward of the side wall 276 and may be oriented orthogonally or substantially orthogonally to the side wall 276. The cover plate 310 may be attached to a proximal end of the stub shaft 296 and may define a centrally-located aperture 312 aligned axially with the aperture 278 of the knob 272 and configured to receive a portion of the selection member 266. The cover plate 310 may be oriented parallel or substantially parallel to, and axially offset from, the base plate 274 to define, along with guides 314 that extend in a chord-like manner between points on the side wall 276 (see FIG. 32), respective sliding channels 316 for the movable members 290 (see FIG. 33). In this configuration, the movable members 290 may be constrained in a lateral direction between the guides 314 and may be restrained in an axial direction between the base plate 274 and the cover plate 310. The sliding channels 316 may be oversized in a radial direction to permit movement of the movable members 290 in the radial direction toward and away from the stub shaft 296.

Referring to FIGS. 30, 31, and 34-36, the base 264 of the weight selection assembly 254 may be at least partially received within the interior space 277 of the knob 272. The base 264 may include a base wall 317 and a side wall 318 extending axially from a periphery of the base wall 317. The base wall 317 may define a centrally-located aperture 319, which may receive a portion of the selection member 266. The side wall 318 may include an outer surface 320, which may be cylindrical or substantially cylindrical. The side wall 276 of the knob 272 may slidably bear against the outer surface 320 of the base 264 during movement of the knob 272 relative to the base 264. When the selection assembly 254 is assembled, the base 264 may be oriented so that the side wall 318 extends distally from the base wall 317 toward the base plate 274 of the knob 272.

Figure 34:
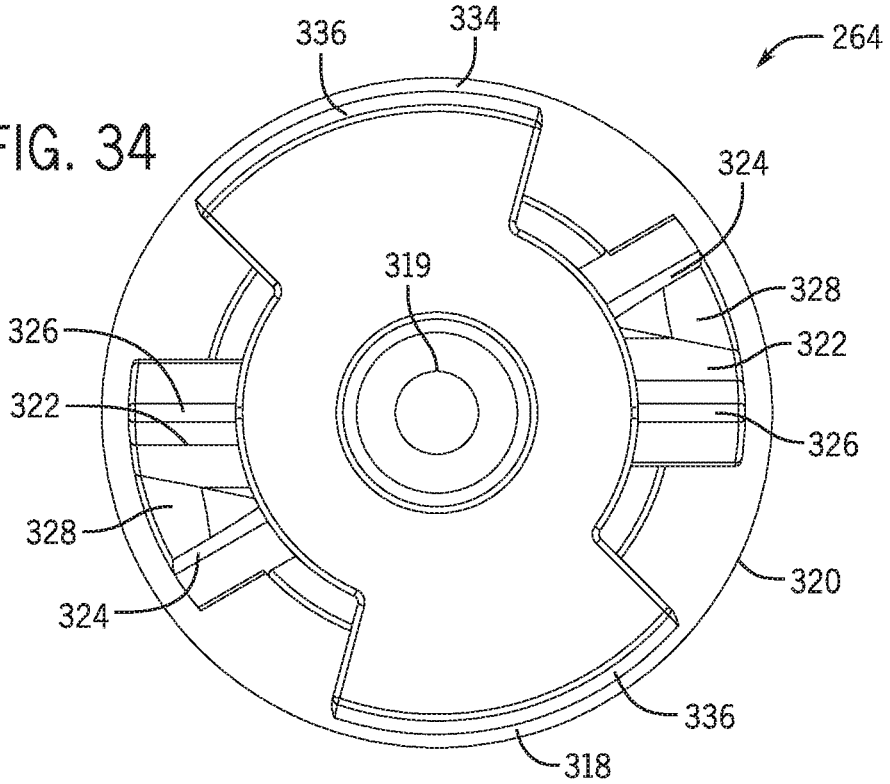
FIG. 34 is a distal elevation view of a base of the selection assembly of FIG. 30.
Figure 35:
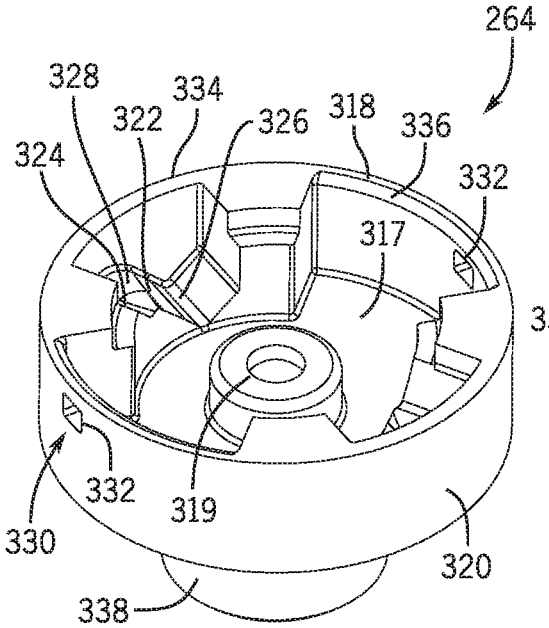
FIG. 35 is an isometric view of the base of FIG. 34.
Figure 36:
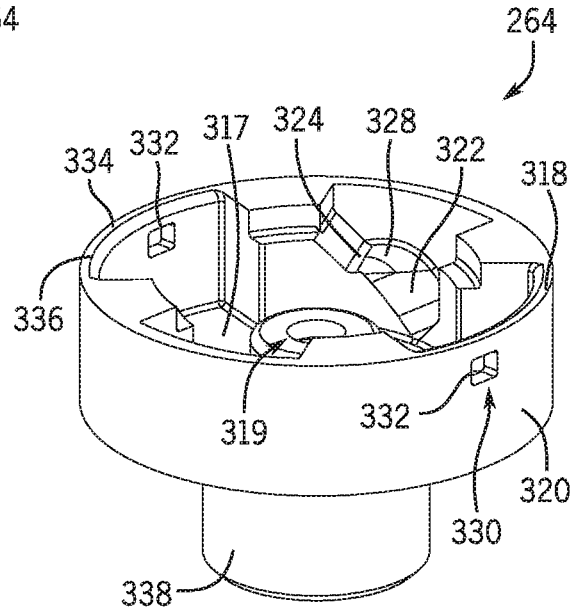
FIG. 36 is another isometric view of the base of FIG. 34.

Referring to FIGS. 34-36, the base 264 may define a pair of diametrically-opposed cam surfaces or ramps 322 configured to interface with the posts 280 of the knob 272. The ramps 322 may be disposed radially between the side wall 318 and the aperture 319. A first parking position 324 may be disposed at a distal end of the ramps 322 and may be configured to receive the proximal free end 282 of a respective post 280 when the selection assembly 254 is in a disengaged position. A second parking position 326 may be disposed at a proximal end of the ramps 322 and may be configured to receive the proximal free end 282 of a respective post 280 when the selection assembly 254 is in an engaged position. Distal portions of the ramps 322 may form dwell surfaces 328, which may define rounded transitions from the first parking positions 324 to steepened portions of the ramps 322.

With continued reference to FIGS. 34-36, the base 264 may define a catch feature 330 that interfaces with the latch feature 300 of the movable members 290 when the weight selection 254 is in an engaged position. The catch feature 330 may be defined in the side wall 318 of the base 264 and may be disposed angularly between the diametrically-opposed ramps 322. Once engaged, the corresponding latch and catch features 300, 330 may prevent axial movement of the knob 272 relative to the base 264, thereby ensuring the selection assembly 254 remains in an engaged or selected position. To permit movement of the knob 272 relative to the base 264, the movable member 290 may be depressed by a user to disengage the corresponding latch and catch features 300, 330.

With continued reference to FIGS. 34-36, the catch feature 330 of the base 264 may include a pair of diametrically-opposed apertures 332 extending through the side wall 318 of the base 264. The apertures 332 may be located axially between a distal end face 334 of the side wall 318 and the base wall 317. The apertures 332 may be located proximally of a portion of the distal end face 334 that includes a rounded or chamfered inner edge 336. The apertures 332 may be sized to receive the barbs 304 of the hooks 302 when aligned with one another.

Referring to FIGS. 31, 35, and 36-40, the base 264 may be fixedly secured to the add-on weight 240. The base 264 may include an axially-extending sleeve 338 attached to and projecting proximally from the base wall 317. The sleeve 338 may be received within the centrally-located aperture 260 of the add-on weight 240. The sleeve 338 may be interference fit within the aperture 260 such that the base 264 is fixedly joined to the add-on weight 240 (see FIGS. 37-40). Other mechanical coupling techniques may be used to secure the base 264 to the add-on weight 240 in lieu of or in addition to interference fitting the base 264 to the add-on weight 240, including, but not limited to, using fasteners, adhesives, welds, or some combination thereof. The aperture 319 of the base wall 317 may extend axially through the sleeve 338 and may be configured to receive the biasing member 270 and a proximal portion of the selection member 266.

Figure 30:
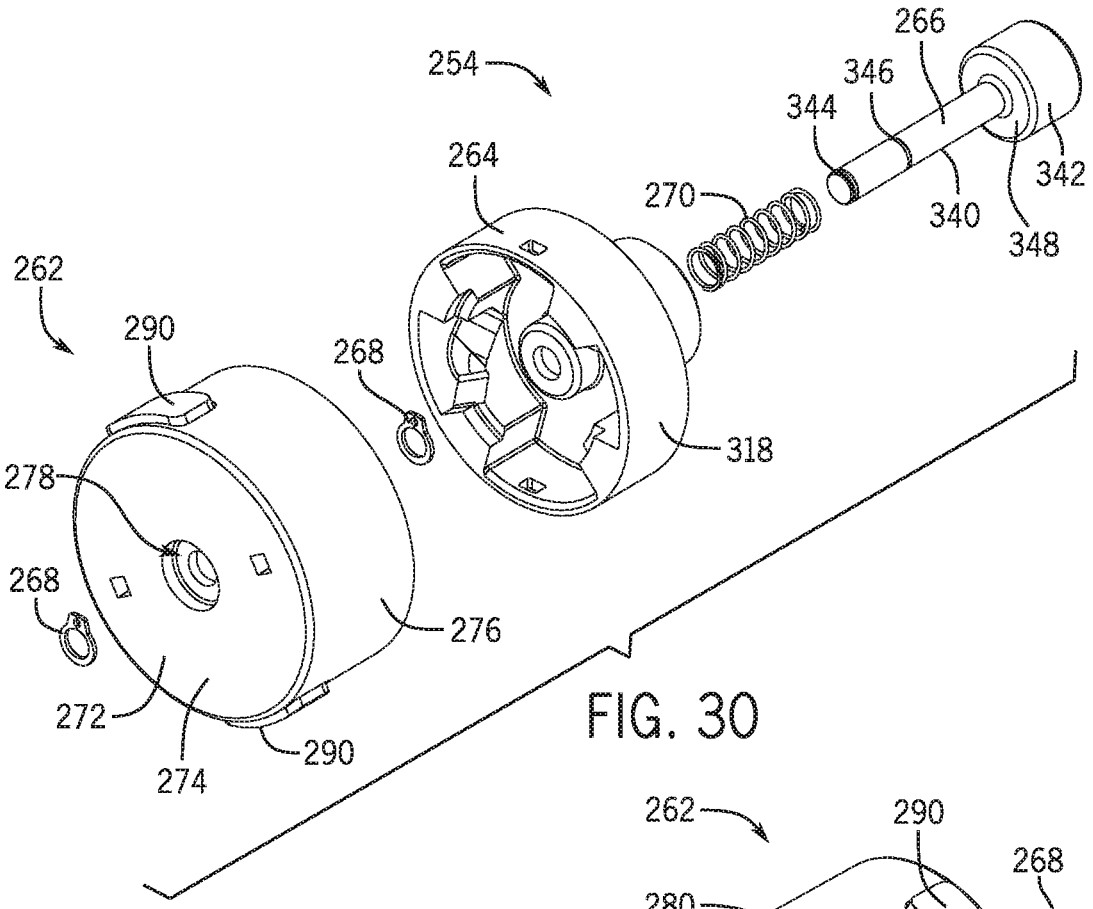
FIG. 30 is a partially exploded, distal isometric view of a selection assembly of the weight of FIG. 28.

Referring to FIGS. 30 and 31, the selection member 266 may include an elongate shaft 340 and a head 342 attached to a proximal end of the shaft 340. The shaft 340 may be attached to the selection assembly 262 so that the selection member 266 moves in unison with the selection assembly 262 along a longitudinal axis of the shaft 340. The shaft 340 may define first and second annular grooves 344, 346 in an outer surface of the shaft 340. The grooves 344, 346 may be spaced axially apart from one another along the length of the shaft 340 and may be configured to receive the retaining clips 268. Referring to FIGS. 37-40, one of the retaining clips 268 may be disposed distally of the base plate 274 of the cap 272 and may be snap fit into the first annular groove 344. The other of the retaining clips 268 may be disposed proximally of the cover plate 310 of the selection assembly 262 and may be snap fit into the second annular groove 346. The retaining clips 268 may abut against the base plate 274 and the cover plate 310 of the selection assembly 262, thereby securing the selection member 266 to the selection assembly 262 so that the selection member 266 moves in unison with the selection assembly 262 in an axial direction relative to the dumbbell 102. Other mechanical coupling techniques may be used to secure the selection member 266 to the selection assembly 262 in lieu of or in addition to utilizing retaining clips 268, including, but not limited to, using fasteners, adhesives, welds, or some combination thereof.

Referring back to FIGS. 30 and 31, the head 342 of the selection member 266 may have a larger outer diameter than the shaft 340, thereby defining a shoulder 348 (see FIG. 30) extending transversely between the outer surfaces of the shaft 340 and the head 342. The head 342 may define a recess or socket 350 opening through a proximal end face of the head 342. The socket 350 may be configured to receive a suitably shaped add-on weight engagement feature 220 secured to the handle assembly 114 when the selection assembly 254 is in an engaged or selected position (see FIGS. 39 and 40). In some embodiments, the add-on weight engagement feature 220 may be a head 220*a* of the fastener. The head 220*a* may be snugly received within the socket 350 to prevent or substantially prevent relative vertical and/or lateral movement between the selection member 266 and the add-on weight engagement feature 220. However, the add-on weight engagement feature 220 may be any suitably shaped projection, protrusion, or the like that is joined to the handle assembly 114 and that is configured to prevent relative vertical and/or lateral movement between the selection member 266 and the add-on weight engagement feature 220. Additionally, the socket 350 could be omitted from the head 342, and the add-on weight engagement feature 220 could be formed into a socket or the like that is configured to receive the head 342 therein to restrict vertical and/or lateral movement between the selection member 266 and the add-on weight engagement feature 220.

Figure 37:
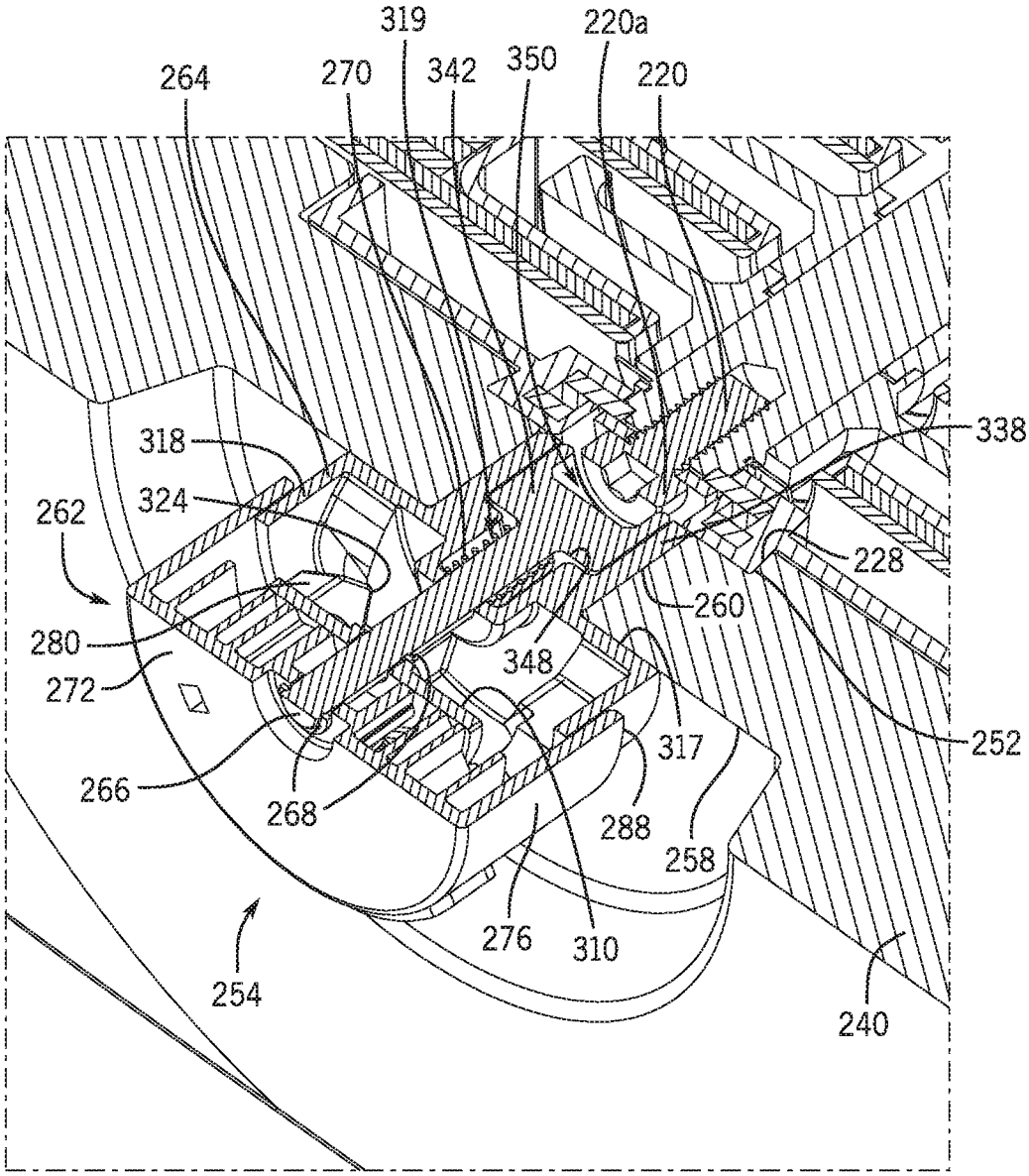
FIG. 37 is an enlarged, isometric, longitudinal cross-sectional view of the adjustable dumbbell system of FIG. 1 with the selection assembly of FIG. 30 in an unselected or disengaged state.
Figure 38:
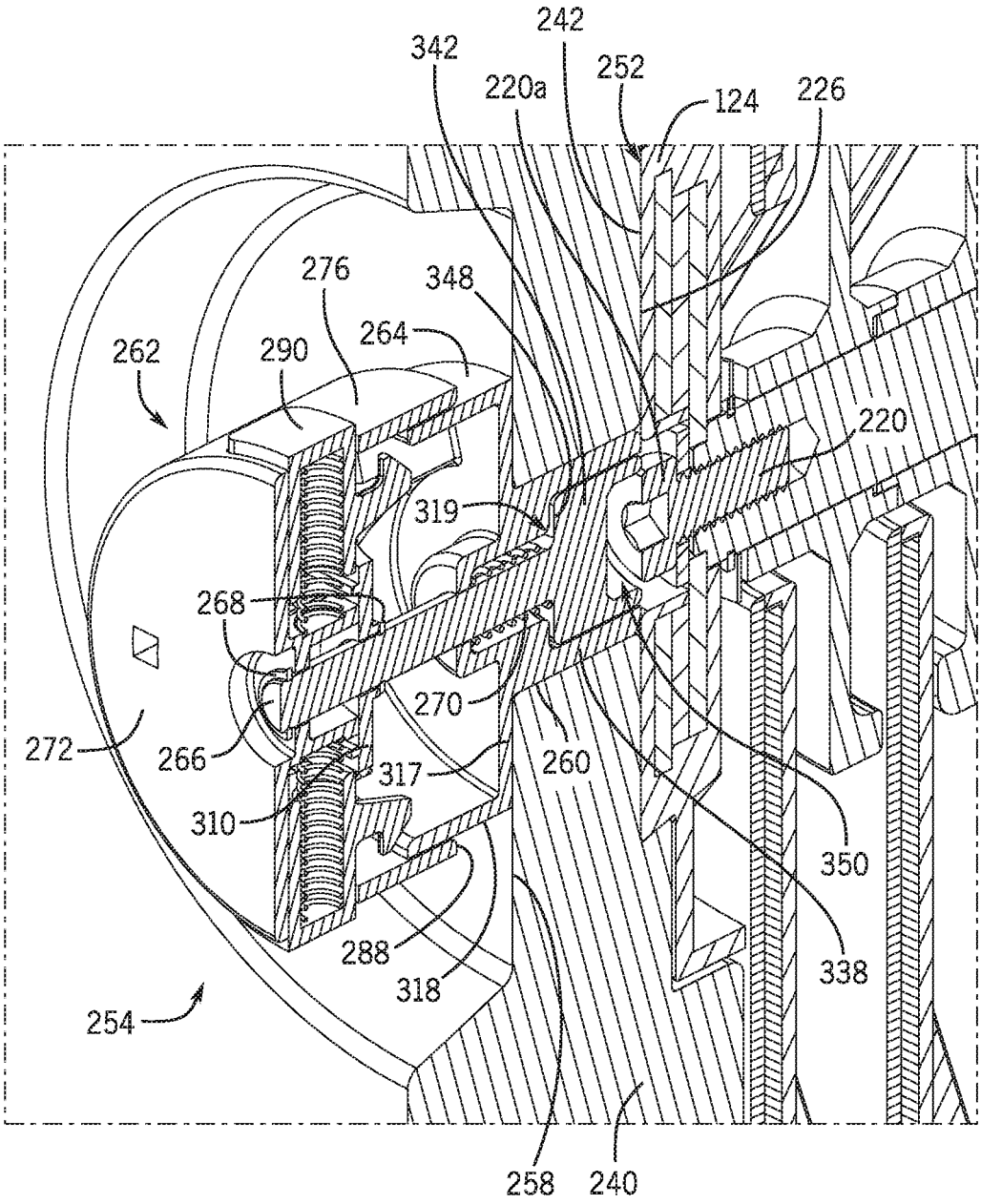
FIG. 38 is another enlarged, isometric, longitudinal cross-sectional view of the adjustable dumbbell system of FIG. 1 with the selection assembly of FIG. 30 in an unselected or disengaged state.
Figure 39:
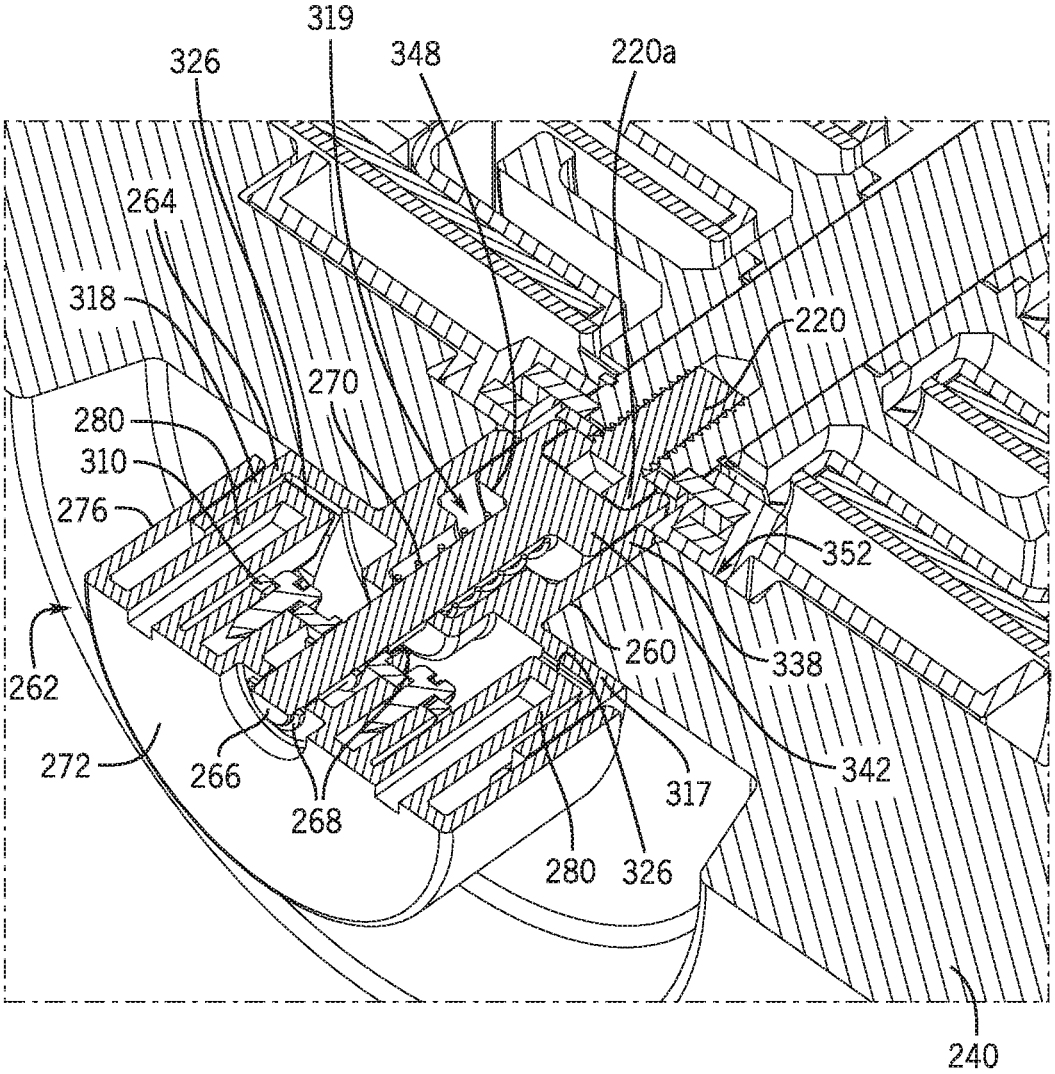
FIG. 39 is another enlarged, isometric, longitudinal cross-sectional view of the adjustable dumbbell system of FIG. 1 with the selection assembly of FIG. 30 in a selected or engaged state.
Figure 40:
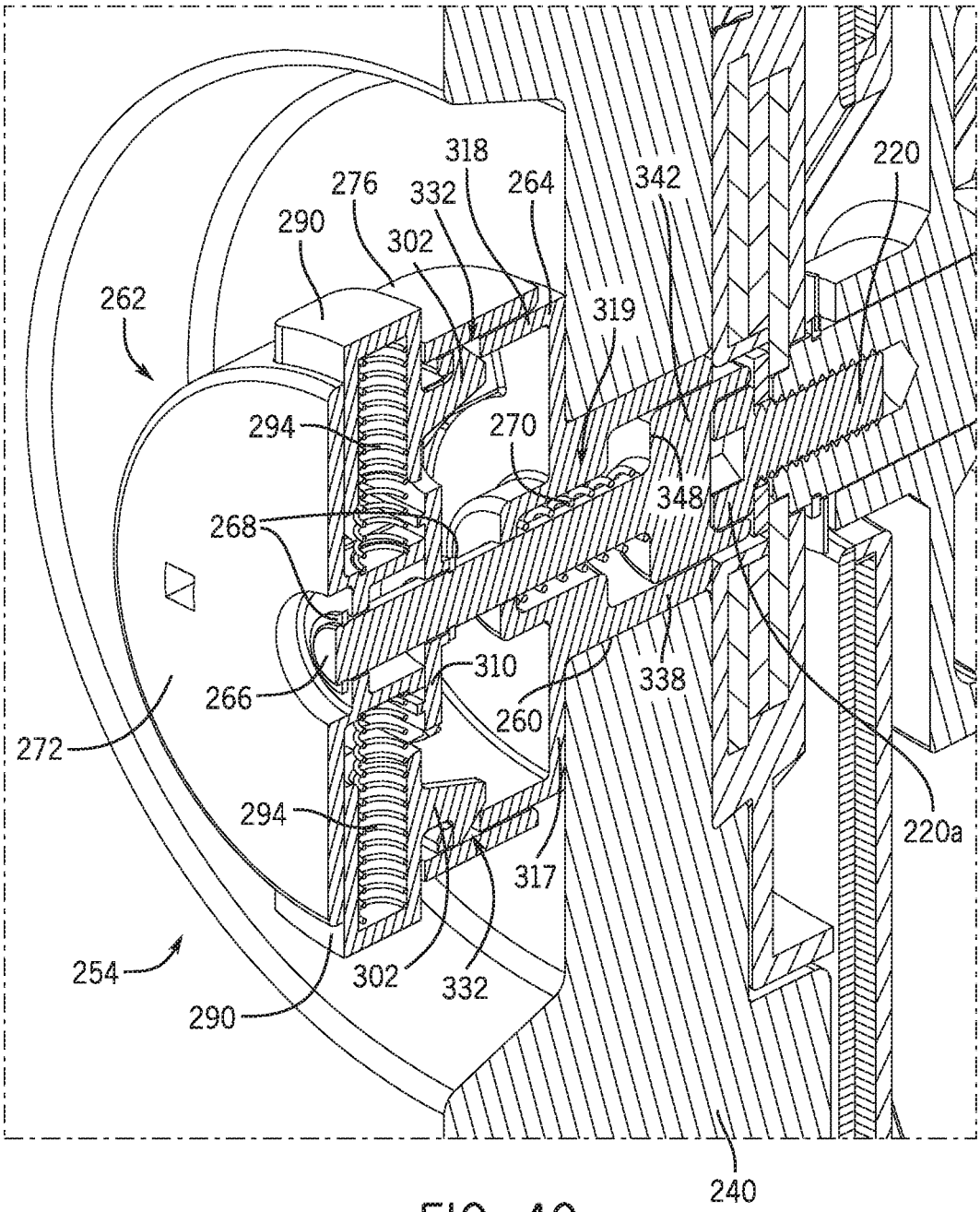
FIG. 40 is yet another enlarged, isometric, longitudinal cross-sectional view of the adjustable dumbbell system of FIG. 1 with the selection assembly of FIG. 30 in a selected or engaged state.

With continued reference to FIGS. 30, 31, and 37-40, the biasing member 270 may bias the selection member 266 toward an engaged or selected position in which the head 342 of the selection member 266 is positioned around the add-on weight engagement feature 220 (see FIGS. 39 and 40). In some embodiments, such as when the biasing member 270 is a coil spring, the biasing member 270 may be disposed about the shaft 340 of the selection member 266 and may be received within the aperture 319 defined by the base 264. The biasing member 270 may be disposed axially between the base wall 317 of the base 264 and the shoulder 348 of the selection member 266. The biasing member 270 may act against a proximal surface of the base 264 and against the shoulder 348 of the selection member 266. The biasing member 270 may exert an axial force on the head 342 of the selection member 266 in a proximal direction, thereby biasing the selection member 266 toward the engaged or selected position (see FIGS. 39 and 40).

Referring to FIGS. 37 and 38, the selection assembly 254 is depicted in a disengaged or unselected position. In the disengaged or unselected position, the selection member 266 may be disposed in a distal position that locates the selection member 266 distally of the separation plane 352 defined between the proximal surface 242 of the add-on weight 240 and the distal end face 226 of the end cap 124, thereby allowing the handle assembly 114 (see FIG. 5) to be removed from the base 104 without the add-on weight 240. In the disengaged or unselected position, the head 342 of the selection member 266 may be housed within the sleeve 338 and the shoulder 348 may abut against a corresponding internal wall of the sleeve 338 to allow the handle assembly 114 to be removed from the base 104 without the selection member 266 interfering with handle assembly 114. In the unselected or disengaged position, the posts 280 of the knob 272 may be seated in the first parking position 324 of the base 264 to maintain the selection assembly 254 in the disengaged or unselected position. The side wall 276 of the knob 272 may overlap the side wall 318 of the base 264 to ensure proper axial alignment of the knob 272 and the base 264. The proximal end face 288 of the side wall 276 may be spaced axially apart from the distal face 258 of the add-on weight 240 to allow axial movement of the knob 272 toward the add-on weight 240 once the posts 280 are unseated from their first parking positions 324. The biasing member 270 may be axially compressed between the shoulder 348 of the selection member 266 and the base plate 317 of the base 264.

Referring to FIGS. 39 and 40, the selection assembly 254 is depicted in an engaged or selected position. In the engaged or selected position, the selector 262 may be disposed in a proximal position such that the selection member 266 spans across the separation plane 352, thereby preventing relative vertical movement between the add-on weights 240 and the handle assembly 114 (see FIGS. 5, 39, and 40). As previously discussed, when the handle assembly 114 and the add-on weight 240 are placed onto the base 104, the side walls 252 of the inverted trapezoidal recess 250 of the add-on weight 240 may engage the side walls 228 of the weight attachment feature 224 of the end cap 124 to prevent axial, lateral, and rotational movement of the add-on weight 240 relative to the end cap 124. Thus, upon extension of the selection member 266 across the vertical separation plane 352, the weight engagement assembly 254 prevents or substantially prevents vertical movement of the end cap 124 relative to the add-on weight 240, and vice versa, resulting in the add-on weight 240 being fixedly secured to the handle assembly 114.

Referring to FIG. 39, when the selection assembly 254 is in the engaged or selected position, the posts 280 of the knob 272 may be disposed in the second parking position 326 of the base 264 and may be biased into this position by the biasing member 270. Referring to FIG. 40, the hooks 302 of the movable members 290 may be received within the apertures 332 of the base 264 to secure the selection assembly 254 in the engaged or selected position. The distal surfaces 306 of the hooks 302 (see FIG. 33) may engage a portion of the side wall 318 surrounding the apertures 332 to secure the selector 262 to the base 264.

To select the add-on weight 240, the user may place the dumbbell 102 in the base 104, move the selector 262 into the engaged or selected position, and remove the dumbbell 102 from the base 104 to perform a desired exercise. To move the selector 262 between the engaged or selected position and the disengaged or unselected position, or vice versa, the user may rotate or twist the selector 262 via the knob 272 about an axis of rotation with the rotation occurring in a plane of rotation that is perpendicular to the axis of rotation. The axis of rotation may be parallel and/or coincident to a central longitudinal axis of the shaft 127 of the dumbbell 102.

Rotation of the selector 262 in a first rotational direction unseats the posts 280 of the knob 272 from the first parking positions 324 of the base 264. Once the posts 280 are unseated, the selector 262 linearly moves the selection member 266 towards the end caps 124. Thus, rotational motion of the selector 262 is converted into linear motion of the selection member 266. The linear movement of the selection member 266 may occur along a line of motion that is (1) parallel, substantially parallel, or coincident to the axis of rotation, (2) perpendicular, substantially perpendicular, oblique, or otherwise not parallel to the plane of rotation, and/or (3) parallel, substantially parallel, or coincident to a longitudinal axis of the shaft 127 of the dumbbell 102. In some embodiments, the movement of the selection member 266 between the engaged or selected position and the disengaged or unselected position, and vice versa, may be considered, or referred to, as an "axial movement" (or as "axial motion," "axially movable," "axially move," or "axially moved") with this being understood as linear movement or motion of the selection member 266 that occurs along a line that is parallel, or substantially parallel, to a longitudinal axis of the shaft 127.

As the selection member 266 is driven toward the end caps 124 by rotation of the selector 262, the selector 262 also moves towards the end caps 124 in a direction similar to the direction of the selection member 266. During this motion of the selector 262, the posts 280 may initially ride along the dwell surfaces 328 and subsequently may ride along the steepened slope portion of the ramp 322 at a faster rate of speed relative to the dwell surfaces 328. As such, the selector 262 may initially move at a first, slower rate of speed, followed by a second, faster rate of speed. The selector 262 may move proximally and rotationally relative to the base 264 and the add-on weight 240 during movement of the selector 262 from the disengaged or unselected position of FIGS. 37 and 38 to the engaged or selected position of FIGS. 39 and 40. At a proximal end of the ramps 322, the posts 280 may be seated in the second parking position 326 of the base 264 under the bias of the biasing member 270, in which position the hooks 302 may be received within the apertures 332 of the side wall 318 to secure the selector 262 in the engaged or selected position.

The slower rate of speed provided by the dwell surfaces 328 may result in lower impact forces between the hooks 302 of the selector 262 and the side wall 318 of the base 264 during movement of the selector 262 from the disengaged or unselected position of FIGS. 37 and 38 to the engaged or selected position of FIGS. 39 and 40. As previously discussed, the hooks 302 may be biased radially outwardly by the bias members 294 (see FIGS. 33 and 40). The hooks 302 may be nominally positioned relative to the side walls 318 such that at least a portion of the barbs 304 are positioned in interfering relationship with the side walls 318 to ensure the hooks 302 engage the apertures 332 of the side walls 318 when the selector 262 is in the engaged or selected position. As such, during movement of the selection assembly 262 from the disengaged or unselected position to the engaged or selected position, the hooks 302 may contact the side walls 318, which may drive the hooks 302 and thus the movable members 290 radially inwardly, thereby compressing the bias members 294 and permitting the hooks 302 to slidably pass along an inner surface of the side walls 318. The hooks 302 may initially contact the distal end face 334 of the side wall 318 when the posts 280 are moving along the dwell surfaces 328, thereby resulting in lower impact forces due to the slower speed. To further reduce the impact forces, the obliquely-angled proximal surfaces 308 of the hooks 302 may contact the rounded edge 336 of the distal end face 334 of the side wall 318 of the base 264, thereby facilitating inwardly movement of the hooks 302 relative to the side wall 318 with lower impact forces.

Should the user desire a dumbbell weight without the add-on weight 240, the user may place the dumbbell 102 back in the base 104, move the selector 262 into the disengaged or unselected position, and remove the dumbbell 102 from the base 104 with the desired weight, without the add-on weight 240. To move the selector 262 into the disengaged or unselected position, the user may actuate the movable members 290 by pushing radially inwardly on the movable members 290, thereby moving the hooks 302 radially inwardly and disengaging the hooks 302 from the side wall 318 of the base 264. Once the hooks 302 are disengaged from the side wall 318, the user may move the selector 262 distally away from the add-on weight 240 by rotating or twisting the selector 262 via the knob 272 relative to the base 264 about the axis of rotation in a second rotation direction that is opposite the first direction to seat the posts 280 of the knob 272 in the first parking position 324 of the base 264. As the selector member 266 moves away from the end plates 124, the selection member 266 linearly moves away from the end caps 124 along a line of motion that is (1) parallel, substantially parallel, or coincident to the axis of rotation, (2) perpendicular, substantially perpendicular, oblique, or otherwise not parallel to the plane of rotation, and/or (3) parallel, substantially parallel, or coincident to a central longitudinal axis of the shaft 127 of the dumbbell 102.

The arrangement of the selection assembly 254 may be altered so that the biasing member 270 biases the selection member 266 into a disengaged or unselected position (see FIGS. 37 and 38) and the user pushes the selector 262 against the force of the biasing member 270 to move the selection member 266 into the engaged or selected position (see FIGS. 39 and 40). In this alternative implementation, the biasing member 270 may be positioned axially between the cover plate 310 of the selector 262 and the base wall 317 of the base 264. Further, the selection assembly 254 may be modified so that the selector 262 may be rotated continuously in the same rotational direction to move the selector member 266 between the engaged or selected position and the disengaged or unselected position, or vice versa.

Figure 41:
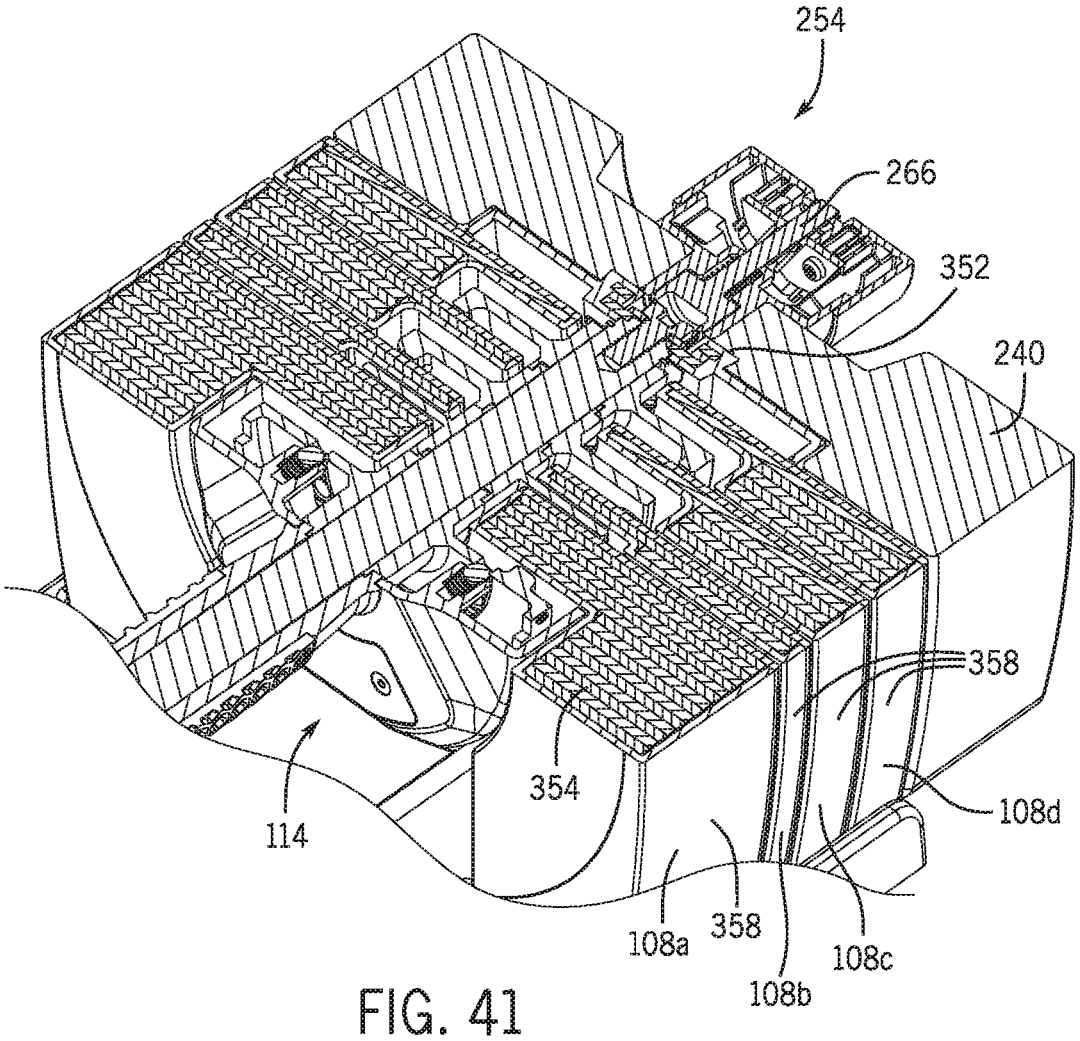
FIG. 41 is an enlarged, isometric, longitudinal cross-sectional view of one end of the adjustable dumbbell system of FIG. 1.
Figure 42:
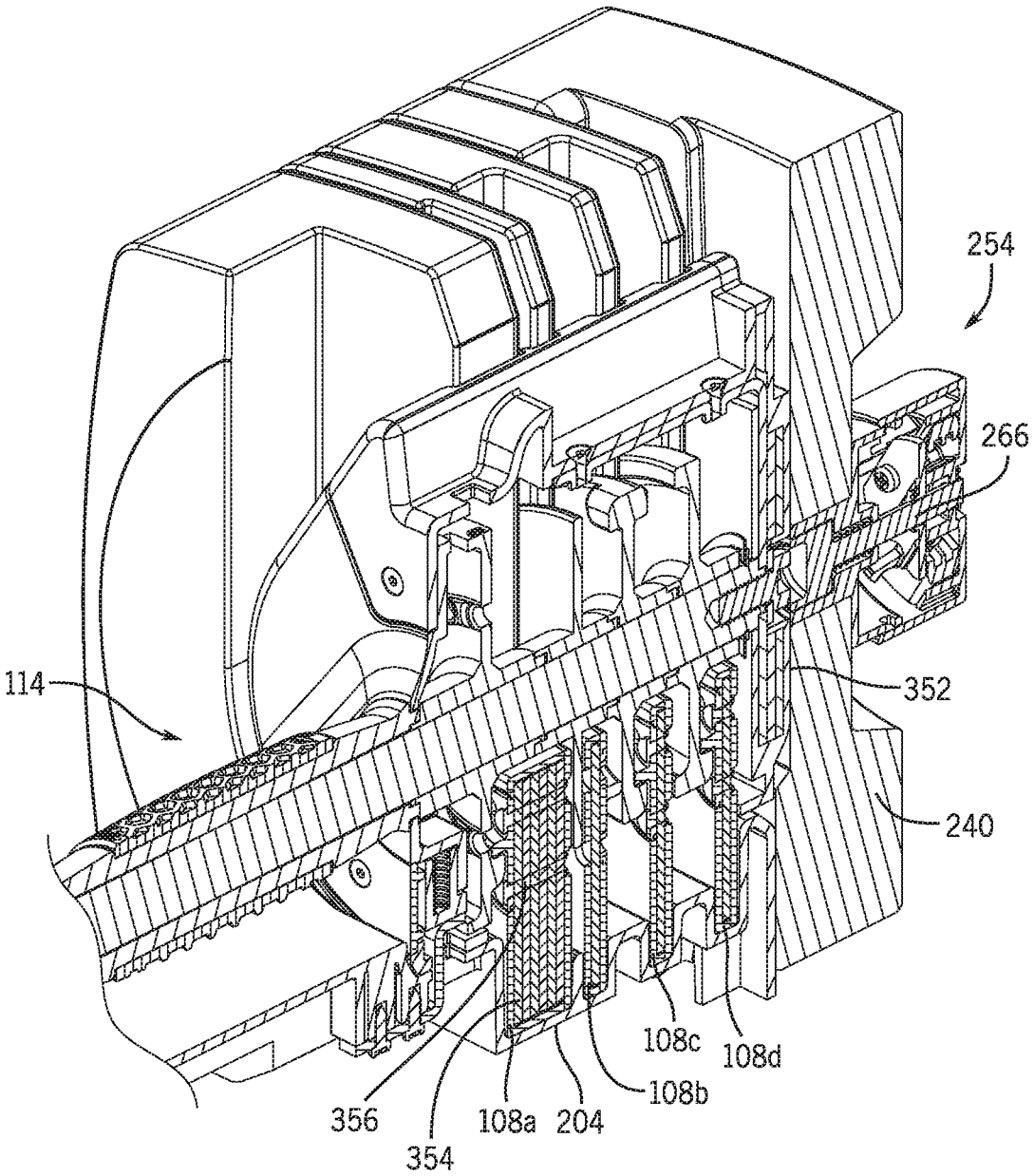
FIG. 42 is another enlarged, isometric, longitudinal cross-sectional view of the end of the adjustable dumbbell system shown FIG. 41.

FIGS. 41 and 42 are longitudinal cross-sectional views of one end of the adjustable dumbbell system 100 showing the weights 108, among other components, in cross-section. The weights 108 may be constructed of one or more weight plates 354 attached together (e.g., clipped, glued, riveted with rivets 356, welded, or other suitable attachment elements/methods). In implementations where the weights 108 are constructed of multiple weights plates 354 attached together, the weight plates 354 may be coated with an over-mold material 358 (see FIG. 41). Example over-mold materials may be nylon, Polypropylene, Kraton, or other suitable materials. In FIGS. 41 and 42, the selection assembly 254 is disposed in a disengaged or unselected position in which the selection member 266 is positioned entirely distally of the separation plane 352 to permit vertical movement of the handle assembly 114 relative to the add-on weight 240.

On-Board Computing Device

Figure 43:
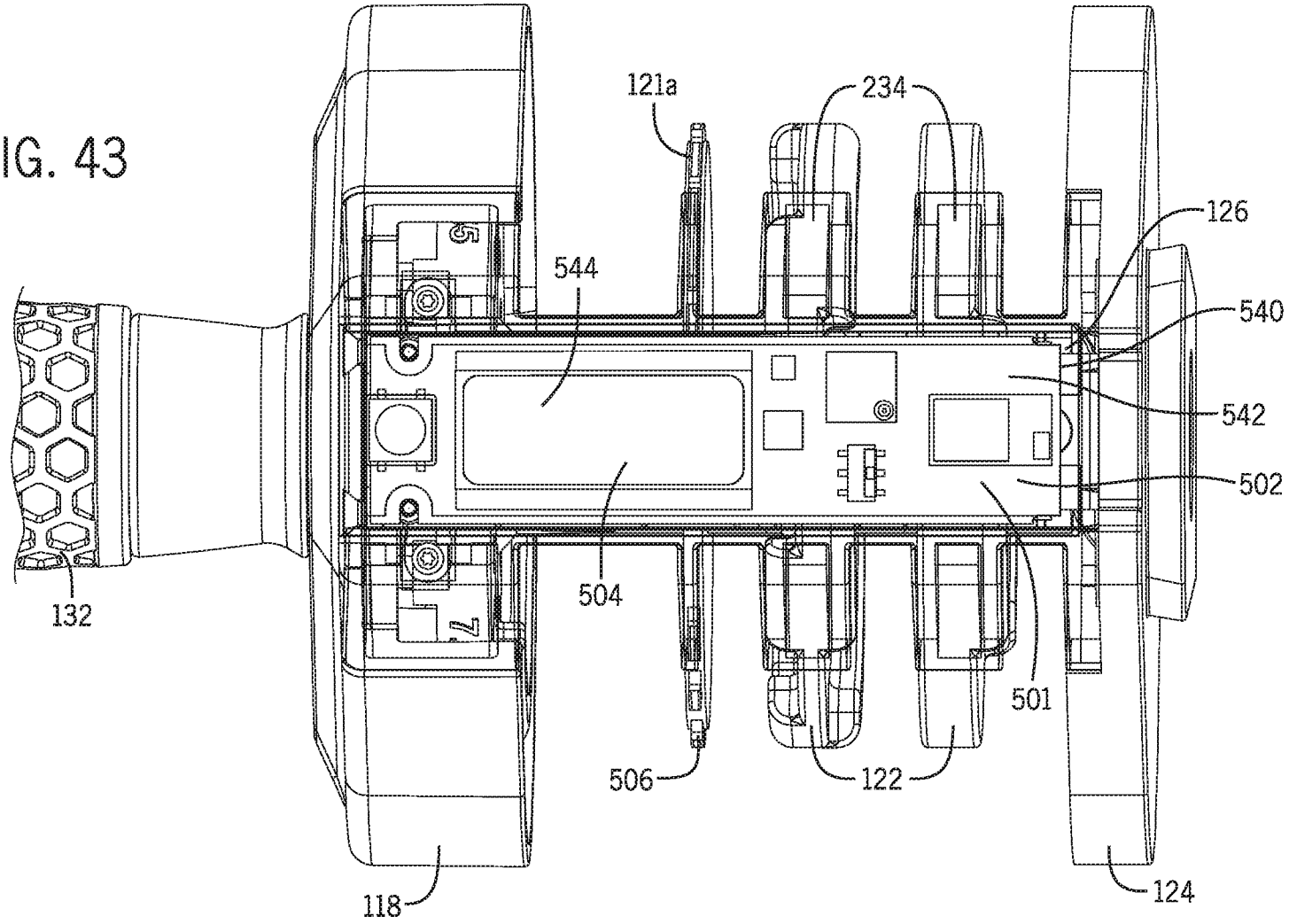
FIG. 43 is a top plan view of an adjustable dumbbell having an on-board computing device.

Referring to FIG. 43, an adjustable dumbbell 102 may include an on-board computing device 502. The on-boarding computing device 502 may be generally configured to record information and to provide output to a user of the dumbbell system 100. In one respect, the computing device 502 outputs visual information to the user through a display device 504. In some cases, the display device 504 may be a touch screen that additionally provides a mechanism for the user to input information. With reference to FIG. 43, the computing device 502 may be positioned such that the display device 504 faces upward when the adjustable dumbbell 102 sits in the support base 104. Thus, when the adjustable dumbbell 102 sits in the support base 104, the display device 502 will be in the direct line of sight of a user looking down on the adjustable dumbbell 102 from above.

Referring to FIGS. 43, 44, 48, 51 and 55, the computing device 502 may be mounted in a bridge 126. While it is possible to mount a computing device 502 in each of the bridges 126 of the dumbbell, or elsewhere on the handle assembly, the dumbbell 102 will typically have one computing device 502 mounted on one bridge 126. The computing device 502 may be positioned within a cavity of the bridge 126 so to protect the computing device 502 from damage. The top surface 540 of the bridge 126, or a portion thereof, may be transparent so that the display device 504 is visible. Alternatively, the display device 504 may form at least a portion of the top side of the bridge 126, or may extend above the top surface of the bridge 126. In the top plan view of FIG. 43, the entire upward facing surface of the computing device 502 is visible through the top surface of the bridge 126. The bridge 126, however, may not necessarily provide this same visibility. In some cases, the top surface 540 may have a transparent region 544 adjacent to the display device 504 and an opaque region 542 adjacent to the remainder of the computing device 502. In this way, the display device 504 is visible, while other components of the computing device 502 are hidden from view.

In some cases, the dumbbell 102 features a display device 504 that is removable from the remainder of the computing device 502. The computing device 502 may include a circuit board 501 having a dock in which the display device 504 sits when the display device 504 is physically connected to the remainder of the computing device 502. The dock may include a locking mechanism that holds the removable display device 504 in place while the dumbbell is in use. The depth of the dock may correspond to a thickness of the display device 502 so that the upward facing surface of the display device 504 is flush with the top surface 540 of the bridge 126 when the display device 502 is seated in the dock. In this way, the upward facing surface of the display device 504 forms a portion of the top surface 540 of the bridge 126. The computing device 502 and the display device 504 may communicate over a wireless connection so that the computing device 502 may continue to provide output through the display device 504 when the display device 504 is removed from the dock. When the display device 504 is in the dock, the computing device 502 and the display device 502 may communicate over a wireless connection and/or a wired connection that may be provided through the dock.

Figure 44:
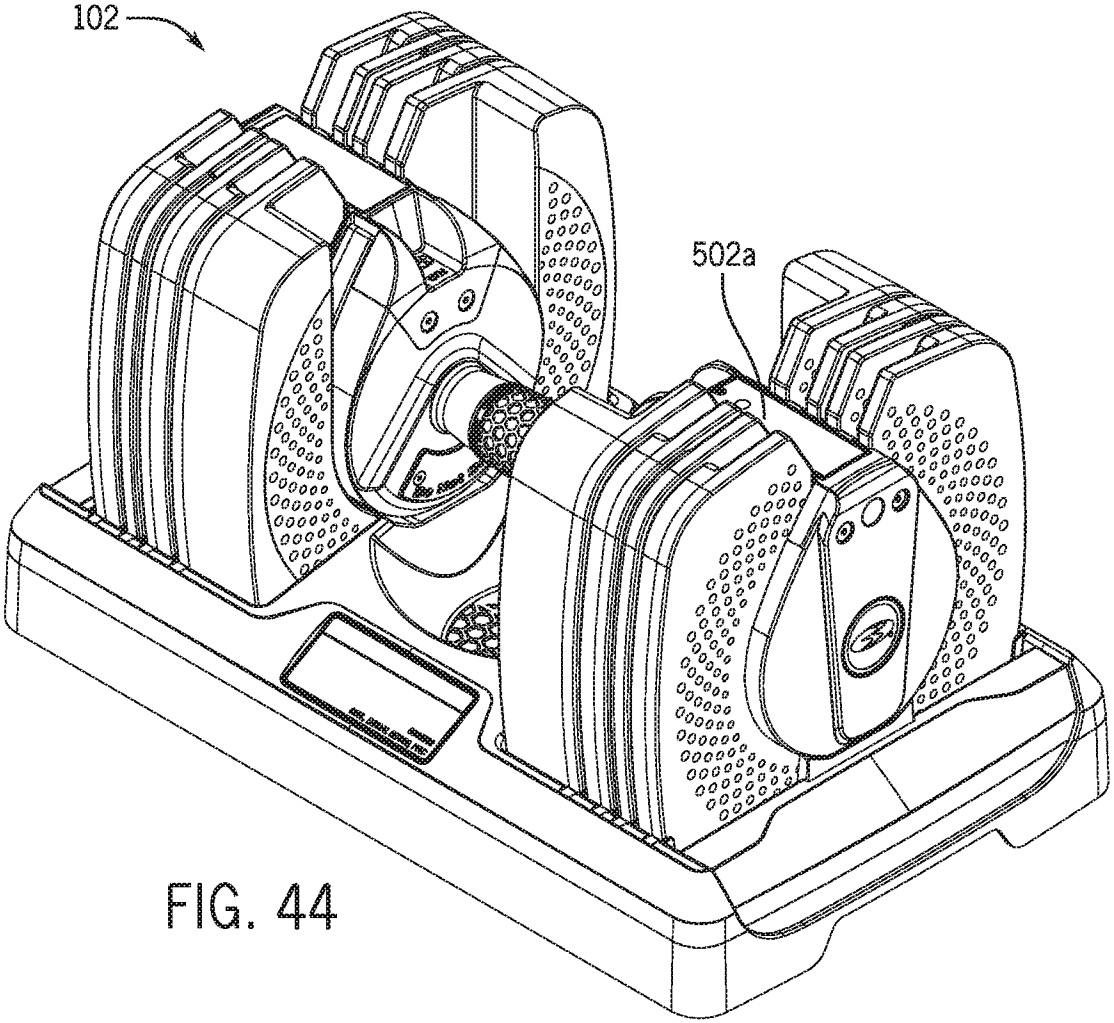
FIG. 44 is an alternative configuration of an adjustable dumbbell having an on-board computing device.
Figure 45:
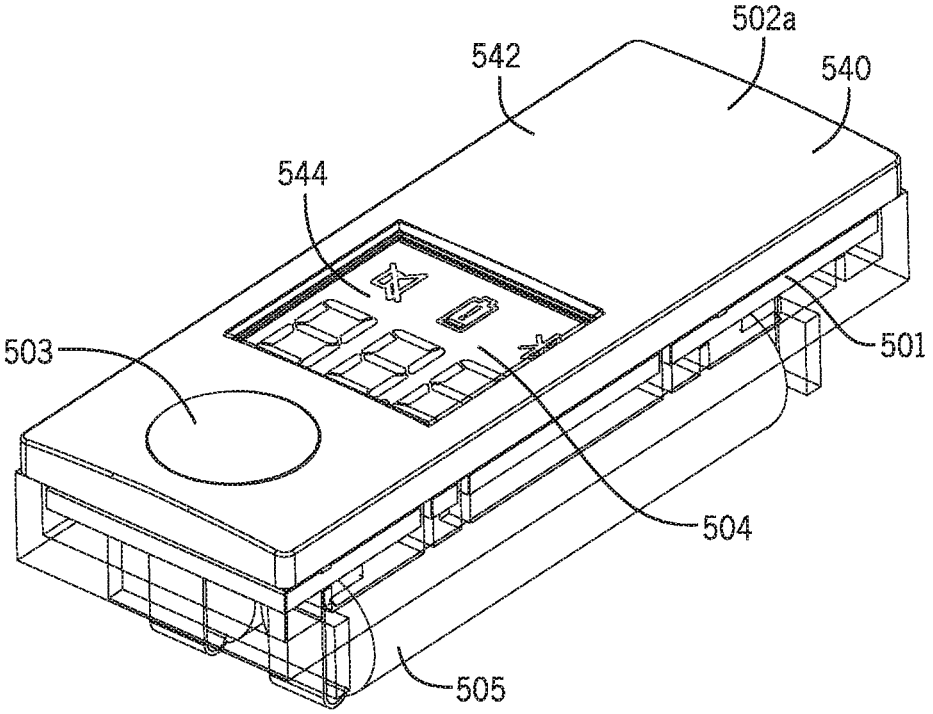
FIG. 45 is an isometric view of the on-board computing device associated with the adjustable dumbbell of FIG. 44.

FIG. 44 and FIG. 45 show alternative examples for the on-board computing device 502*a*. The on-board computing device 502*a* may be part of an alternative configuration for the adjustable dumbbell 102. The on-board computing device 502*a* may include a display device 504 that is visible through a transparent region 544 region of a top surface 540 of the on-board computing device 502*a*. The top surface 540 may also include an opaque region 542 region that obscures the underlying circuit board 501. A button 503 may be positioned within an aperture formed in on-board computing device 502*a*. The button 503 may be positioned proximate to the display device 504 and may include an engagement surface that is approximately flush with the top surface 540. The button 503 may be used to implement various functions. In accordance with various examples, the button 503 may be a power button, a reset button, a help button, and so on. The on-board computing device 502*a* may also include a battery pack 505 or other power source that is disposed on the underside of the circuit board 501.

FIG. 46 is a block diagram of various components that may be included in the computing device 502. The computing device 502 may include one or more of the following: a processor 508, a memory 510, an input/output interface 507, a sensor port 512, a wireless interface 514, and an accelerometer 516. The processor 508 may be configured to support the various operations of the computing device 502. The processor may communicate with the memory 510 that operates to store data and/or computer readable code that is executable by the processor 508. The input/output interface 507 is generally configured to send and receive data to and from the user. Generally, the input/output interface 507 may be configured to send data to various output devices that generate output perceptible to a user. Various output devices that may be associated with the computing device 502 may generate output that is visible, audible, tactile, olfactory, and so on. Additionally, the input/output interface 507 may be configured to receive data from various input devices that sense user input. Various input devices that may be associated with the computing device 502 may receive sensor data that is visible, audible, tactile, olfactory, and so on. By way of example, the input/output interface 507 may send data to the display device 504 shown in FIG. 44. If the display device 504 includes touch screen capabilities, the input/output interface 507 may also receive data generated by these inputs. By way of further example, the input/output interface 507 may send audio output to audio devices that may be associated with the computing device 502, such as a speaker, a beeper, a buzzer, a tone generator, or the like. Similarly, the input/output interface 507 may receive audio input through a microphone or the like.

The computing device 502 may also feature a wireless interface 514, such as a Bluetooth transceiver. As alluded to above, if the dumbbell features a removable display device 502, the computing device 502 may communicate with the display device 502 through the wireless interface 514 so that the computing device 502 may continue to provide output through the display device 504 when the display device 504 is removed from the dock. The computing device 504 may also use the wireless interface to communicate with other electronic devices. For example, the computing device may communicate data to and from a smart phone, electronic tablet, laptop or desktop computer, and so on.

The computing device 502 may also feature an accelerometer 516, which is generally configured to be responsive to changes in velocity of the accelerometer 516 itself or objects to which the accelerometer is fixedly attached. The accelerometer 516 is fixedly attached to the circuit board 501 of the computing device 502, and thus fixedly attached to the dumbbell 102 itself. Accordingly, the accelerometer 516 is responsive to changes in the velocity of the dumbbell. The computing device 502 may track and record use of the dumbbell 102 through acceleration signals generated by the accelerometer 516. Specifically, when a user lifts the dumbbell 102 and moves the dumbbell through an exercise movement, the dumbbell 102 will experience a number of accelerations. For example, the dumbbell 102 may experience accelerations due to the initial movement of the dumbbell 102 off of the base 104, changes in speed and/or direction of the dumbbell 102 during the exercise movement, and the dumbbell coming to rest as it is again placed on the base 104. The computing device 502 may receive and record signals from the accelerometer 516 responsive these accelerations as part of an operation of tracking use of the dumbbell 102.

The computing device 502 may also feature a weight sensor port 512, which is configured to receive sensor signals that indicate amount of weight selected by the user. When the user turns the handle 106 to select a desired combination of weights 108, this action may actuate one or more sensors that are configured to sense the user's selection. More specifically, the sensors may be configured to be responsive to the angular displacement of the handle assembly 114. By receiving these sensor signals, the computing device 502 may determine the amount of weight on the adjustable dumbbell 102. In this way, the computing device 502 may track the amount of weight that the user is lifting during his or her workout. The computing device 502 may track the weight used as part of programmed training routine executed by the computing device. Specifically, the user may download a training program into the computing device 502, which then outputs various prompts or information that guide the user through the workout. As part of the training program, the computing device 502 may track the weight used during the routine so as to track compliance with program specifications or to record the used to track progress over time.

With reference to FIGS. 46 and 47, the computing device 502 may communicate with a user's mobile device 518. In some examples, the computing device 502 may transmit data related to use of dumbbell to the user's mobile device 518. The computing device 502 may transmit data such as recorded workout information, weight amounts used, compliance with certain training programs and the like. The user also may transmit data to the computing device 502 through his or her mobile device 518. For example, the user may download a certain work program to the computing device 502 through a wireless communication sent from the mobile device 518.

Weight Sensors

An adjustable dumbbell 102 may include one or more sensors that are configured to detect handle assembly 114 or add-on weight attributes that indicate whether or not selection members associated with the handle assembly 114 or the add-on weight are engaged or not engaged. For example, an adjustable dumbbell 102 may include one or more sensors that are configured to detect certain handle assembly 114 attributes that indicate the rotational position of the handle 106 or the rotational position of an indicator member, such as a disc, that may or may not rotate with the handle. An adjustable dumbbell 102 may also include a linearly moving selector provided in association with a sensor that detects attributes that indicate the linear position of the selection member. One example of such a linearly moving selector is a sensor that detects the linear position of a selection member associated with the add-on weight.

The one or more sensors may be further configured to communicate or transmit this positional information to the computing device 502. Because certain combinations of weights 108 are retained on the handle assembly 114 when the handle 106 is rotated into particular rotational positions, the computing device 502 may use the rotational position information detected by the one or more sensors to calculate or otherwise determine the amount of weight retained on the handle assembly 114. In this way, the one or more sensors and the computing device 502 may together form a sensing mechanism that is adapted to detect the amount of weight that a user has configured the handle assembly 114 to retain.

An adjustable dumbbell 102 may incorporate various types of handle assembly 114 attributes that indicate the rotational position of the handle 106 of the handle assembly 114. In some implementations, an indicator member, such as a disc (also referred to as an indicator disc) of the handle assembly 114 that rotates with handle 106 may include a rotational position encoding feature that encodes each of a plurality of disc sectors with a unique binary number. Here, each disc sector may correspond to a particular rotational position of the handle 106 and thus to a specific weight 108 combination retained on the handle assembly 116. The rotational position encoding feature may encode each disc sector with a unique binary number by encoding each of a plurality of sector subdivisions with either a first binary digit or a second binary digit. To sense each of the sector subdivision encoding, the handle assembly 114 may include a plurality of sensors, one for each sector subdivision. Various adjustable dumbbell 102 implementations are discussed below beginning with those that include a rotational position encoding feature that encodes each of a plurality of disc sectors with a unique binary number. While the examples below are described with reference to a single indicator member (a "disc" in the examples below), more than one indicator member may be implemented for use with the described weight sensor examples. Further, the indicator member may have a circular shape, or may have a geometric or non-geometric shape.

Sensing Weight Amounts with Optical Interrupt Sensors

Figure 48:
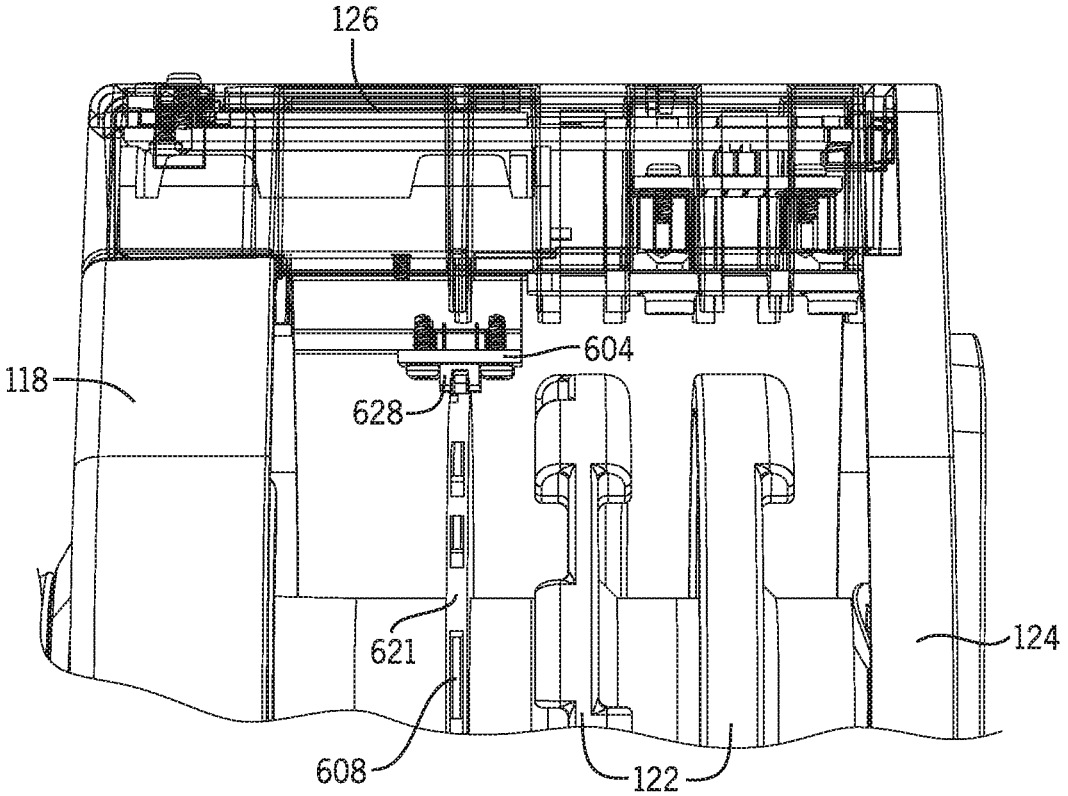
FIG. 48 is a side elevation view of an example of the adjustable dumbbell shown in FIG. 43.
Figure 49:
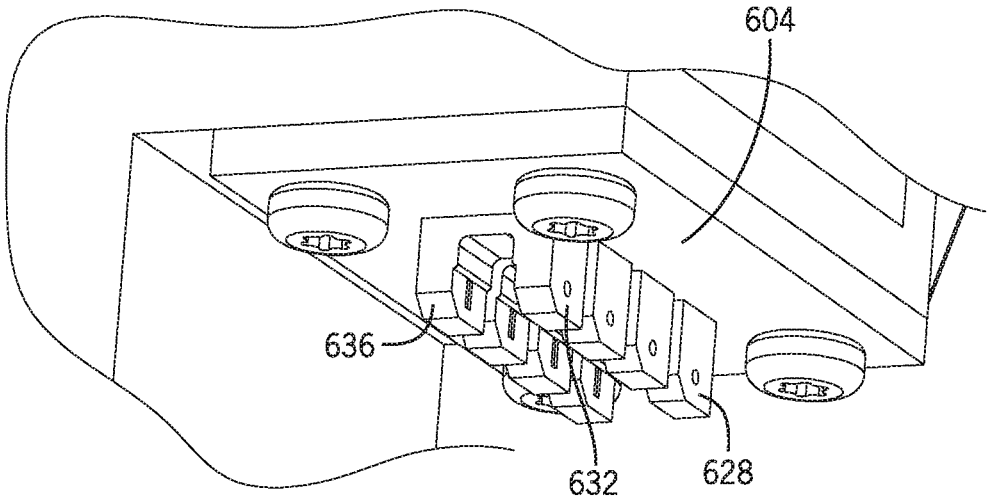
FIG. 49 is an enlarged view of the sensor board shown in FIG. 48.

FIG. 48 is a side elevation view of the adjustable dumbbell 102 shown in FIG. 43. As shown in FIG. 48 and FIG. 49, an adjustable dumbbell 102 may include a sensor board 604. The sensor board 604 may be configured to provide positional information to the computing device 502, which positional information the computer device 502, in turn, uses to determine the amount of weight retained on the handle assembly 114 of the adjustable dumbbell 102. The sensor board 604 may sense the rotational position of, for example, a separator disc 621 that is modified to include a rotational position encoding feature. A modified separator disc 621 is discussed herein by way example and not limitation. In accordance with other embodiments, other discs, such as one or more of the selector discs 122, may be modified to include a rotational position encoding feature.

Once the sensor board 604 senses the rotational position of the modified separator disc 621, the sensor board 604 may then output this positional information to the computing device 502. Because the separator disc 621 is rotationally interlocked with the indexing disc 120 and the selector discs 122, the rotational position of the separator disc 621 corresponds to a specific amount of weight retained on the handle assembly 114. The computing device 502 may be programmed with a look-up table or other data structure that correlates the rotational position of the separator disc 621 with specific weight amounts. The computing device 502 may determine the amount of weight being retained on the handle assembly 114 by referencing the rotational position information received from the circuit board 604 against this look-up table. Alternatively, the computing device 502 may calculate the amount of weight retained on the handle assembly 114 by using equations that specify mathematical relationships between sensor data values and specific weight amounts.

Thus, generally, the separator disc 621 or other disc may be modified with a rotational position encoding that allows the disc to work with some type of binary sensor or sensors. The binary sensor or sensors register either an "on or "off" state and these states can be interpreted as binary "0" or "1". The number of binary sensors used in a particular implementation is typically chosen to allow for enough unique binary codes for the number of weight combinations that can be retained on the dumbbell. The unique combination of codes provides information about the rotational orientation of the handle 106 relative to a predetermined initial position, thus allowing for the number of weights retained on the handle to be inferred via a look-up table, an equation, or so on.

Figure 50:
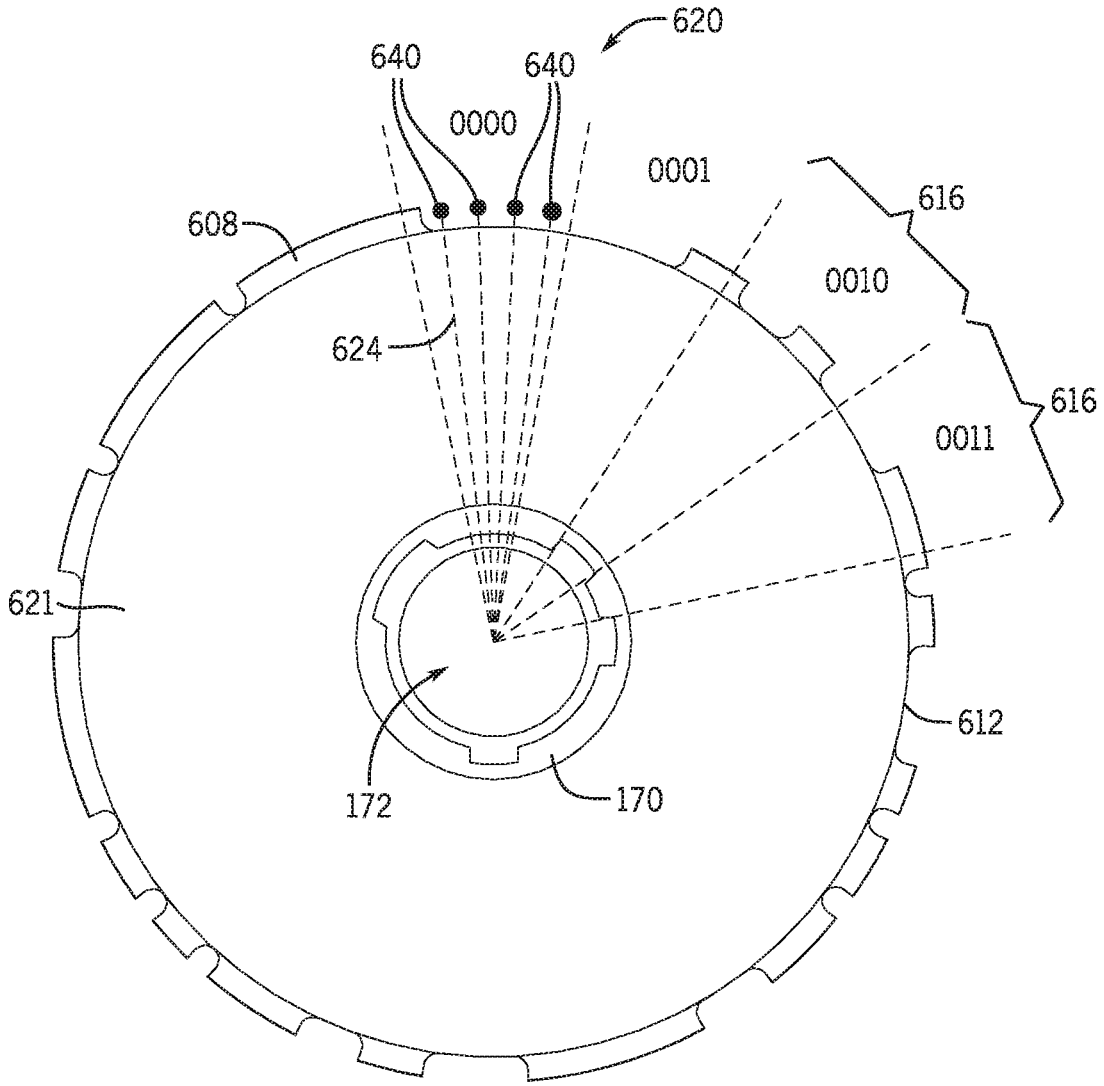
FIG. 50 is a side elevation view of the modified separator disc shown in FIG. 48.

FIG. 50 is a side elevation view elevation view of a separator disc 621 that has been modified to include a particular rotational position encoding. The separator disc 621 is modified from that of the separator disc 121 shown in FIG. 11 by the inclusion of two or more tabs 608 that encode the rotational position of the separator disc 621. The tabs 608 are arranged around the perimeter 612 of the separator disc 621 and extend axially outward from the perimeter 612. The tabs 608 have approximately the same or a smaller width as the remainder of the separator disc 621. The separator disc 621 can be considered as having sixteen equally sized sectors 616. The tabs 608 encode the rotational position of the separator disc 621 by having a unique pattern for each of the sixteen disc sectors 616. The sensor board 604 is arranged to sense which pattern of tabs 608 is present at the 12 o'clock position 620 shown in FIG. 50. Because each of the disc sectors 616 has a unique pattern of tabs 608, the sensor board 604 detects which of the sixteen sectors 616 is present at the 12 o'clock 620 position by sensing which pattern of tabs 608 is present at the 12 o'clock position 620. Thus, the tabs 608 encode sixteen discrete rotational positions that can be sensed by the sensor board 604.

Unique tab 608 patterns are formed for each sector 616, by dividing each sector 616 into four equally sized sector subdivisions here referred to as subsectors 624. Each subsector 624 either includes or does not include a tab 608 or tab 608 portion. In this way, the subsectors 624 are organized as a binary symbol system where the presence of a tab 608 corresponds to one symbol and the absence of a tab 608 corresponds to the other symbol. Viewed as binary numbers, the presence of a tab 608 may correspond to a "1" and the absence of a tab 608 may correspond to a "0." With four subsectors 624, there are $2^4$ or sixteen possible binary numbers. Because there is a total of sixteen sectors 616, an encoding may be defined where each sector 616 is assigned a unique binary number. In the example separator disc 621 shown in FIG. 50, the sector 616 in the 12 o'clock 620 position is assigned binary 0000. Moving clockwise, the sectors 616 are assigned binary 0001, 0010, 0110, 0011, and so on. The encoding of FIG. 50 is shown by way of example and not limitation. Alternative encodings may be used depending on the implementation.

In some implementations, the separator disc 612 or other disc could be divided into more or less than sixteen sectors. For example, the separator disc 612 or other disc could be divided into eight sectors with 3 subsectors. Alternatively, the separator disc 612 or other disc could be divided into ten sectors with 4 subsectors with some of the binary codes not utilized (e.g., six of the 16 possible codes remaining unused). The number of sectors may generally correspond to the number of weight combinations that can be attached to the dumbbell. Thus, the number of sector subdivisions or subsectors may correspond to the minimum number of binary codes required for the number of sectors/weight combinations (e.g., 2 sub-sectors for 3 to 4 sectors, 3 sub-sectors for 5 to 8 sectors, 4 sub-sectors for 9 to 16 sectors, and so on). Additionally, the subdivisions could be created along a radial line by aligning the sensors vertically. Here, the separator disc 612 or other disc may be provided with sufficiently large holes, for example, formed along radial lines of the discs in binary patterns to determine the angular position of handle 106 or other rotatable member.

FIG. 49 is an enlarged view of an example sensor board 604 that may be used in combination with the modified separator disc 621 of FIG. 50. The sensor board 604 may include a plurality of optical interrupt type sensors 628 that each has a transmitter 632 and an opposing receiver 636. The sensors 628 are arranged to sense the pattern of tabs 608 that are present in the 12 o'clock position 620 shown in FIG. 50. The number of sensors 628 disposed on the sensor board 604 corresponds to the number of subsectors 624 in an individual disc sector 616. Thus, for the example separator disc 621, the sensor board 604 includes four sensors 628. Each sensor 628 is associated with a particular subsector 624 and, in connection with that particular subsector 624, the sensor 628 is arranged to detect the presence or absence of a tab 608.

The sensor 628 detects the presence or absence of a tab 608 by emitting a light beam from the transmitter 632 towards the opposing receiver 636. The light beam may include visible light or non-visible light, such as infrared radiation. By way of example, four light beams 640 corresponding to the four sensors 628 are shown in cross section in FIG. 50. Greater or lesser numbers of sensors may be used depending upon the number of possible weight combinations in a particular implementation. If the path of the light beam 640 is obstructed by a tab 608, the corresponding sensor 628 registers the presence of the tab 608 because the light beam 640 does not reach the receiver 636. If the path of the light beam 640 is not obstructed by the tab 608, the corresponding sensor 628 registers the absence of a tab 608 because the light beam reaches the receiver 636. In the implementation shown in FIG. 50, the sensor 628 registers the absence of a tab 608 when the light beam passes between the gaps in the pattern of tabs. In order to prevent sensor pair light beam pollution, other implementations may encode rotational position information using holes rather than tabs 608. Here, the sensor 628 may register an absence when the light beam passes through a hole.

The sixteen sectors 616 are arranged such that each sector 616 corresponds to one of the sixteen possible weight 108 combinations that can be retained on the handle assembly 114. Specifically, the sectors 616 are arranged such that when the detents 140 engage respective indicator features 156 to indicate that a desired combination of weights 108 is adequately engaged with the handle assembly 114, a single disc sector 616 is in the 12 o'clock position 620 shown in FIG. 50. Thus, the particular pattern of weights 108 retained on the handle assembly 114 can be determined by detecting which of the sixteen disc sectors 616 is in the 12 o'clock position 620. As mentioned, the particular disc sector 616 that is in the 12 o'clock position 620 can be determined by the positional information that is encoded by the tabs 608. Here, the sensor board 604 senses the presence or absence of a tab 608 for each subsector 624 and transmits this encoded positional information to the computing device 502. The computing device 502, in turn, determines the amount of weight retained on the handle assembly by comparing the encoded information against a stored look-up table or other data structure. The following is an example look-up table that is based on the adjustable dumbbell 102 shown in FIG. 43 encoding of FIG. 50:

TABLE (1)

| Binary Code | Weight (lbs) |
|---|---|
| 0000 | 10 |
| 0001 | 15 |
| 0010 | 20 |
| 0011 | 25 |
| 0100 | 30 |
| 0101 | 35 |
| 0110 | 40 |
| 0111 | 45 |
| 1000 | 50 |
| 1001 | 55 |
| 1010 | 60 |
| 1011 | 65 |
| 1100 | 70 |
| 1101 | 75 |
| 1110 | 80 |
| 1111 | 85 |

As an alternative to a look-up table, the amount of weight retained on the handle assembly 114 may be calculated using one or more equations in some implementations. For example, using known weight amount for individual weights (i.e. weight #1 weighs 5 lbs, weight #2 weighs 10 lbs, and so on), an equation may be used that takes the binary number sensed by an individual sensor (1 or zero) and multiplies this binary number by the weight associated with the individual sensor. This multiplication may be repeated for each sensed value and weight amount pair and then the total added together along with the fixed weight of the handle assembly 114 to arrive at the total weight.

Sensing Weight Amounts with Mechanical Sensors

FIG. 51 is a side elevation view of an additional adjustable dumbbell 102 implementation. As mentioned, the adjustable dumbbell 102 may include a sensor board 704 configured to provide positional information to a computing device 502 that determines the amount of weight retained on the handle assembly 114. Specifically, the sensor board 704 senses the rotational position of, for example, a separator disc 721 that has been modified to include a rotational position encoding. The separator disc 721 is rotationally interlocked with the indexing disc 120 and the selector discs 122. Thus, the rotational position of the separator disc 721 corresponds to a specific amount of weight being retained on the handle assembly 114. Accordingly, the computing device 502 may determine the amount of weight being retained on the handle assembly 114 by referencing the rotational position information received from the circuit board 704 against this look-up table or by inputting this information into an appropriate equation.

Figure 53:
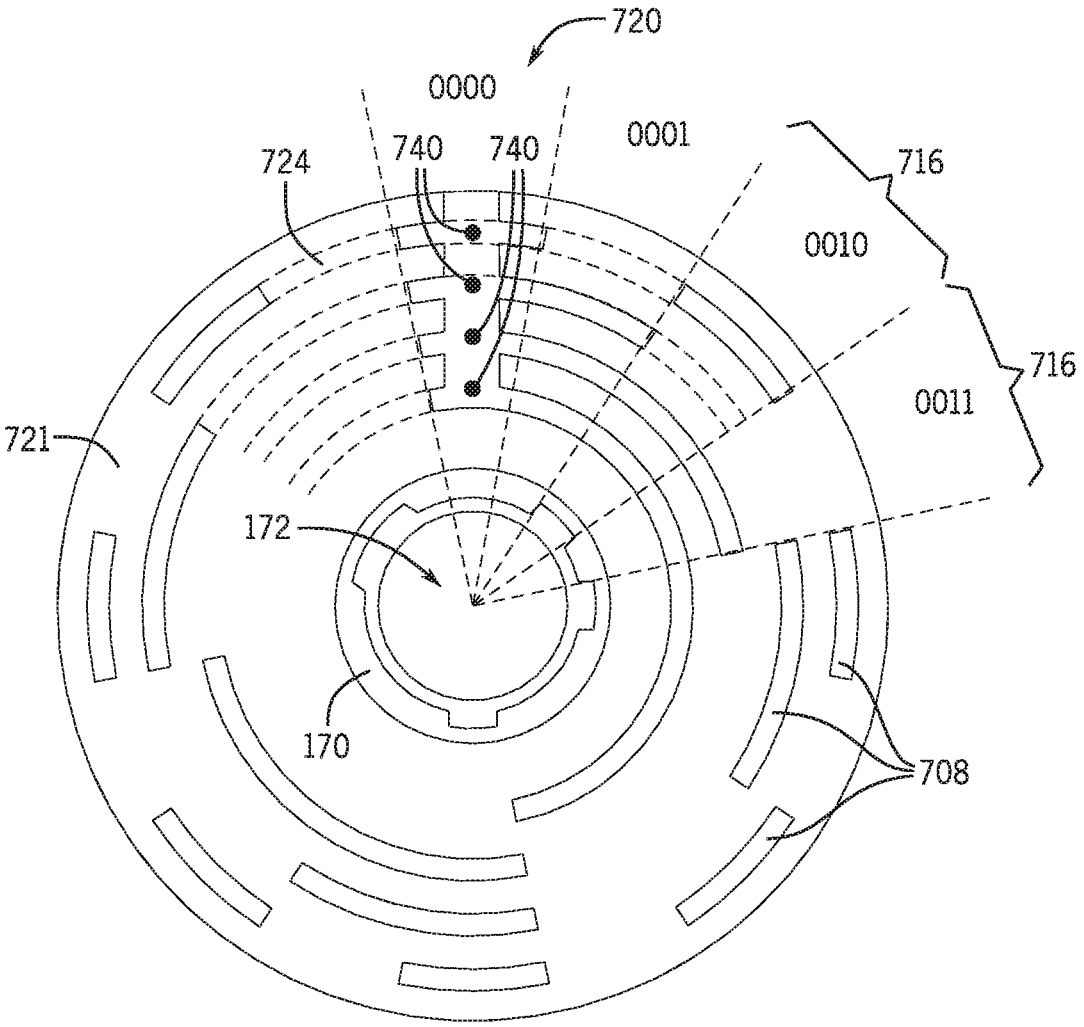
FIG. 53 is a side elevation view of the modified separator disc shown in FIG. 51.

FIG. 53 is a side elevation view elevation view of a separator disc 721 that has been modified to include a particular rotational position encoding. The separator disc 721 is modified from that of the separator disc 121 shown in FIG. 11 by the inclusion of a plurality of surface features, such as grooves 708, that encode the rotational position of the separator disc 708. Grooves 708 are described as surface features by way of example and not limitation. Alternative surface features include projections, tracks, mounds, bumps, dimples, and so on. The grooves 708 are arranged as recesses in the inner surface of the separator disc 721. The separator disc 721 can be considered as having sixteen equally sized sectors 716. The grooves 708 encode the rotational position of the separator disc 721 by having a unique pattern for each of the sixteen disc sectors 716. The sensor board 704 is arranged to sense which pattern of grooves 708 is present at the 12 o'clock position 720 shown in FIG. 53. Because each of the disc sectors 716 has a unique pattern of grooves 708, the sensor board 704 detects which of the sixteen sectors 716 is present at the 12 o'clock 720 position by sensing which pattern of grooves 708 is present at the 12 o'clock position 720. Thus, the grooves 708 encode sixteen discrete the modified positions that can be sensed by the sensor board 704.

Unique groove 708 patterns are formed for each sector 716 by arranging the grooves 708 along four sector subdivisions, here referred to as concentric tracks 724, on the inner surface of the separator disc 721. Along each track 724, a groove 708 is either present or not present. In this way, the tracks 724 are organized as a binary symbol system where the presence of a groove 708 corresponds to one symbol and the absence of a groove 708 corresponds to the other symbol. Viewed as binary numbers, the presence of a groove 708 may correspond to a "0" and the absence of a groove 708 may correspond to a "1." With four grooves 708, there are $2^4$ or sixteen possible binary numbers. Because there is a total of sixteen sectors 716, an encoding may be defined where each sector 716 is assigned a unique binary number. In the example separator disc 721 shown in FIG. 53, the sector 716 in the 12 o'clock 720 position is assigned binary 0000. Moving clockwise, the sectors 716 are assigned binary 0001, 0010, 0110, 0011, and so on. The encoding of FIG. 53 is shown by way of example and not limitation. Alternative encodings may be used depending on the implementation. As previously mentioned, other implementations may include an alternative number of sectors, sector subdivisions, and so on.

FIG. 52 is an enlarged view of an example sensor board 704 that may be used in combination with the modified separator disc 721 of FIG. 53. The sensor board 704 may include a plurality of mechanical switch type sensors 728 that each has a base 734 and a moveable tip 738. The sensors 728 are arranged to sense the pattern of grooves 708 that are present in the 12 o'clock position 720 shown in FIG. 53. The number of sensors 728 disposed on the sensor board 704 corresponds to the number of tracks 724 on the inner surface of the separator disc 721. Thus, for the example separator disc 721, the sensor board 704 includes four sensors 728. Each sensor 728 is associated with a particular track 724, and in connection with that particular track 724, the sensor 728 is arranged to detect the presence or absence of a groove 708.

The sensor 728 detects the presence or absence of a groove 708 by the action of the moveable tip 738 portion of the sensor 728. The sensor 728 may include a spring or other biasing mechanism that urges the tip 738 to an unactuated position, such as outward from the base 734. A mechanical force can be applied to the tip 738 such that the tip 738 moves to an actuated position, such as partially or completely withdrawn into the base 734. The sensor 727 may also include metallic or other conductive contacts that form an electrical switch that is open when the tip 738 is in the unactuated position and that is closed when the tip 738 is in the actuated position. The circuit board 704 may be arranged such that the moveable tips 738 of the four sensors 728 engage the tracks 724 on the inner surface of the separator disc 721 at the four contact points 740 shown in FIG. 53. The circuit board 704 is disposed at a distance from the separator disc 721 such that, if a track 724 contains a groove 708 at a contact point 740, the depth of the groove 708 allows the corresponding tip 738 to move into the unactuated position under the action of the biasing mechanism. Similarly, if a track 724 does not contain a groove 708 at a contact point 740, the inner surface of the separator disc 721 acts to maintain the moveable tip 738 in the actuated position against the action of the biasing mechanism.

The sixteen sectors 716 are arranged such that each sector 716 corresponds to one of the sixteen possible weight 108 combinations that can be retained on the handle assembly 114. Specifically, the sectors 716 are arranged such that when the detents 140 engage the indicator feature 156 to fully engage the weights 108 with the handle assembly 114, one and only one disc sector 716 is in the 12 o'clock position 620 shown in FIG. 53. When the weights 108 are fully engaged with the handle assembly 114, a specific pattern of weights 108 is retained on the handle assembly 114. Thus, the particular pattern of weights 108 that is retained on the handle assembly 114 can be determined by detecting which of the sixteen disc sectors 716 is in the 12 o'clock position 720. As mentioned, the particular disc sector 716 that is in the 12 o'clock position 720 can be determined by the positional information that is encoded by the grooves 708. Here, the sensor board 704 senses the presence or absence of a groove 708 for each track 624 and transmits this encoded positional information to the computing device 502. The computing device 502, in turn, determines the amount of weight retained on the handle assembly by comparing the encoded information against a stored look-up table or other data structure. The example look-up table given in Table (1) may be used in connection with encoding of FIG. 53. Alternatively, the computing device 502 may calculate the amount of weight being retained on the handle assembly 114 by using equations that specify mathematical relationships between sensor data values and specific weights amounts.

Figure 54A:
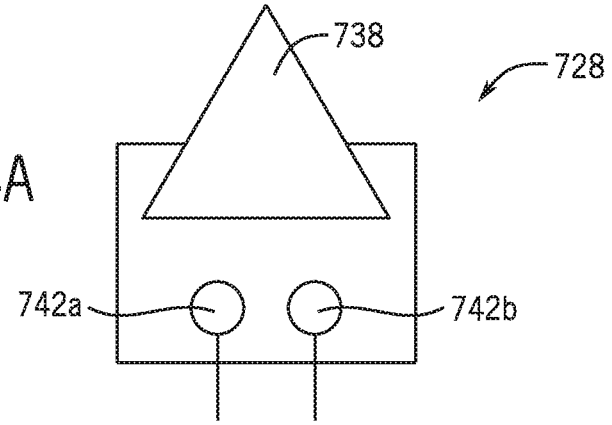
FIG. 54A through FIG. 54C are side elevation views of an alternative example for the mechanical sensors shown in FIG. 51 and FIG. 52.
Figure 54B:
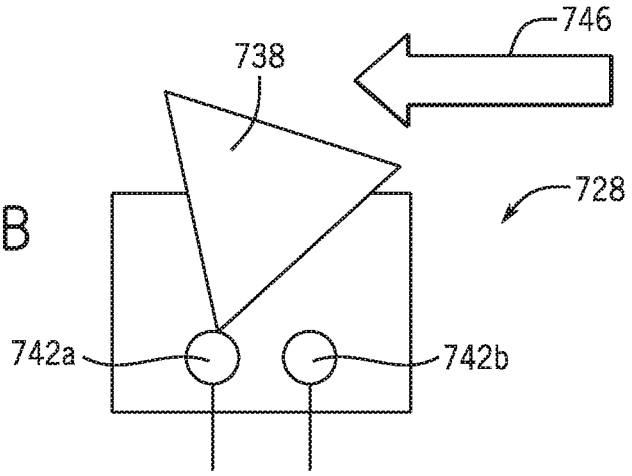
Figure 54C:
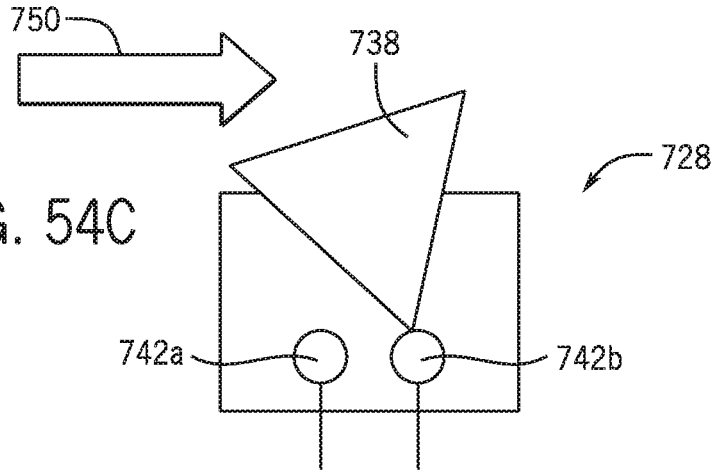

FIG. 54A through FIG. 54C are side elevation views of an alternative example for the mechanical sensors 728. As shown, the sensors 728 may include two electrical switches 742*a-b* that may be separately closed by a mechanical force being applied to the movable tip 738. The particular switch 742*a-b* that is closed by the movable tip 738 depends on the direction in which force is applied to the movable tip 738. FIG. 54A shows the orientation of the moveable tip 738 when no force is applied. Here, the tip 738 is maintained in the unactuated position by the action of the bias mechanism. Neither of the two electrical switches 742*a-b* is closed. FIG. 54B shows the orientation of the moveable tip 738 when a force 746 is applied from the right. Here, the tip 738 closes the left switch 742*a*, but leaves the right switch 742*b* unaffected. FIG. 54C shows the orientation of the moveable tip 738 when a force 750 is applied from the left. Here, the tip 738 closes the right switch 742*b*, but leaves the left switch 742*a* unaffected. Based on which of the two electrical switches 742*a-b* is closed, the sensor board 704 may be able to determine which direction a user is turning the handle assembly 114. The computing device 502 may use this information for various purposes, such as determining whether the user is increasing or decreasing the amount of weight that is retained on the handle assembly 114.

Grooves are discussed above in connection with a rotational position encoding by way of example not limitation. In other implementations, other mechanisms may be used to encode positional information. For example, in some implementations, projections may be used to encode positional information. In this implementation, mechanical sensors may be used that incorporate levers that are switched back-and-forth by projections disposed on a surface of a rotating disc or other handle component.

Sensing Weight Amounts with Reflective Optical Sensors

Figure 55:
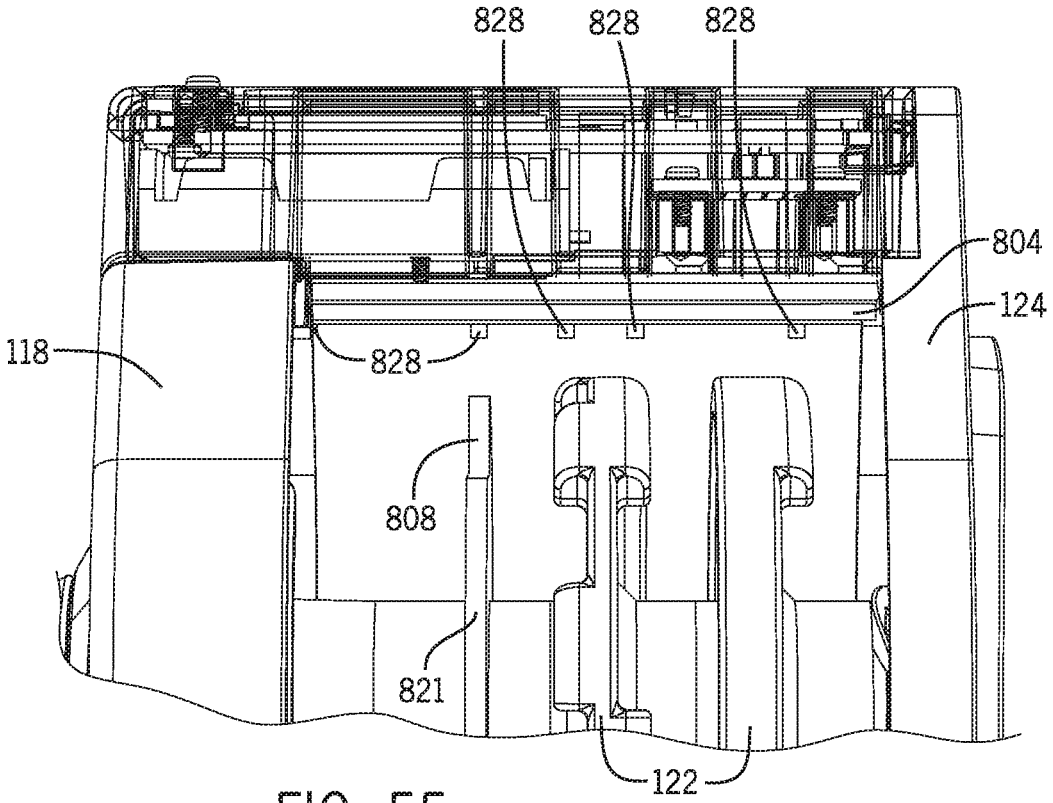
FIG. 55 is a side elevation view of another example of the adjustable dumbbell shown in FIG. 43.

FIG. 55 is a side elevation view of the adjustable dumbbell 102 implementation. As mentioned, the adjustable dumbbell 102 may include a sensor board 804 configured to provide positional information to a computing device 502 that determines the amount of weight retained on the handle assembly 114. Specifically, the sensor board 804 senses the rotational position of, for example, a separator disc 721 that has been modified to include a rotational position encoding, as well as the rotational position of the indexing disc 120 and selector discs 122. Because the specific combination of weights 108 retained on the handle assembly 114 corresponds to specific angular positions for the discs 821, 120, 122, the computing device 502 can use the positional information received from the sensor board 804 to determine the amount of weight retained on the handle assembly 114. Accordingly, the computing device 502 may determine the amount of weight being retained on the handle assembly 114 by referencing the rotational position information received from the circuit board 704 against this look-up table or by inputting this information into an appropriate equation.

Figure 57A:
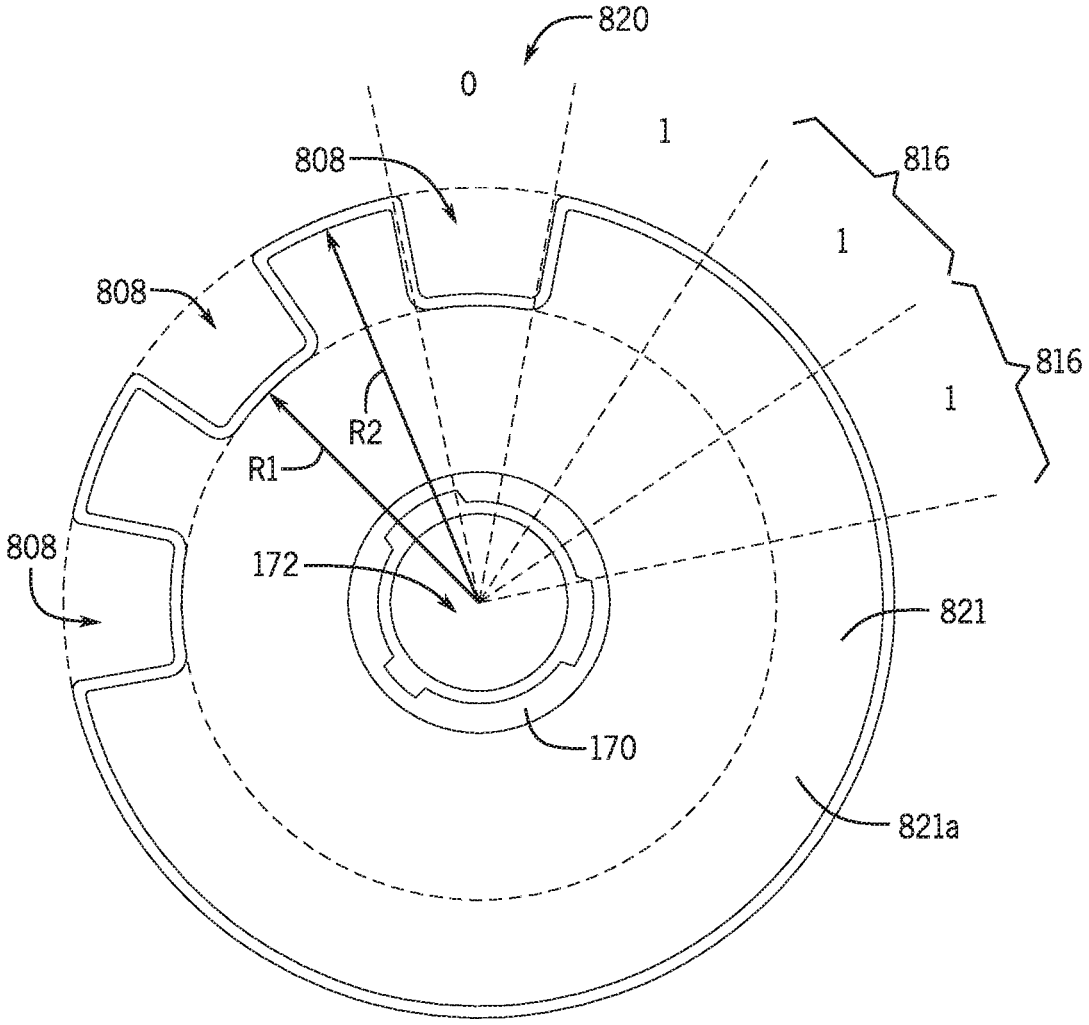
FIG. 57A is a side elevation view elevation view of the modified separator disc shown in FIG. 55.

FIG. 57A is a side elevation view elevation view of a separator disc 821 that has been modified to include a partial rotational position encoding. The separator disc 821 is modified from that of the separator disc 121 shown in FIG. 11 by the inclusion of a plurality of cut-outs 808 that partially encode the rotational position of the separator disc 908. The cut-outs 808 are arranged such that the separator disc 821 has a reduced radius R1 at certain angular positions, where the radius R1 is smaller than the radius R2 of the remainder of the separator disc 821. An outer concentric ring 812*a* can be defined on the separator disc 821 that includes portions of the separator disc 821 disposed at radial distances greater than R1, but less than or equal to R2. Within the concentric ring 812*a*, material that forms the separator disc 821 is absent at those angular positions having cut-outs 808. Similarly, material that forms the separator disc 821 is present at those angular positions not having cut-outs 808. As shown in FIG. 57B through FIG. 57E, concentric rings similar to the concentric ring 812*a* of the separator disc 821 can be defined for the indexing disc 120 and selector discs 122.

Figure 57B:
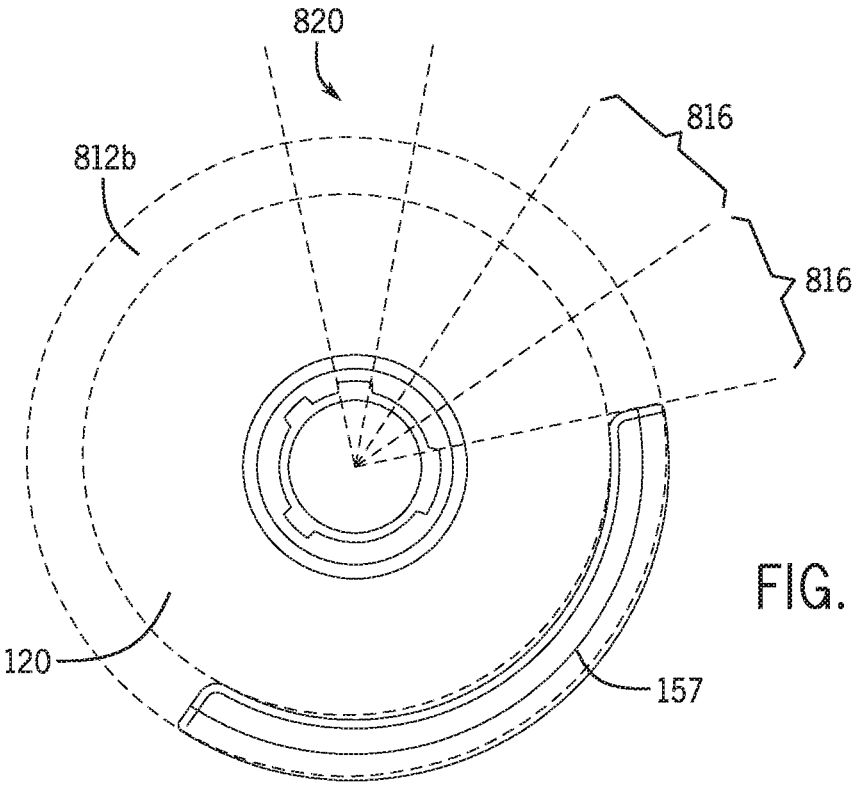
FIG. 57B is a cross section of the indexing disc shown in FIG. 10.

FIG. 57B is a cross section of the indexing disc 120 shown in FIG. 10. The cross section of FIG. 57B is set-off from the outer surface of the indexing disc 120 so as to intersect with the weight selection feature 157. An outer concentric ring 812*b* can be defined for the separator disc 821 that includes portions of the separator disc 821 disposed at radial distances greater than R1, but less than or equal to equal to R2, where R1 and R2 are defined in connection with FIG. 57A. Within the concentric ring 812*b*, material that forms the indexing disc 120 is absent at those angular positions where the weight selection feature 157 is absent. Similarly, material that forms the indexing disc 120 is present at those angular positions where the weight selection feature 157 is present.

Figure 57C:
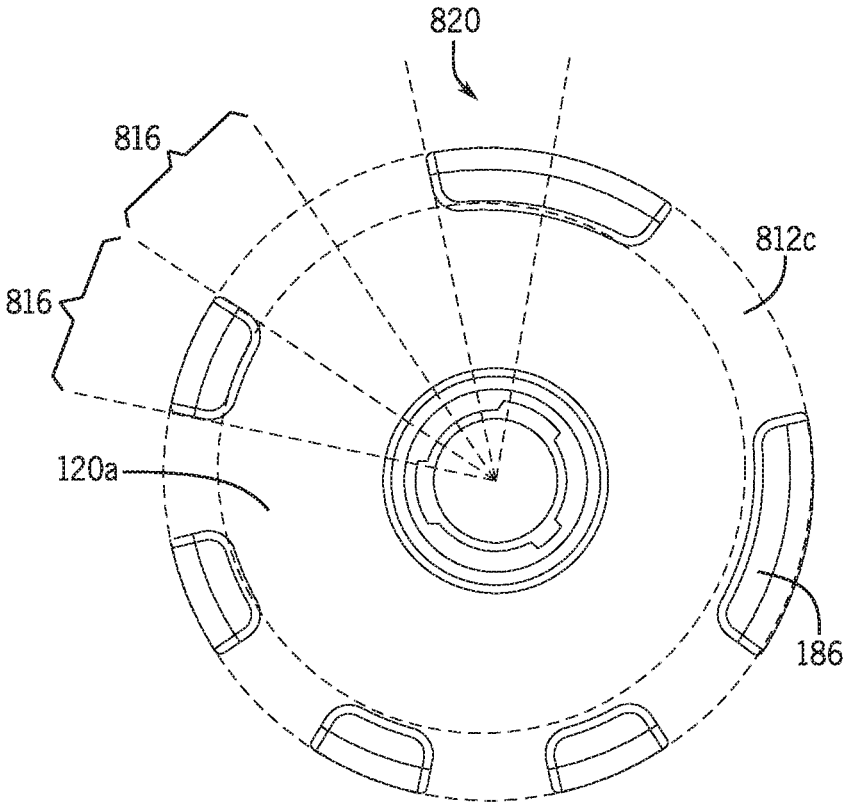
FIG. 57C is a cross section of the first selector disc shown in FIG. 13.

FIG. 57C is a cross section of the first selector disc 120*a* shown in FIG. 13. The cross section of FIG. 57C is set-off from the inner surface of the selector disc 120*a* so as to intersect with the weight selection feature 186. A first outer concentric ring 812*c* can be defined for the selector disc 120*a* that includes portions of the selector disc 120*a* disposed at radial distances greater than R1, but less than or equal to equal to R2, where R1 and R2 are defined in connection with FIG. 57A. Within the concentric ring 812*c*, material that forms the selector disc 120*a* is absent at those angular positions where the weight selection feature 186 is absent. Similarly, material that forms the selector disc 120*a* is present at those angular positions where the weight selection feature 186 is present.

Figure 57D:
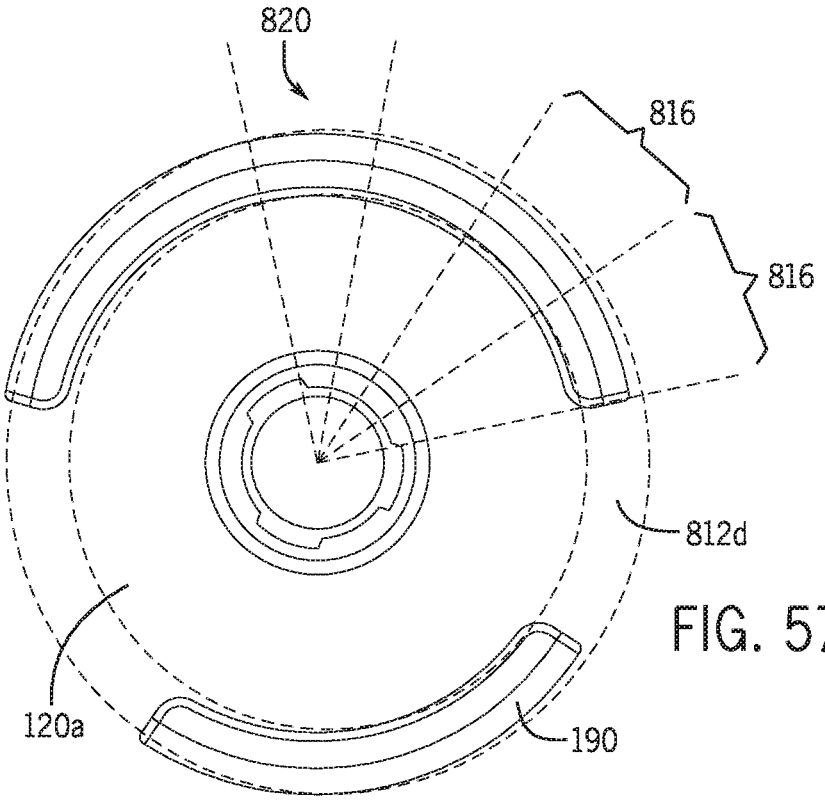
FIG. 57D is a cross section of the first selector disc shown in FIG. 14.

FIG. 57D is a cross section of the first selector disc 120*a* shown in FIG. 14. The cross section of FIG. 57D is set-off from the outer surface of the selector disc 120*a* so as to intersect with the weight selection feature 190. A second outer concentric ring 812*d* can be defined for the selector disc 120*a* that includes portions of the selector disc 120*a* disposed at radial distances greater than R1, but less than or equal to equal to R2, where R1 and R2 are defined in connection with FIG. 57A. Within the concentric ring 812*d*, material that forms the selector disc 120*a* is absent at those angular positions where the weight selection feature 190 is absent. Similarly, material that forms the selector disc 120*a* is present at those angular positions where the weight selection feature 190 is present.

Figure 57E:
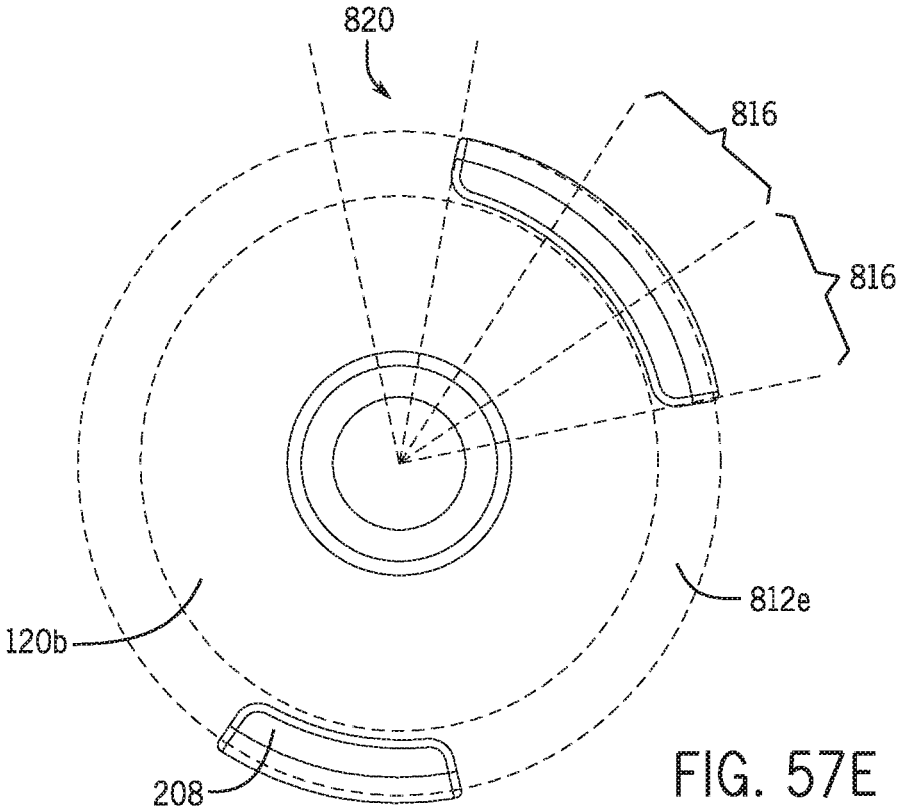
FIG. 57E is a cross section of the second selector disc shown in FIG. 16.

FIG. 57E is a cross section of the second selector disc 120*b* shown in FIG. 16. The cross section of FIG. 57D is set-off from the outer surface of the selector disc 120*b* so as to intersect with the weight selection feature 208. An outer concentric ring 812*e* can be defined for the selector disc 120*b* that includes portions of the selector disc 120*b* disposed at radial distances greater than R1, but less than or equal to equal to R2, where R1 and R2 are defined in connection with FIG. 57A. Within the concentric ring 812*e*, material that forms the selector disc 120*b* is absent at those angular positions where the weight selection feature 208 is absent. Similarly, material that forms the selector disc 120*a* is present at those angular positions where the weight selection feature 208 is present.

The concentric rings 812*a-e* can each be considered as having sixteen equally sized sectors 816. The concentric rings 812*a-e* encode the rotational position of the discs 821, 120, 122 by forming a unique pattern for each rotational position using adjacent disc sectors 716 that are grouped across all of the concentric rings 812*a-e*. The sensor board 804 is arranged to sense the ring patterns that are present at the 12 o'clock positions 820 shown in FIG. 57A through FIG. 5E. Because each group of adjacent disc sectors 816 forms a unique pattern, the sensor board 804 detects which of the sixteen groups of adjacent sectors 816 is present at the 12 o'clock 820 position by sensing which pattern of rings 812*a-e* is present at the 12 o'clock position 820. Thus, the rings 812*a-e* encode sixteen discrete rotational positions that can be sensed by the sensor board 804.

As mentioned, unique ring 812*a-e* patterns are formed for each group of adjacent disc sectors 816. In this way, the rings 812*a-e* form a binary symbol system where the presence of a material in the ring 812*a-e* corresponds to one symbol and the absence of material in the ring 812*a-e* corresponds to the other symbol. Viewed as binary numbers, the absence of material in the ring 812*a-e* may correspond to a "0" and the presence of a material in the ring 812*a-e* may correspond to a "1." With five rings 812*a-e*, there are $2^5$ or thirty-two possible binary numbers. Because there are a total of sixteen groups of adjacent disc sectors 816, the rings 812*a-e* define an encoding may where each group of adjacent disc sectors 816 corresponds to a unique binary number. However, because thirty-two is greater than sixteen, not every binary number in the system corresponds to a group of adjacent disc sectors 816.

Figure 56:
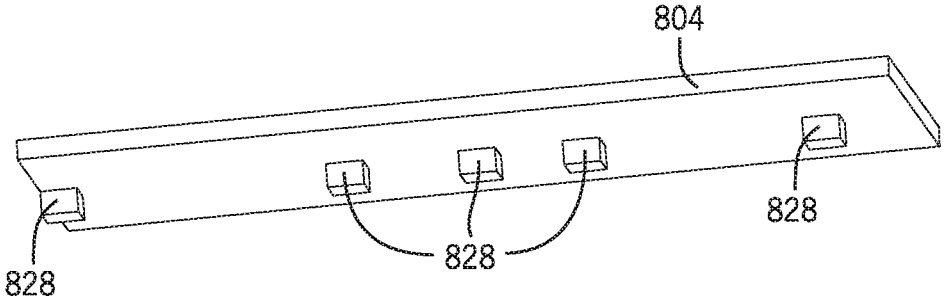
FIG. 56 is an enlarged view of the sensor board shown in FIG. 55.

FIG. 56 is an enlarged view of the sensor board 804. The sensor board 804 may include a plurality of optical reflective type sensors 828*a-e*. The sensors 828*a-e* are arranged to sense the pattern of rings 812*a-e* that is present in the 12 o'clock position 820 shown in FIG. 57A through FIG. 5E. The number of sensors 828 disposed on the sensor board 804 corresponds to the number of rings 812*a-e* defined by the discs 821, 120, 122. Thus, for the rings shown in FIG. 57A through FIG. 5E, the sensor board 804 includes five sensors 828*a-e*. Each sensor 828*a-e* is associated with a particular ring 812*a-e* and; in connection with that particular ring 828*a-e*, the sensor 828*a-e* is arranged to detect the presence or absence of a material within the ring 812*a-e*.

The sensors 828 detect the presence or absence of material within the rings 828*a-e* by emitting light beams toward the rings 828*a-e*. If there is material within the ring 828*a-e* and thus in the path of the light beam, the corresponding sensor 828 registers the presence of the material because a light beam that is transmitted by a transmitter portion of the sensor 828 is reflected back and received by a receiver portion of the sensor 828. If there is not material within the ring 828*a-e* and thus not in the path of the light beam, the corresponding sensor 828 registers the absence of the material because the light beam is not reflected back to the sensor 828.

The sixteen groups of adjunct sectors 816 are arranged such that each group of adjacent sectors 816 corresponds to one of the sixteen possible weight 108 combinations that can be retained on the handle assembly 114. Specifically, the groups of adjunct sectors 816 are arranged such that when detents 140 engage the indicator feature 156 to fully engage the weights 108 with the handle assembly 114, one and only group of adjunct sectors 816 is in the 12 o'clock position 820 shown in FIG. 57A through FIG. 5E. When the weights 108 are fully engaged with the handle assembly 114, a specific pattern of weights 108 is retained on the handle assembly 114. Thus, the particular pattern of weights 108 that is retained on the handle assembly 114 can be determined by detecting which of the groups of adjunct sectors 816 is in the 12 o'clock position 820. As mentioned, the particular group of adjunct sectors 816 that is in the 12 o'clock position 820 can be determined by the positional information that is encoded by the rings 828*a-e*. Here, the sensor board 804 senses the presence or absence of material within the ring 828*a-e* and transmits this encoded positional information to the computing device 502. The computing device 502, in turn, determines the amount of weight retained on the handle assembly by comparing the encoded information against a stored look-up table or other data structure. Alternatively, the computing device 502 may calculate the amount of weight being retained on the handle assembly 114 by using equations that specify mathematical relationships between sensor data values and specific weights amounts.

Sensing Weight Amounts with an Accelerometer

Figure 58:
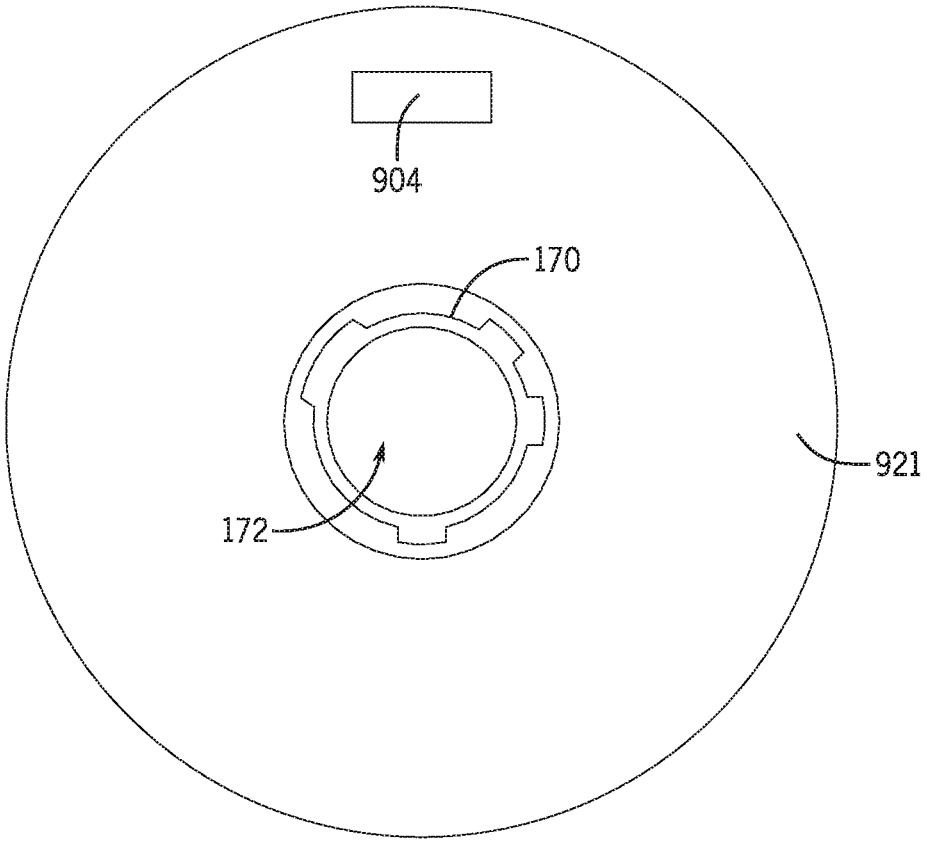
FIG. 58 is a side elevation view a modified separator disc that includes an accelerometer.

Referring to FIG. 58, in an alternative example, the computing device 502 may determine the amount of weight that is retained on the handle assembly 114 based on acceleration measurements made by an accelerometer. FIG. 58 is a side elevation view a modified separator disc 921. The separator disc 621 is modified from that of the separator disc 121 shown in FIG. 11 by the inclusion of an accelerometer 904. The accelerometer 904 may be configured to sense accelerations and to send acceleration data to the computing device 502. The computing device 502 may then use this data to determine an angular change that indicates a rotational position of the handle. Here, gravity (which is a form of acceleration measured by the accelerometer 904) is measured on various axes of the accelerometer 904 to determine the orientation of the disk 921 relative to gravity. The angular change relative to gravity that indicates rotational position is calculated by the computing device 502 from the direction gravity is acting on the accelerometer 904. Because the separator disc 821 is rotationally interlocked with the indexing disc 120 and the selector discs 122, the rotational position of the separator disc 821 corresponds to a specific amount of weight being retained on the handle assembly 114. Thus, by sensing accelerations and calculating angular changes in a gravity vector of the modified separator disc 821, the accelerometer 904 and computing device 502 can derive data that the computing device 502 can use to determine the amount of angular displacement and thus the rotational position of the handle. With the rotational position of the handle known, the computing device 502 can determine the amount of weight retained on the handle assembly 114. Positional sensing through an accelerometer is an example of a sensing mechanism that detected movement. In other implementations, other sensors such as gyroscopes and magnetometers may be used.

Alternative Weight Sensor Implementations

In some implementations, an adjustable dumbbell includes at least one sensor that is configured to detect the rotational position of an indicator member, such as a disc or the like, by detecting a sensible parameter having a substantially continuous range of possible values. A sample value is then passed from the sensor to the computing device, which determines which of the plurality weights are fixedly connected to the handle assembly by determining in which of two or more sub-ranges of the continuous range the sensed parameter is detected. As described below, the continuous range of sensible values may be the displacement of a mechanical linkage, the capacitance or inductance of a material arranged on the indicator member or disc, the direction of a magnetic field, and so on.

Figure 59B:
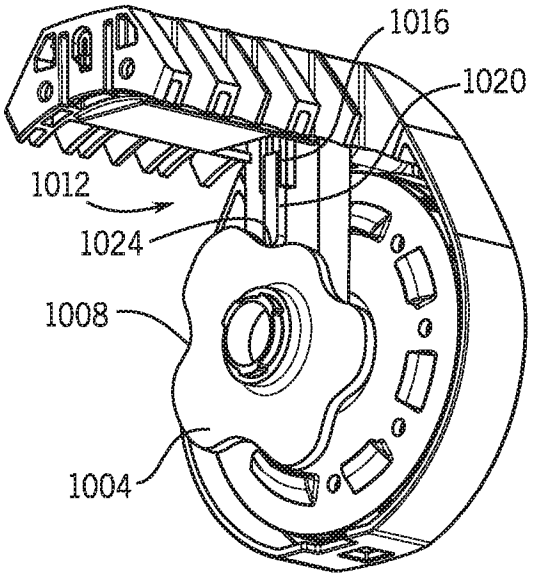
FIG. 59B is a perspective view of an alternative sensor configuration having a potentiometer.
Figure 59A:
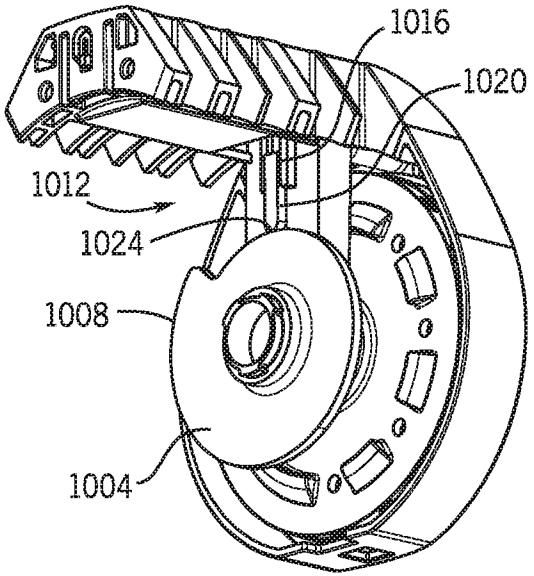
FIG. 59A is perspective view of a sensor configuration that includes a potentiometer.

Referring to FIG. 59A and FIG. 59B, an adjustable dumbbell system includes a disc 1004 having a perimeter 1008 with a varying surface shape or profile. In one example, as shown in FIG. 59A, the perimeter 1008 is a spiral-shaped perimeter. Generally, as shown in FIG. 59B, the perimeter 1008 is such that at least some of the points along at least a portion of the perimeter 1008 are disposed at different distances from a center of the disc 1004. The disc 1004 having the varying perimeter 1008 may be provided in association with a sensor 1012 that includes a potentiometer 1016 having a mechanical linkage 1020. The potentiometer 1016 could be any potentiometer having a suitable mechanical structure such as a linear potentiometer, a rotary potentiometer, and so on. A first end 1024 of the mechanical linkage 1020 may be in contact the perimeter 1008 of the disc 1004. In operation, the perimeter 1008 of disc 1004 may move the mechanical linkage 1020 when the disc 1004 rotates due to the varying shape of the perimeter 1008. Here, the disc 1004 may move the mechanical linkage 1020 against the action of a bias mechanism that urges the linkage 1020 in a downward direction. The sensor 1012 may be configured to detect a displacement of the mechanical linkage 1020 that occurs as the disc 1004 rotates. In this way, the sensor 1012 may detect the rotational position of the disc 1004 and thus the amount of weight retained on the handle assembly based on the displaced of the mechanical linkage 1020.

Figure 60:
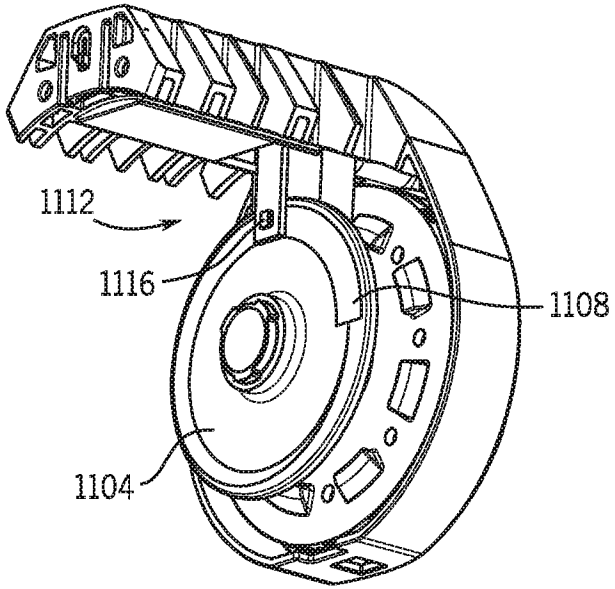
FIG. 60 is perspective view of a sensor configuration that includes a capacitive and/or inductive sensor.

Referring to FIG. 60, an adjustable dumbbell system includes a disc 1104 having a concentric ring 1108 of material positioned on a surface of the disc 1104. The material in the ring 1108 may have an electrical property that has a different magnitude at each angular position along the ring 1108. For example, the material in the ring 1108 may exhibit a capacitance or inductance of varying magnitude. The ring 1108 of material may be provided in association with a sensor 1112 that includes an electrical sensing portion 1116 adjacent to the ring 1108 of material. The electrical sensing portion 1116 may be configured to detect the magnitude of the electrical property of the ring 1108 of material as the disc 1104 rotates. In this way, the sensor 1112 may detect the rotational position of the disc 1104 and thus the amount of weight retained on the handle assembly based on the detected magnitude of the electrical property. As shown in FIG. 60, material could be placed on a face of the disc 1104. Alternatively, material could be placed on other areas of the disc 1104, such as on the edge of the disc.

Figure 61B:
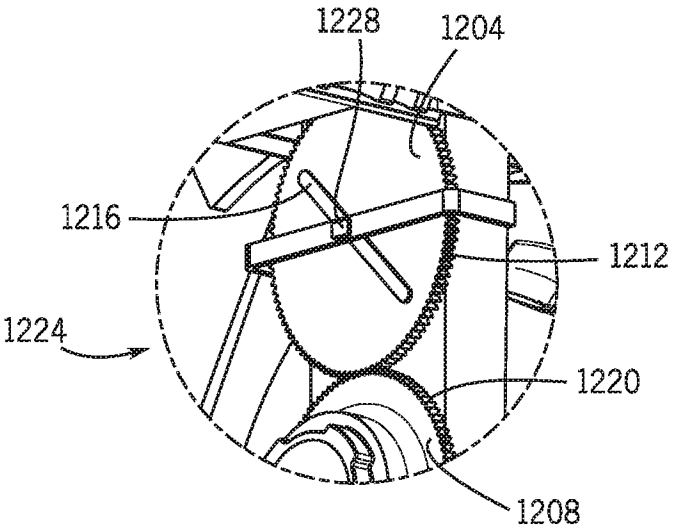
FIG. 61A-B is perspective view of a sensor configuration that includes a magnetic sensor.
Figure 61A:
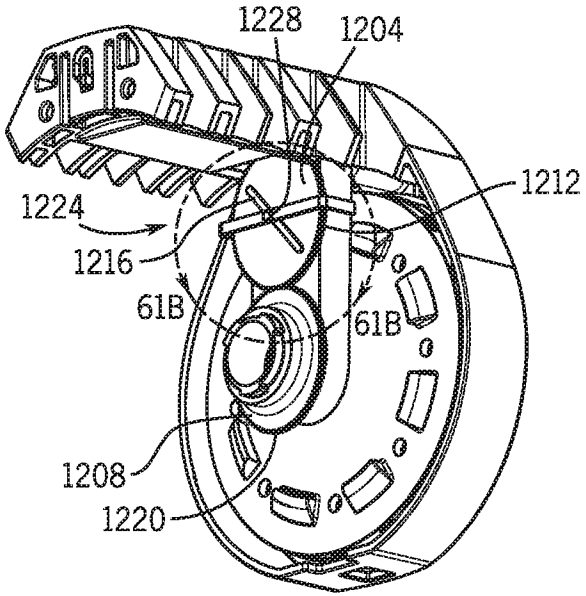

Referring to FIG. 61A and FIG. 61B, an adjustable dumbbell system includes a wheel 1204 positioned on the handle assembly adjacent to a disc 1208 that rotates with the handle. The wheel 1204 may have a plurality of teeth 1212 arranged along a perimeter of the wheel 1204 and a magnet 1216 positioned on a surface of the wheel 1204. The magnet 1216 may be formed in the shape of strip, circle, oval, or any suitable shape. The magnet 1216 may be arranged such that a magnetic field direction of the magnet 1216 varies with a rotational position of the wheel 1204. Further, the disc 1208 may include plurality of teeth 1220 arranged along a perimeter of the disc 1208. The teeth 1220 of the disc 1208 may be arranged to intermesh with the teeth 1212 of the wheel 1204 such that the rotation of the disc 1208 causes a corresponding rotation of the wheel 1204. The wheel 1204 may be provided in association with a sensor 1224 that includes a magnetic sensing portion 1228 adjacent to the magnet 1216 disposed on the wheel 1204. The magnetic sensing portion 1228 may be configured to detect a direction of the magnetic field of the magnet 1216 as the wheel 1204 rotates due to the rotation of the disc 1208. In this way, the sensor 1224 may detect the rotational position of the disc 1208 and thus the amount of weight retained on the handle assembly based on the detected direction of the magnetic field of the magnet 1216. In an alternative implementation, magnetic sensing could be done without a disc and a wheel having intermeshing teeth. Specifically, a magnet may be located at the end of the handle and a magnetic sensor located over the magnet.

Sensing the Add-On Weight

The computing device 502 may additionally be configured to determine if the add-on weights 240 are retained on the handle assembly 114. In this regard, the adjustable dumbbell may include an add-on weight sensor that determines if the add-on weights 240 are engaged with the handle assembly 114 so as to be retained by the weight attachment feature 224 when the dumbbell 102 is lifted out of the support base 104. As shown in FIG. 18, the add-on weight sensor 1004 may be attached to a portion of the end cap 124 in a position that allows the sensor 1004 to detect the position of the plunger 266 that is associated with the add-on weight engagement assembly 254. The add-on sensor 1004 may be configured to detect that an add-on weights 240 is engaged by sensing that the selection member 266 spans across the separation plane 352 to engage the handle assembly 114. Similarly, the add-on sensor 1004 may be configured to detect that an add-on weights 240 is not engaged by sensing that the selection member 266 does not span across the separation plane 352.

The add-on weight sensor 1004 may be implemented using any mechanism capable of sensing the position of the selection member 266, such as optical sensing or mechanical sensing. If implemented as an optical sensor, the add-on weight sensor 1004 may function my emitting a light beam that reflected or interrupted in the event that the selection member 266 spans across the separation plane 352 and that is not reflected or not interrupted in the event that the selection member 266 does not span across the separation plane 352. If implemented as a mechanical sensor, the add-on weight sensor 1004 may an actuator that moves to one position in the event that the selection member 266 spans across the separation plane 352 and moves to another position in the event that the selection member 266 does not span across the separation plane 352. Regardless of the form taken by the add-on weight sensor 1004, the sensor 1004 may be configured to sense the position of the selection member 266 and to covey this information to this computing device 502, which, in turn, uses this information in calculating the amount of weight retained on the handle assembly 114.

The foregoing has many advantages. For instance, as described, the dumbbell system may provide a single dumbbell that accommodates lighter weight workouts with relatively small weight increments between weight selections and heavier weight workouts without disassembling the handle assembly. The dumbbell system may include two different types of weight selection methods. One weight selection method may involve rotating a handle about an axis of rotation to join one or more weights to a handle assembly of the dumbbell via rotation of indexing and/or selector discs. Such as selection method may be useful on a lighter weight dumbbell and/or may allow for relatively small incremental weight selections, such as two and one-half pound increments, between lower and upper weight limits for the adjustable dumbbell. The other weight selection method may involve rotating a selector to linearly move a selection member to couple a weight to a handle assembly of the dumbbell. This selection method may be useful to join relatively large weights to the dumbbell to significantly increase the upper weight limit of an existing adjustable dumbbell that uses another selection method to join its other weights to the handle assembly.

Each add-on weight may be joined to an adjacent add-on weight utilizing one of the selection assemblies described herein and suitably modified as needed. Any such add-on weights may further be modified to include a weight attachment feature to interact with a corresponding weight attachment features on an adjacent add-on weight. Thus, an adjustable dumbbell with a plurality of weights on each end of the handle assembly could be formed using solely add-on weights that incorporate a selection assembly on the add-on weight.

As used in the claims with respect to connection between a weight and the handle assembly, the phrases "fixedly connected," "fixedly joined," or variations thereof (e.g., "fixedly connects" or "fixedly joins") refer to a condition in which the connection between the weight and the handle assembly is such that all six degrees of rigid body motion freedom (i.e., translation in three perpendicular axes and rotation about the three perpendicular axes) are restrained between the weight and the handle assembly. In the "fixedly connected" or "fixedly joined" state, the weight is intended to contribute to the total weight of the dumbbell by remaining joined to the handle assembly during use in an exercise by the user. Further, as used in the claims with respect to the weights being connected to the handle assembly, the phrases "not fixedly connected," "not fixedly joined," or variations thereof (e.g., "not fixedly connects" or "not fixedly joins") refer to a condition in which the connection between the weight and the handle assembly is such that at least one of the translation degrees of freedom is not restrained between the weight and the handle assembly. In the "not fixedly connected" or "not fixedly joined" state, the handle assembly is movable relative to the weight along a non-restrained translation degree of freedom so that upon sufficient movement of the handle assembly relative to the weight, the weight is disconnected from the handle assembly as the weight is not intended to contribute to the total weight of the dumbbell during use in the exercise. Further, in the "not fixedly connected" or "not fixedly joined" state, if the weight is not removed from the handle assembly prior to the start of the exercise by sufficiently moving the handle assembly relative to the dumbbell along the non-restrained translation degree of freedom, the weight will become disconnected from the handle assembly (typically by sliding off the handle assembly) when the weight moves sufficiently along the non-restrained translation degree of freedom during the exercise.

The foregoing description has broad application. The discussion of any embodiment is meant only to be explanatory and is not intended to suggest that the scope of the disclosure, including the claims, is limited to these examples. In other words, while illustrative embodiments of the disclosure have been described in detail herein, the inventive concepts may be otherwise variously embodied and employed, and the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. An adjustable dumbbell system, comprising:

a handle assembly including a disc that is rotatable into a set of discrete rotational positions;

a plurality of weights selectively fixedly connectable to the handle assembly, each discrete rotational position of the set of discrete rotational positions of the disc corresponding to a different combination of the plurality of weights fixedly connected to the handle assembly;

a sensor configured to detect each discrete rotational position of the set of discrete rotational positions of the disc; and a computing device in communication with the sensor and configured to determine which of the plurality of weights are fixedly connected to the handle assembly based on each discrete rotational position of the set of discrete rotational positions of the disc detected by the sensor, wherein the sensor is positioned on the handle assembly so as to remain in a fixed position during rotation of the disc.

2. The adjustable dumbbell system of claim 1, wherein the sensor comprises at least one of the following: an optical sensor, a reflective sensor, a mechanical sensor, an inductive sensor, a capacitive sensor, a potentiometer, an accelerometer, or a magnetometer.

3. The adjustable dumbbell system of claim 1, wherein the handle assembly further includes a handle operatively associated with the disc so as to rotate with the disc.

4. The adjustable dumbbell system of claim 1, further comprising a rotational position encoding feature arranged on the disc so as to encode each of a plurality of disc sectors with a unique binary number, each disc sector corresponding to one of the discrete rotational positions of the set of discrete rotational positions of the disc.

5. The adjustable dumbbell system of claim 4, wherein:

the sensor comprises a plurality of sensors configured to cooperate with the rotational position encoding feature to detect a different one of the unique binary numbers when the disc is in each of the discrete rotational positions of the set of discrete rotational positions; and the computing device is configured to determine which of the plurality of weights are fixedly connected to the handle assembly based on the detected unique binary number.

6. The adjustable dumbbell system of claim 5, wherein:

the rotational position encoding feature encodes each disc sector with the respective unique binary number by encoding each of a plurality of sector subdivisions with either a first binary digit or a second binary digit; and the plurality of sensors are configured to sense the respective unique binary number by respectively sensing each of the sector subdivision encodings with each one of the plurality of sensors arranged to sense one of the sector subdivision encodings when the disc is in a particular one of the discrete rotational positions of the set of discrete rotational positions.

7. The adjustable dumbbell system of claim 6, wherein:

the rotational position encoding feature comprises a plurality of tabs arranged around a perimeter of the disc and extending axially outward from the perimeter, a presence of one of the plurality of tabs in a particular sector subdivision corresponding to the particular sector subdivision being encoded with the first binary digit, and an absence of one of the plurality of tabs in the particular sector subdivision corresponding to the particular sector subdivision being encoded with the second binary digit; and each one of the plurality of sensors comprises an optical interrupt sensor, each optical interrupt sensor including a transmitter and an opposing receiver respectively disposed on opposing sides of the plurality of tabs, the transmitter configured to emit a light beam toward the opposing receiver, each optical interrupt sensor configured to detect that the particular sector subdivision is encoded with the first binary digit by sensing that the light beam emitted by the transmitter is blocked by one of the plurality of tabs so as to prevent reception of the light beam by the opposing receiver, and configured to detect that the particular sector subdivision is encoded with the second binary digit by sensing that the light beam emitted by the transmitter is not blocked by one of the plurality of tabs so as to be received by the opposing receiver.

8. The adjustable dumbbell system of claim 6, wherein:

the rotational position encoding feature comprises a plurality of surface features disposed on a surface of the disc, a presence of a surface feature in a particular sector subdivision corresponding to the particular sector subdivision being encoded with the first binary digit, and an absence of the surface feature in the particular sector subdivision corresponding to the particular sector subdivision being encoded with the second binary digit; and each one of the plurality of sensors comprises a mechanical sensor, each mechanical sensor movable into an unactuated position by an action of a sensor biasing mechanism when a sensor contact is engaged with one of the surface features, and movable into an actuated position by an application of a mechanical force by the surface of the disc that acts against the sensor biasing mechanism when the sensor contact is not engaged with the respective one of the surface features, each mechanical sensor configured to detect if the particular sector subdivision is encoded with the first binary digit by sensing that the mechanical sensor is in the unactuated position and configured to detect if the particular sector subdivision is encoded with the second binary digit by sensing that the mechanical sensor is in the actuated position.

9. The adjustable dumbbell system of claim 1, wherein:

the sensor is configured to detect each discrete rotational position of the set of discrete rotational positions of the disc by detecting a sensible parameter including a substantially continuous range of possible values, the substantially continuous range of possible values divided into at least one sub-range, each of the at least one sub-range associated with a particular number of the plurality of weights; and the computing device is configured to determine which of the plurality of weights are fixedly connected to the handle assembly by determining which sub-range of the at least one sub-range is detected.

10. The adjustable dumbbell system of claim 1, wherein:

the disc comprises a contoured perimeter such that points along at least a portion of the contoured perimeter are disposed at a different distance from a center of the disc; and the sensor comprises a potentiometer operatively associated with the contoured perimeter to detect the each discrete rotational position of the set of discrete rotational positions of the disc.

11. The adjustable dumbbell system of claim 1, wherein:

the disc comprises a concentric ring of material positioned on a surface of the disc, wherein a plurality of angular positions are disposed along the concentric ring, the material including an electrical property that has a different magnitude at each angular position along the concentric ring;

the sensor comprises an electrical sensing portion adjacent to the concentric ring of material, the electrical sensing portion configured to detect the different magnitudes of the electrical property of the concentric ring of material as the disc rotates; and the sensor is configured to detect each discrete rotational position of the set of discrete rotational positions of the disc based on the detected different magnitudes of the electrical property.

12. The adjustable dumbbell system of claim 1, further comprising a magnet joined to the handle assembly, the magnet having a magnetic field and configured to change a direction of the magnetic field as the disc rotates.

13. The adjustable dumbbell system of claim 12, wherein:

the sensor comprises a magnetic sensing portion adjacent to the magnet, the magnetic sensing portion configured to detect the direction of the magnetic field of the magnet; and the sensor is configured to detect each discrete rotational position of the set of discrete rotational positions of the disc based on the detected direction of the magnetic field of the magnet.

14. The adjustable dumbbell system of claim 1, wherein at least one weight of the plurality of weights includes a selection assembly, the selection assembly including a selection member movable between a selected position where the at least one weight is fixedly connected to the handle assembly and an unselected position where the at least one weight is not fixedly connected to the handle assembly.

15. The adjustable dumbbell system of claim 14, wherein the sensor is configured to detect whether the at least one weight is fixedly connected to the handle assembly by sensing whether the selection member is in the selected position.

16. The adjustable dumbbell system of claim 1, further comprising:

at least one separator disc operatively associated with the disc so as to rotate with the disc, the separator disc including a number of cut-out sections arranged within an outer ring portion of the separator disc; and a plurality of selector discs operatively associated with the disc so as to rotate with the disc, each selector disc including engagement features that retain a particular weight of the plurality of weights on the handle assembly in certain rotational positions of each respective selector disc.

17. The adjustable dumbbell system of claim 16, wherein the sensor comprises a plurality of reflective optical sensors positioned on the handle assembly, the plurality of reflective optical sensors configured to sense a unique pattern of cut-out sections and engagement features formed at a position proximate to the plurality of reflective optical sensors.

18. The adjustable dumbbell system of claim 17, wherein the computing device is configured to determine which weights of the plurality of weights are fixedly connected with the handle assembly based on the unique pattern of cut-out sections and engagement features detected by the plurality of reflective optical sensors.

* * * * *